US009581351B2

(12) United States Patent
Kumamoto et al.

(10) Patent No.: US 9,581,351 B2
(45) **Date of Patent: *Feb. 28, 2017**

(54) AIR CONDITIONING APPARATUS WITH CONTROL DEVICE FOR VARYING THE ANGLE OF AIR CONDITIONING DISCHARGE FLAPS

(71) Applicant: DAIKIN INDUSTRIES, LTD., Osaka-shi, Osaka (JP)

(72) Inventors: Gen Kumamoto, Kusatsu (JP); Satoshi Hashimoto, Sakai (JP)

(73) Assignee: Daikin Industries, Ltd., Osaka (JP)

( * ) Notice: Subject to any disclaimer, the term of this patent is extended or adjusted under 35 U.S.C. 154(b) by 0 days.

This patent is subject to a terminal disclaimer.

(21) Appl. No.: 15/045,115

(22) Filed: Feb. 16, 2016

(65) Prior Publication Data

US 2016/0231015 A1 Aug. 11, 2016

Related U.S. Application Data

(62) Division of application No. 13/497,701, filed as application No. PCT/JP2010/066239 on Sep. 17, 2010, now Pat. No. 9,297,547.

(30) Foreign Application Priority Data

| | | |
|---|---|---|
| Sep. 28, 2009 | (JP) | 2009-223486 |
| Mar. 24, 2010 | (JP) | 2010-067381 |
| Jun. 24, 2010 | (JP) | 2010-144018 |

(51) Int. Cl.
*F24F 13/14* (2006.01)
*F24F 11/00* (2006.01)
(Continued)

(52) U.S. Cl.
CPC ..... *F24F 11/0078* (2013.01); *F24F 1/0011* (2013.01); *F24F 1/0014* (2013.01);
(Continued)

(58) Field of Classification Search
CPC .. F24F 1/0011; F24F 11/0001; F24F 11/0078; F24F 11/022; F24F 2007/005; F24F 2011/0063
(Continued)

(56) References Cited

U.S. PATENT DOCUMENTS

| | | | |
|---|---|---|---|
| 5,039,008 | A | 8/1991 | Sugawara et al. |
| 5,775,989 | A | 7/1998 | Choi |

(Continued)

FOREIGN PATENT DOCUMENTS

| | | | |
|---|---|---|---|
| CN | 1400432 | A | 3/2003 |
| JP | 61-49244 | U | 4/1986 |

(Continued)

OTHER PUBLICATIONS

International Search Report of corresponding PCT Application No. PCT/JP2010/066239 dated Dec. 14, 2010.

*Primary Examiner* — Jonathan Bradford
(74) *Attorney, Agent, or Firm* — Global IP Counselors

(57) ABSTRACT

An air conditioning apparatus includes a control device that controls a swing action of flaps of an air conditioning apparatus. The flaps are swung up and down. The control device includes an operation mode determining section, a swing pattern storage area and a control command generator. The operation mode determining section determines at least an air-cooling operation mode and an air-warming operation mode that are operation modes of the air conditioning apparatus. The swing pattern storage area stores a plurality of swing patterns that include information pertaining to the swing action. The control command generator generates a control command of the air conditioning apparatus on the basis of a swing pattern corresponding to the mode determined by the operation mode determining section from among the plurality of swing patterns.

13 Claims, 48 Drawing Sheets

(51) Int. Cl.
*F24F 11/02* (2006.01)
*F24F 1/00* (2011.01)

(52) U.S. Cl.
CPC ..... *F24F 11/0012* (2013.01); *F24F 11/022* (2013.01); *F24F 13/1413* (2013.01); *F24F 2001/0037* (2013.01); *F24F 2011/0063* (2013.01); *F24F 2011/0064* (2013.01); *F24F 2011/0083* (2013.01)

(58) Field of Classification Search
USPC ..... 62/186, 404, 408, 409
See application file for complete search history.

(56) References Cited

U.S. PATENT DOCUMENTS

| | | | |
|---|---|---|---|
| 2004/0244391 | A1 | 12/2004 | Kouno et al. |
| 2006/0254293 | A1 | 11/2006 | Lee et al. |
| 2008/0254734 | A1 | 10/2008 | Uenaka et al. |

FOREIGN PATENT DOCUMENTS

| | | | |
|---|---|---|---|
| JP | 1-111151 | A | 4/1989 |
| JP | 1-153441 | U | 10/1989 |
| JP | 7-158933 | A | 6/1995 |
| JP | 9-11694 | A | 5/1997 |
| JP | 9-196435 | A | 7/1997 |
| JP | 10-110997 | A | 4/1998 |
| JP | 2001-133019 | A | 5/2001 |
| JP | 2004-76974 | A | 3/2004 |
| JP | 2005-112036 | A | 4/2005 |
| JP | 2006-336925 | A | 12/2006 |
| JP | 2007-24453 | A | 2/2007 |
| JP | 2007-50781 | A | 3/2007 |
| JP | 2007-218564 | | 8/2007 |

| No | CONTINUOUS TIME DURATION (s) |
|---|---|
| tk0 | 0 |
| tk1 | 10 |
| tk2 | 20 |
| tk3 | 30 |
| tk4 | 40 |
| tk5 | 80 |

FIG. 4

| PHASE | | CONDITION | SWING PATTERN |
|---|---|---|---|
| AIR-COOLING OPERATION MODE | STARTUP PERIOD | DISCHARGE TEMPERATURE > SET TEMPERATURE | PATTERN 1 |
| | STABLE PERIOD 1 | DISCHARGE TEMPERATURE < SET TEMPERATURE -10 CONTINUES FOR 10 MIN NO TEMPERATURE NONUNIFORMITY | PATTERN 2 |
| | STABLE PERIOD 2 | DISCHARGE TEMPERATURE < SET TEMPERATURE -10 CONTINUES FOR 10 MIN TEMPERATURE NONUNIFORMITY | PATTERN 3 |
| AIR-WARMING OPERATION MODE | STARTUP PERIOD | DISCHARGE TEMPERATURE < SET TEMPERATURE | PATTERN 4 |
| | INTERMEDIATE PERIOD 1 | DISCHARGE TEMPERATURE ≥ SET TEMPERATURE | PATTERN 5 |
| | INTERMEDIATE PERIOD 2 | DISCHARGE TEMPERATURE > SET TEMPERATURE +5 CONTINUES FOR 3 MIN | PATTERN 6 |
| | STABLE PERIOD | DISCHARGE TEMPERATURE > SET TEMPERATURE +10 CONTINUES FOR 10 MIN | PATTERN 7 |

FIG. 5

| | FLAP ID | INITIAL POSITION | INITIAL ACTION | CONTINUOUS TIME DURATION PATTERN (ONE CYCLE) | | | | | | | |
|---|---|---|---|---|---|---|---|---|---|---|---|
| | | | | 1st | 2nd | 3rd | 4th | 5th | 6th | 7th | 8th |
| PATTERN 1 | ID1 | DOWNWARD BLOWING | SWING | tk1 | tk1 | tk0 | tk0 | | | | |
| | ID2 | HORIZONTAL BLOWING | SWING | tk0 | tk0 | tk1 | tk1 | | | | |
| | ID3 | HORIZONTAL BLOWING | SWING | tk0 | tk0 | tk1 | tk1 | | | | |
| | ID4 | DOWNWARD BLOWING | SWING | tk1 | tk1 | tk0 | tk0 | | | | |
| PATTERN 2 | ID1 | HORIZONTAL BLOWING | SWING | tk0 | tk4 | tk0 | tk2 | tk0 | tk2 | tk0 | tk4 |
| | ID2 | HORIZONTAL BLOWING | SWING | tk0 | tk2 | tk0 | tk4 | tk0 | tk4 | tk0 | tk2 |
| | ID3 | HORIZONTAL BLOWING | SWING | tk0 | tk2 | tk0 | tk4 | tk0 | tk4 | tk0 | tk2 |
| | ID4 | HORIZONTAL BLOWING | SWING | tk0 | tk4 | tk0 | tk2 | tk0 | tk2 | tk0 | tk4 |
| PATTERN 3 | ID1 | HORIZONTAL BLOWING | SWING | tk0 | tk5 | tk0 | tk4 | tk0 | tk4 | tk0 | tk5 |
| | ID2 | HORIZONTAL BLOWING | SWING | tk0 | tk4 | tk0 | tk5 | tk0 | tk5 | tk0 | tk4 |
| | ID3 | HORIZONTAL BLOWING | SWING | tk0 | tk4 | tk0 | tk5 | tk0 | tk5 | tk0 | tk4 |
| | ID4 | HORIZONTAL BLOWING | SWING | tk0 | tk5 | tk0 | tk4 | tk0 | tk4 | tk0 | tk5 |
| PATTERN 4 | ID1 | HORIZONTAL BLOWING | SWING | tk0 | tk4 | | | | | | |
| | ID2 | HORIZONTAL BLOWING | KEEP | tk4 | tk0 | | | | | | |
| | ID3 | HORIZONTAL BLOWING | KEEP | tk4 | tk0 | | | | | | |
| | ID4 | HORIZONTAL BLOWING | SWING | tk0 | tk4 | | | | | | |
| PATTERN 5 | ID1 | HORIZONTAL BLOWING | KEEP | tk3 | tk0 | | | | | | |
| | ID2 | HORIZONTAL BLOWING | SWING | tk0 | tk3 | | | | | | |
| | ID3 | HORIZONTAL BLOWING | SWING | tk0 | tk3 | | | | | | |
| | ID4 | HORIZONTAL BLOWING | KEEP | tk3 | tk0 | | | | | | |
| PATTERN 6 | ID1 | HORIZONTAL BLOWING | KEEP FOR 10 s | tk0 | tk2 | | | | | | |
| | ID2 | DOWNWARD BLOWING | SWING | tk2 | tk0 | | | | | | |
| | ID3 | DOWNWARD BLOWING | SWING | tk2 | tk0 | | | | | | |
| | ID4 | HORIZONTAL BLOWING | KEEP FOR 10 s | tk0 | tk2 | | | | | | |
| PATTERN 7 | ID1 | HORIZONTAL BLOWING | SWING | tk0 | tk1 | | | | | | |
| | ID2 | DOWNWARD BLOWING | SWING | tk1 | tk0 | | | | | | |
| | ID3 | DOWNWARD BLOWING | SWING | tk1 | tk0 | | | | | | |
| | ID4 | HORIZONTAL BLOWING | SWING | tk0 | tk1 | | | | | | |

FIG. 6

AIR-COOLING - VERY STABLE PERIOD (PATTERN 3)

AIR-WARMING - STARTUP PERIOD (PATTERN 4)

AIR-WARMING - INTERMEDIATE PERIOD 2 (PATTERN 6)

AIR-WARMING - STABLE PERIOD (PATTERN 7)

| | CONSUMED POWER [Wh] IN TEMPERATURE NONUNIFORMITY RESOLUTION PERIOD | CONSUMED POWER [Wh] UNTIL AVERAGE ROOM TEMPERATURE REACHES SET TEMPERATURE |
|---|---|---|
| DOWNWARD BLOWING STATIONARY STATE | APPROX. 900 | APPROX. 600 |
| SWING STATE | APPROX. 700 | APPROX. 300 |

FIG. 26

| | CONSUMED POWER [Wh] IN TEMPERATURE NONUNIFORMITY RESOLUTION PERIOD |
|---|---|
| SWING STATE | APPROX. 700 |
| SWING STATE/DOWNWARD BLOWING STATIONARY STATE | APPROX. 600 |

FIG. 28

| | AMOUNT OF TIME UNTIL AVERAGE ROOM TEMPERATURE REACHES SET TEMPERATURE | CONSUMED POWER UNTIL AVERAGE ROOM TEMPERATURE REACHES SET TEMPERATURE |
|---|---|---|
| HORIZONTAL BLOWING STATIONARY STATE | 28 MIN 00 SEC | APPROX. 400 Wh |
| ALL-SYNCHRONOUS SWING STATE | 66 MIN 00 SEC | APPROX. 800 Wh |
| OPPOSITE-SIDE SWING STATE | 16 MIN 40 SEC | APPROX. 300 Wh |

FIG. 35

| | CONSUMED POWER FROM START OF AIR-COOLING OPERATION UNTIL ONE HOUR ELAPSES |
|---|---|
| HORIZONTAL BLOWING STATIONARY STATE | APPROX. 600 Wh |
| ALL-SYNCHRONOUS SWING STATE | APPROX. 700 Wh |
| OPPOSITE-SIDE SWING STATE | APPROX. 800 Wh |
| OPPOSITE-SIDE SWING STATE / HORIZONTAL BLOWING STATIONARY STATE | APPROX. 500 Wh |

FIG. 36

AIR CONDITIONING APPARATUS WITH CONTROL DEVICE FOR VARYING THE ANGLE OF AIR CONDITIONING DISCHARGE FLAPS

CROSS-REFERENCE TO RELATED APPLICATIONS

This application is a divisional application of U.S. patent application Ser. No. 13/497,701 filed on Mar. 22, 2012, which is a National Stage application of International Patent Application No. PCT/JP2010/066239 filed on Sep. 17, 2010. The entire disclosure of U.S. patent application Ser. No. 13/881,858 is hereby incorporated herein by reference.

The present invention relates to a control device of an air conditioning apparatus in which the direction of an airflow supplied from a discharge port can be varied by controlling a flap disposed over the discharge port.

BACKGROUND ART

Control devices which control the swing action of an air conditioning apparatus are known in conventional practice (e.g., Japanese Laid-open Patent Application No. 9-196435). The control device sends to the air conditioning apparatus a control command causing the angle of a flap to vary. The flow of air blown out from the air conditioning apparatus is thereby shifted up and down, the air in the room is agitated, and deviations in the vertical temperature distribution in the space being air-conditioned are resolved. Particularly, in Japanese Laid-open Patent Application No. 9-196435, the width of a discharge port is adjusted to control the airflow rate of discharged air in accordance with the temperature of the discharged air. Specifically, the airflow rate is controlled so that the airflow rate is low when the discharge temperature is low and the airflow rate is high when the discharge temperature is high. This prevents a strong airflow from directly reaching the user when the discharge temperature is low, and reduces discomfort felt by the user due to a draft.

SUMMARY

Technical Problem

However, in Japanese Laid-open Patent Application No. 9-196435, the swing action that adjusts the airflow direction is a mere up-and-down motion, and only the airflow rate is varied as the discharge temperature changes. Therefore, there is a possibility that a low-temperature airflow will directly reach the user even if the airflow rate is low, and there is a risk that the user will experience more than a little discomfort due to a draft. In Japanese Laid-open Patent Application No. 9-196435, such swing action control is described only for an air-warming operation, and swing action control in an air-cooling operation is not particularly described.

Among actual commercially sold air conditioning apparatuses, there are those in which no time is allowed for the flap to stay in a horizontal blowing or downward blowing state, and it takes 12 seconds for the flap to transition either from horizontal blowing to downward blowing or from downward blowing to horizontal blowing. Specifically, in this air conditioning apparatus, horizontal blowing and downward blowing are repeated in 24 second cycles. In such an air conditioning apparatus, the intervals between the horizontal blowing and downward blowing of the flap are short which does have some effect in resolving temperature discrepancies in the indoor space, but it is difficult for the air conditioning to reach the corners of the space.

Among other air conditioning apparatuses, there are those in which the flap is fixed for 60 seconds in the downward blowing state. With such an air conditioning apparatus, there is a risk that the user will experience discomfort due to a draft because of the long time duration of 60 seconds for downward blowing.

An object of the present invention is to provide a control device for controlling the swing action of an air conditioning apparatus and improving the level of comfort within the room.

Solution to Problem

A control device according to a first aspect of the present invention is a control device for controlling a swing action whereby flaps of an air conditioning apparatus are swung up and down, the control device comprising an operation mode determining section, a swing pattern storage area, and a control command generator. The operation mode determining section determines at least an air-cooling operation mode and an air-warming operation mode that are operation modes of the air conditioning apparatus. The swing pattern storage area stores a plurality of swing patterns that are varieties of information pertaining to the swing action. The control command generator generates a control command of the air conditioning apparatus on the basis of a swing pattern corresponding to the result determined by the operation mode determining section from among the plurality of swing patterns.

Generally, cold air falls readily and warm air rises readily. A user will usually be in the bottom of the space. Therefore, when a ceiling-hanging air conditioning apparatus performs air-conditioning, for example, it is easy to ensure that the user is not directly exposed to an airflow by normally blowing out air in a horizontal direction during the air-cooling operation, but the air is normally blown out in a downward direction during the air-warming operation and the user is readily exposed directly to the airflow.

After some time following the air-cooling operation or the air-warming operation, the air will separate into a layer of cold air and a layer of warm air, the layer of cold air will stagnate at the bottom of the space, and the layer of warm air will stagnate at the top of the space. Thus, when the air in the space has deviation in the temperature distribution relative to the vertical direction, air-conditioning efficiency decreases and the user experiences discomfort. Therefore, performing the swing action of the flaps periodically, unlike normally during the air-cooling operation or the air-warming operation, could possibly resolve this deviation in the temperature distribution.

However, during the air-cooling operation, when the user is directly exposed to the airflow supplied from the discharge ports, there is a risk of the user experience discomfort from a draft. When the swing action is a simple fixed pattern, the comfort felt by the user gradually decreases. During the air-warming operation, since the air supplied from the discharge ports is blown out in a horizontal direction (near the ceiling), this causes deviation in the temperature distribution.

In the control device of the present invention, two operation modes (the air-cooling operation mode and the air-warming operation mode) and a plurality of swing patterns are correlated and stored in the swing pattern storage area. The control command generator selects a swing pattern corresponding to the operation mode determined by the operation mode determining section. The control command generator generates a control command according to the swing action of the flaps on the air conditioning apparatus on the basis of the selected swing pattern. Specifically, the control device of the present invention executes a swing pattern focused on the level of comfort in the space (e.g., a discomfort index or the like) where the air conditioning apparatus is installed, according to the operation mode being performed by the air conditioning apparatus at the time.

Therefore, different swing patterns can be executed so that the swing pattern in the air-cooling operation and the swing pattern in the air-warming operation are optimal for the air-cooling operation and the air-warming operation respectively. Therefore, deviation in the temperature distribution in the vertical direction occurring in the air-conditioned space can be resolved, the discomfort from a draft can be reduced, and the level of comfort in the room can be improved.

A control device according to a second aspect of the present invention is the control device according to the first aspect, further comprising a repeating time interval deciding unit. The repeating time interval deciding unit decides between a first repeating time interval and a second repeating time interval on the basis of the plurality of swing patterns. The first repeating time interval is a time interval until the tilt of the flaps changes from a first orientation to a second orientation and then varies back to the first orientation. The second repeating time interval is a time interval until the tilt of the flaps changes from a second orientation to a first orientation and then changes back to the second orientation. The swing patterns are correlated with the operation modes. The swing action is an action that repeats the first orientation and the second orientation. In the first orientation, the flaps are tilted at a first angle relative to a horizontal plane and the air blown out from the air conditioning apparatus flows in a nearly horizontal direction. In the second orientation, the flaps are tilted at a second angle relative to the horizontal plane and the air blown out from the air conditioning apparatus flows in a nearly vertical direction.

In the control device of the present invention, the repeating time interval deciding unit decides the time interval from one first orientation of the flaps until the next first orientation to be the first repeating time interval, based on the plurality of swing patterns. Similarly, the repeating time interval deciding unit decides the time interval from one second orientation of the flaps until the next second orientation to be the second repeating time interval, based on the plurality of swing patterns.

The frequency of the swing action can thereby be varied according to at least two or more operation modes (including the air-cooling operation mode and the air-warming operation mode). Therefore, different swing patterns can be executed according to the operation mode so as to be optimal for the operation mode at the time. Therefore, deviation in the temperature distribution in the vertical direction occurring in the air-conditioned space can be resolved, the discomfort from a draft can be reduced, and the level of comfort in the room can be improved.

A control device according to a third aspect of the present invention is the control device according to the second aspect, wherein the repeating time interval deciding unit decides a plurality of the first repeating time intervals in at least the air-cooling operation mode.

In at least the air-cooling operation mode, it is not preferable that a cold airflow be blown out downward, so as not to cause discomfort to the user due to a draft. However, when the air in the space has deviation in the temperature distribution relative to the vertical direction, air-conditioning efficiency decreases and the user experiences discomfort. Thus, when there is much discomfort caused by deviation in the temperature distribution, the deviation in the temperature distribution must be resolved, ignoring the discomfort from a draft. In this case, however, the user still experiences discomfort from a draft if the swing action of the flaps is simply performed periodically.

Thus, the user readily experiences discomfort from a draft during the air-cooling operation mode. Therefore, in the control device of the present invention, the repeating time interval deciding unit decides a plurality of first repeating time intervals at least during the air-cooling operation mode.

Therefore, the patterns of airflows that reach the user directly can be implemented irregularly. Deviation in the temperature distribution in the vertical direction in the space can also be resolved, and discomfort to the user from a draft can be prevented as much as possible.

A control device according to a fourth aspect of the present invention is the control device according to the second or third aspect, further comprising temperature value obtaining units and a swing pattern selector. The temperature value obtaining units obtain predetermined temperature values in the room where the air conditioning apparatus is installed. The swing pattern selector selects a predetermined swing pattern from the plurality of swing patterns on the basis of the result determined by the operation mode determining section and the predetermined temperature values obtained by the temperature value obtaining units. The repeating time interval deciding unit decides the first repeating time interval and the second repeating time interval on the basis of the predetermined swing pattern selected by the swing pattern selector. The control command generator generates the control command corresponding to the first repeating time interval and the second repeating time interval decided by the repeating time interval deciding unit.

In the control device of the present invention, predetermined temperature values are obtained in the room where the air conditioning apparatus is installed. A predetermined swing pattern is selected from the plurality of swing patterns on the basis of the results determined by the operation mode determining section and the predetermined temperature values. A repeating time interval is then decided based on the selected swing pattern. A control command is generated according to the repeating time interval. The term "predetermined temperature values" used herein refers to discharge temperatures, intake temperatures, floor temperatures, and the like, for example. The term "predetermined swing pattern" used herein refers to a swing pattern corresponding to the predetermined temperature values.

Therefore, the selected swing pattern can be varied not only according to the differences between operation modes, but also according to the state of the air conditioning, such as the indoor temperature distribution. Therefore, deviation in the temperature distribution in the vertical direction in the space can be resolved, and discomfort to the user from a draft can be prevented as much as possible.

A control device according to a fifth aspect of the present invention is the control device according to the fourth aspect, further comprising a phase determining unit. The phase determining unit determines phases from the startup period of the air conditioning apparatus until a stable period which is a state in which air-conditioning control of the room interior has been sufficiently performed by the air conditioning apparatus. The swing pattern selector selects the swing pattern on the basis of the phase determined by the phase determining unit. Based on the swing pattern selected by the swing pattern selector, the repeating time interval deciding unit lengthens the repeating time interval from the startup period to the stable period during the air-cooling operation mode, and shortens the repeating time interval from the startup period to the stable period during the air-warming operation mode.

In the control device of the present invention, the phases from the startup period of the air conditioning apparatus until the stable period are determined by the phase determining unit, the stable period being a state in which air-conditioning control of the room interior has been sufficiently performed by the air conditioning apparatus. The swing pattern is selected by the swing pattern selector on the basis of the determined phase. The state from the startup period of the air conditioning apparatus until the stable period includes an intermediate time or the like, which is a state in which there is temperature nonuniformity in the room. According to the selected swing patterns, air is discharged in a nearly vertical direction more frequently during the startup period than the stable period in the air-cooling operation mode, and air is discharged in a nearly vertical direction more frequently during the stable period than the startup period in the air-warming operation mode.

Therefore, the selected swing pattern can be varied not only according to the differences between operation modes, but also according to the phases which are the state of the air conditioning, such as the indoor temperature distribution. Therefore, deviation in the temperature distribution in the vertical direction in the space can be resolved, and discomfort to the user from a draft can be prevented as much as possible.

A control device according to a sixth aspect of the present invention is the control device according to any of the first through fifth aspects, wherein the air conditioning apparatus is an air conditioning apparatus having four discharge ports. The swing pattern storage area stores the swing patterns associated with the flaps provided respectively to the four discharge ports.

In the control device of the present invention, the swing pattern storage area stores the swing patterns correlated with each of the four flaps of the air conditioning apparatus. Therefore, the flaps of the four-directional air conditioning apparatus can each be controlled individually by a different swing pattern.

A control device according to a seventh aspect of the present invention is the control device according to the sixth aspect, wherein the four discharge ports include a first discharge port, a third discharge port, a second discharge port, and a fourth discharge port. The third discharge port is disposed symmetrically with respect to the first discharge port. The second discharge port extends from a proximity to one end of the first discharge port into proximity to one end of the third discharge port, and the second discharge port is adjacent to the first discharge port and the third discharge port. The fourth discharge port extends from a proximity to the other end of the first discharge port into proximity to the other end of the third discharge port, and the fourth discharge port is disposed symmetrically with respect to the second discharge port and is adjacent to the first discharge port and the third discharge port. The control device of the present invention further comprises an ID storage area and a pair designator. The ID storage area stores IDs corresponding to the four discharge ports. The pair designator designates two pairs of two flaps provided to two adjacent discharge ports, on the basis of the ID stored in the ID storage area. The control command generator generates a control command for synchronizing two flaps belonging to the same pair.

In the control device of the present invention, IDs corresponding to the four discharge ports are stored in the ID storage area. Based on the stored IDs, pairs of two flaps provided to two adjacent discharge ports are decided by the pair designator. Flaps designated in the same pair have synchronized swing patterns on the basis of the control command generated by the control command generator.

When the swing patterns of two flaps provided to two adjacent discharge ports are synchronized and the airflow directions blown out from the discharge ports are made to have the same up-and-down motion, a swirl flow readily arises in the vertical direction of the space. Therefore, a swirl flow of the air in the longitudinal direction can be created with the control device of the present invention.

A control device according to an eighth aspect of the present invention is the control device according to the seventh aspect, wherein the control command generator causes the two pairs to execute the same swing pattern at different timings.

In the control device of the present invention, of the four flaps provided to the four discharge ports, the pair executes the same swing pattern at different timings. Specifically, two flaps of the same pair (a first pair) and two flaps different from the first pair (a second pair) execute a swing pattern with different timings, and the swing patterns executed by the first pair and second pair at this time are the same.

The air in the room can thereby be agitated.

A control device according to a ninth aspect of the present invention is the control device according to the seventh or eighth aspect, wherein the pair designator varies the pairs in a predetermined condition.

In the control device of the present invention, the pairs are varied in a predetermined condition. Specifically, two flaps belonging to different pairs are decided as a pair. The predetermined condition herein is a predetermined time interval, the air-conditioned environment in the room, or the like, for example.

The temperature nonuniformity in the room can thereby be suitably resolved.

A control device according to a tenth aspect of the present invention is the control device according to any of the fourth through ninth aspects, wherein the temperature value obtaining units obtain values detected by temperature sensors attached to an indoor unit.

In the control device of the present invention, values detected by temperature sensors attached to an indoor unit are obtained and the swing patterns are decided. The temperature sensors attached to the indoor unit include, for example, an intake temperature sensor, a discharge temperature sensor, a floor temperature sensor, and the like.

The swing patterns can thereby be decided according to the indoor environment including the indoor temperature, and according to the conditions of the indoor unit including the discharge temperature.

An air conditioning apparatus according to an eleventh aspect of the present invention comprises the control device according to the first aspect, a blow-out portion, and flaps. The discharge ports are formed in the blow-out portion. The flaps are disposed in proximity to the discharge ports. The flaps vary the vertical directions of air blown out into the room from the discharge ports. The control device has a judgment unit, a receiver, and a temperature nonuniformity resolution control unit. The judgment unit judges whether or not there is a state of temperature nonuniformity in the room.

The state of temperature nonuniformity is a state where temperature nonuniformity is occurring in the room. The receiver receives a swing action start command for the flaps from the user. The temperature nonuniformity resolution control unit executes temperature nonuniformity resolution control either when the judgment unit judges that the state of temperature nonuniformity is in effect or when the receiver receives the swing action start command. The temperature nonuniformity resolution control unit controls the driving of the flaps during temperature nonuniformity resolution control so that the swing action of the flaps is started and when a predetermined condition is fulfilled, the swing action of the flaps is stopped. The predetermined condition is either a first condition, a second condition, or a third condition. The first condition is that a first predetermined time duration set in advance has elapsed following the start of the swing action. The second condition is that a learning operation time duration, which is decided by learning past operation records, has elapsed following the start of the swing action. The third condition is that the judgment unit has judged that the state of temperature nonuniformity is not in effect.

In the air conditioning apparatus according to the eleventh aspect of the present invention, when the predetermined condition has been fulfilled after the swing action of the flaps has started during temperature nonuniformity resolution control, the swing action of the flaps is stopped.

The inventors have obtained the knowledge that the consumed power when the flaps perform the swing action is greater than the consumed power when the flaps do not perform the swing action but continue to assume a predetermined orientation.

Therefore, by stopping the swing action of the flaps when the predetermined condition is fulfilled after the swing action of the flaps has started during temperature nonuniformity resolution control, the swing action of the flaps which has started in order to resolve temperature nonuniformity in the room can be automatically stopped without a command from the user.

The temperature nonuniformity in the room can thereby be resolved and the consumed power can be reduced.

An air conditioning apparatus according to a twelfth aspect of the present invention is the air conditioning apparatus according to the eleventh aspect, further comprising a fan. The fan produces a flow of air blown out from the discharge ports by being driven. The temperature nonuniformity resolution control unit controls the driving of the fan during temperature nonuniformity resolution control so that the airflow quantity of the fan reaches a maximum. In this air conditioning apparatus, since the driving of the fan is controlled during temperature nonuniformity resolution control so that the airflow quantity of the fan reaches a maximum, the state of temperature nonuniformity in the room can be resolved in a shorter amount of time than when the airflow quantity of the fan is small, for example.

An air conditioning apparatus according to a thirteenth aspect of the present invention is the air conditioning apparatus according to the eleventh or twelfth aspect, wherein when the temperature nonuniformity resolution control unit executes the temperature nonuniformity resolution control during the air-warming operation, the driving of the flaps is controlled so that after the swing action of the flaps has been stopped, the flaps assume a downward blowing orientation in which air is blown out downward from the discharge ports. Therefore, when the temperature nonuniformity resolution control is executed during the air-warming operation, air can be blown out downward from the discharge ports after the temperature nonuniformity in the room has been resolved by the swing action of the flaps. Therefore, warm air blown out from the discharge ports can be impeded from accumulating in the top of the room.

An air conditioning apparatus according to a fourteenth aspect of the present invention is the air conditioning apparatus according to any of the eleventh through thirteenth aspects, wherein the temperature nonuniformity resolution control unit has a learning unit. The learning unit decides a learning operation time duration. The learning unit decides the learning operation time duration using a time duration during which a thermo-on state continues. In this air conditioning apparatus, since a learning operation time duration is decided by the learning unit using a time duration during which a thermo-on state continues, continuous time duration can be decided for the swing action during the temperature nonuniformity resolution control suited to the environment of the room where the air conditioning apparatus is installed.

The term "thermo-on state" refers to a state in which refrigerant is flowing through the refrigerant circuit due to the compressor being driven, and sufficient heat exchange is being performed between the refrigerant and the indoor air. Commonly, to keep the indoor temperature near a target temperature or the like, when the indoor temperature deviates from the target temperature by a predetermined temperature or grater, the air conditioning apparatus employs the thermo-on state. The term "thermo-off state" refers to a state in which refrigerant does not flow or flows very little through the refrigerant circuit, and no substantial heat exchange is being performed between the refrigerant and the indoor air.

An air conditioning apparatus according to a fifteenth aspect of the present invention is the air conditioning apparatus according to the fourteenth aspect, wherein the learning unit decides the learning operation time duration in either one of the following cases: a test operation has been performed, the number of switches from the thermo-on state to a thermo-off state reaches a predetermined number or greater, a predetermined time set in advance has passed; or a second predetermined time duration has elapsed following the deciding of the learning operation time duration. Therefore, the air conditioning apparatus can decide the learning operation time duration with a predetermined timing.

An air conditioning apparatus according to a sixteenth aspect of the present invention is the air conditioning apparatus according to any of the eleventh through fifteenth aspects, further comprising a first temperature sensor and a second temperature sensor. The first temperature sensor detects temperature in proximity to the floor of the room. The second temperature sensor detects temperature in proximity to the blow-out portion. The judgment unit judges whether or not the state of temperature nonuniformity is in effect on the basis of the detection results of the first temperature sensor and the second temperature sensor. Therefore, when the blow-out portion is disposed in proximity to the ceiling, for example, whether or not there is a state of temperature nonuniformity in the room can be judged based on the temperature difference between the top and bottom of the indoor space. Therefore, the occurrence of temperature nonuniformity can be judged more accurately in comparison with cases in which whether or not temperature nonuniformity is occurring in the room is estimated from the temperature of the top of the indoor space, for example.

An air conditioning apparatus according to a seventeenth aspect of the present invention is the air conditioning apparatus according to any of the eleventh through sixteenth aspects, wherein the blow-out portion is installed in proximity to the ceiling of the room. Therefore, in this air conditioning apparatus, the blow-out portion can be installed near the ceiling.

An air conditioning apparatus according to an eighteenth aspect of the present invention comprises the control device according to the first aspect, a blow-out portion, first flaps, and second flaps. The blow-out portion is disposed in proximity to the ceiling of an air-conditioned room. Discharge ports are formed in the blow-out portion. The first flaps and second flaps are provided to the discharge ports. The first flaps and second flaps are also capable of individually varying respective vertical airflow direction angles. The control device has a control unit. The control unit executes initial air-cooling control. Initial air-cooling control is control in which the first flaps and the second flaps are made to perform different swing actions during an initial time period. The initial time period is a time period from the start of an air-cooling operation until a predetermined time duration elapses.

In the air conditioning apparatus according to the eighteenth aspect of the present invention, initial air-cooling control in which the first flaps and second flaps perform different swing actions is executed during the initial time period from the start of an air-cooling operation until a predetermined time duration elapses.

The inventors have obtained the knowledge that in an air conditioning apparatus comprising first flaps and second flaps, causing the first flaps and second flaps to perform different swing actions can make the temperature distribution in the air-conditioned room uniform in a shorter amount of time after the start of the air-cooling operation than causing the first flaps and second flaps to continuously assume an orientation such that air is blown out in a substantially horizontal direction from the discharge ports.

Therefore, during initial air-cooling control performed at the start of the air-cooling operation, by causing the first flaps and second flaps to perform different swing actions, the time needed to make the temperature distribution uniform in the air-conditioned room after the start of the air-cooling operation can be shortened in comparison with cases in which the first flaps and second flaps are made to assume an orientation such that air is blown out in a substantially horizontal direction from the discharge ports.

The comfort of the user can thereby be improved.

An air conditioning apparatus according to a nineteenth aspect of the present invention is the air conditioning apparatus according to the eighteenth aspect, wherein the control unit starts the swing actions of the first flaps and the second flaps at different timings during the initial air-cooling control. In this air conditioning apparatus, during initial air-cooling control, the first flaps and second flaps can be made to perform different swing actions by starting the swing actions of the first flaps and second flaps at different timings.

An air conditioning apparatus according to a twentieth aspect of the present invention is the air conditioning apparatus according to the nineteenth aspect, wherein the discharge ports include a first discharge port, a second discharge port, a third discharge port, and a fourth discharge port which are long and thin in shape and which are disposed along each of the four sides of a quadrangle. The first flaps are two flaps positioned so as to face each other and disposed in the first discharge port and the third discharge port. The second flaps are two flaps positioned so as to face each other and disposed in the second discharge port and the fourth discharge port.

In the air conditioning apparatus according to the twentieth aspect, the initial air-cooling control is executed in which the first flaps, which are two flaps positioned so as to face each other, and the second flaps, which are two flaps positioned so as to face each other, are made to perform different swing actions.

The inventors have obtained the knowledge that in an air conditioning apparatus comprising four flaps, causing all of the flaps to continuously assume orientations such that air is blown out in a substantially horizontal direction from the discharge ports can make the temperature distribution in the air-conditioned room uniform in a shorter amount of time after the start of the air-cooling operation than causing all of the flaps to perform the swing action with the same timing. The inventors have also obtained the knowledge that in an air conditioning apparatus comprising four flaps, causing the first flaps and second flaps, which are both configured from two flaps positioned so as to face each other, to perform the swing action with different timings can make the temperature distribution in the air-conditioned room uniform in a shorter amount of time after the start of the air-cooling operation than causing all of the flaps to continuously assume an orientation such that air is blown out in a substantially horizontal direction from the discharge ports.

Therefore, during initial air-cooling control, by causing the first flaps, which are two flaps positioned so as to face each other, and the second flaps, which are two flaps positioned so as to face each other, to perform the swing action with different timings; the time needed in order to make the temperature distribution in the air-conditioned room uniform after the start of the air-cooling operation can be shortened in comparison with cases in which all of the flaps are made to assume an orientation such that air is blown out in a substantially horizontal direction from the discharge ports, or cases in which all of the flaps are made to perform the swing action with the same timing.

An air conditioning apparatus according to a twenty-first aspect of the present invention is the air conditioning apparatus according to any of the eighteenth through twentieth aspects, further comprising a fan for producing a flow of air blown out from the discharge ports by being driven. The control unit causes the fan to be driven during the initial air-cooling control so that the airflow quantity of the fan reaches a maximum. In this air conditioning apparatus, since the airflow quantity of the fan reaches a maximum during execution of the initial air-cooling control, the temperature distribution in the air-conditioned room can be made uniform in a shorter amount of time in comparison with cases in which the airflow quantity of the fan is small, for example.

An air conditioning apparatus according to a twenty-second aspect of the present invention is the air conditioning apparatus according to any of the eighteenth through twenty-first aspects, wherein the length of the initial time period is set in advance. Therefore, in this air conditioning apparatus, the time duration during which the first flaps and second flaps are made to perform different swing actions during initial air-cooling control can be set in advance.

An air conditioning apparatus according to a twenty-third aspect of the present invention is the air conditioning apparatus according to any of the eighteenth through twenty-first aspects, wherein the control unit has a learning unit for deciding the length of the initial time period by learning past operation records. In this air conditioning apparatus, since the time duration during which the first flaps and second flaps are made to perform different swing actions can be decided using past operation records, it is possible to decide a time duration for executing the swing action suited to the environment of the air-conditioned room.

An air conditioning apparatus according to a twenty-fourth aspect of the present invention is the air conditioning apparatus according to any of the eighteenth through twenty-first aspects, further comprising a temperature sensor for detecting temperature in proximity to the ceiling. The control unit has a deciding unit for deciding an ending time point of the initial time period on the basis of the detection results of the temperature sensor. In this air conditioning apparatus, since the ending time point of the initial time period, i.e., the time duration during which the first flaps and second flaps are made to perform different swing actions can be decided according to the temperature in proximity to the ceiling, it is possible to decide a time duration for executing the swing action suited to the environment of the air-conditioned room.

An air conditioning apparatus according to a twenty-fifth aspect of the present invention is the air conditioning apparatus according to any of the eighteenth through twenty-first aspects, wherein the initial time period includes a first time period and a second time period that follows the first time period. During the initial air-cooling control, the control unit causes the first flaps and the second flaps to perform the different swing actions in the first time period. Also during the initial air-cooling control, the control unit causes the first flaps and the second flaps to assume an orientation in which air is blown out in a substantially horizontal direction from the discharge ports in the second time period. In this air conditioning apparatus, when the air-cooling operation is started, initial air-cooling control is executed in which the first flaps and second flaps are first made to perform different swing actions, and the first flaps and second flaps are then made to assume a predetermined orientation so that air is blown out in a substantially horizontal direction from the discharge ports. Thereby, after the air-cooling operation has started and the temperature distribution in the air-conditioned room has become uniform, cold air can be impeded from accumulating near the floor in the air-conditioned room.

Advantageous Effects of Invention

With the control device according to the first aspect of the present invention, different swing patterns can be executed so that the swing pattern in the air-cooling operation and the swing pattern in the air-warming operation are optimal for the air-cooling operation and the air-warming operation respectively. Therefore, deviation in the temperature distribution in the vertical direction occurring in the air-conditioned space can be resolved, the discomfort from a draft can be reduced, and the level of comfort in the room can be improved.

With the control device according to the second aspect of the present invention, the frequency of the swing action can be varied according to at least two or more operation modes (including the air-cooling operation mode and the air-warming operation mode). Therefore, different swing patterns can be executed according to the operation mode so as to be optimal for the operation mode at the time. Therefore, deviation in the temperature distribution in the vertical direction occurring in the air-conditioned space can be resolved, the discomfort from a draft can be reduced, and the level of comfort in the room can be improved.

With the control device according to the third aspect of the present invention, the patterns of airflows that reach the user directly can be implemented irregularly. Deviation in the temperature distribution in the vertical direction in the space can also be resolved, and discomfort to the user from a draft can be prevented as much as possible.

With the control device according to the fourth aspect of the present invention, the selected swing pattern can be varied not only according to the differences between operation modes, but also according to the state of the air conditioning, such as the indoor temperature distribution. Therefore, deviation in the temperature distribution in the vertical direction in the space can be resolved, and discomfort to the user from a draft can be prevented as much as possible.

With the control device according to the fifth aspect of the present invention, the selected swing pattern can be varied not only according to the differences between operation modes, but also according to the phases which are the state of the air conditioning, such as the indoor temperature distribution. Therefore, deviation in the temperature distribution in the vertical direction in the space can be resolved, and discomfort to the user from a draft can be prevented as much as possible.

With the control device according to the sixth aspect of the present invention, each of the flaps of the four-directional air conditioning apparatus can be controlled individually by a different swing pattern.

With the control device according to the seventh aspect of the present invention, a swirl flow of the air in the longitudinal direction can be created by the air conditioning apparatus performing control for synchronizing the swinging of two adjacent flaps.

With the control device according to the eighth aspect of the present invention, the air in the room can be agitated.

With the control device according to the ninth aspect of the present invention, the temperature nonuniformity in the room can be suitably resolved.

With the control device according to the tenth aspect of the present invention, the swing patterns can be decided according to the indoor environment including the indoor temperature, and according to the conditions of the indoor unit including the discharge temperature.

With the control device according to the eleventh aspect of the present invention, the temperature nonuniformity in the room can be resolved and the consumed power can be reduced.

With the control device according to the twelfth aspect of the present invention, the state of temperature nonuniformity in the room can be resolved in a shorter amount of time.

With the control device according to the thirteenth aspect of the present invention, warm air can be impeded from accumulating in the top of the room.

With the control device according to the fourteenth aspect of the present invention, a continuous time duration can be decided for the swing action during the temperature nonuniformity resolution control suited to the environment of the room.

With the air conditioning apparatus according to the fifteenth aspect of the present invention, the learning operation time duration can be decided with a predetermined timing.

With the air conditioning apparatus according to the sixteenth aspect of the present invention, the occurrence of temperature nonuniformity can be judged more accurately.

With the air conditioning apparatus according to the seventeenth aspect of the present invention, the blow-out portion can be installed near the ceiling.

With the air conditioning apparatus according to the eighteenth aspect of the present invention, the comfort of the user can be improved.

With the air conditioning apparatus according to the nineteenth aspect of the present invention, the first flaps and second flaps can be made to perform different swing actions by starting the swing actions of the first flaps and second flaps at different timings.

With the air conditioning apparatus according to the twentieth aspect of the present invention, the time needed in order to make the temperature distribution in the air-conditioned room uniform after the start of the air-cooling operation can be shortened.

With the air conditioning apparatus according to the twenty-first aspect of the present invention, the temperature distribution in the air-conditioned room can be made uniform in a shorter amount of time.

With the air conditioning apparatus according to the twenty-second aspect of the present invention, the time duration during which the first flaps and second flaps are made to perform different swing actions during initial air-cooling control can be set in advance.

With the air conditioning apparatus according to the twenty-third aspect of the present invention, it is possible to decide a time duration for executing the swing action suited to the environment of the air-conditioned room.

With the air conditioning apparatus according to the twenty-fourth aspect of the present invention, it is possible to decide a time duration for executing the swing action suited to the environment of the air-conditioned room.

With the air conditioning apparatus according to the twenty-fifth aspect of the present invention, after the air-cooling operation has started and the temperature distribution in the air-conditioned room has become uniform, cold air can be impeded from accumulating near the floor in the air-conditioned room.

BRIEF DESCRIPTION OF THE DRAWINGS

FIG. 4 shows a continuous time duration table.

FIG. 5 shows a condition table.

FIG. 6 shows a swing pattern table.

FIG. 26 is a chart showing the consumed power both in a case in which the air conditioning apparatus performs the air-warming operation with an indoor unit installed in a test room in the downward blowing stationary state, and a case in which the air conditioning apparatus performs the air-warming operation with the indoor unit installed in the test room in the swing state.

FIG. 28 is a chart showing the consumed power both in a case in which the air conditioning apparatus performs the air-warming operation with the indoor unit installed in the test room in the swing state, and a case in which the air conditioning apparatus performs the air-warming operation with the indoor unit installed in the test room going into both the swing state and the downward blowing stationary state.

FIG. 35 is a chart showing the amount of time and consumed power until the average room temperature reaches the set temperature in a case in which the air-cooling operation of the air conditioning apparatus is started with the indoor unit installed in the test room in a horizontal blowing stationary state, a case in which the air-cooling operation of the air conditioning apparatus is started with the indoor unit installed in the test room in an all-synchronous swing state, and a case in which the air-cooling operation of the air conditioning apparatus is started with the indoor unit installed in the test room in an opposite-side swing state.

FIG. 36 is a chart showing the consumed power respectively in a case in which the air-cooling operation of the air conditioning apparatus is started with the indoor unit installed in the test room in a horizontal blowing stationary state, a case in which the air-cooling operation of the air conditioning apparatus is started with the indoor unit installed in the test room in an all-synchronous swing state, a case in which the air-cooling operation of the air conditioning apparatus is started with the indoor unit installed in the test room in an opposite-side swing state, and a case in which the air-cooling operation of the air conditioning apparatus is started with the indoor unit installed in the test room in both the opposite-side swing state and the horizontal blowing stationary state.

DESCRIPTION OF EMBODIMENTS

First Embodiment

A first embodiment of an air conditioning apparatus 1 according to the present invention is described in detail hereinbelow using the drawings.

(1) Configuration of Air Conditioning Apparatus 1

An embodiment of the air conditioning apparatus 1 of the present invention is described hereinbelow based on the drawings.

Figure 1:
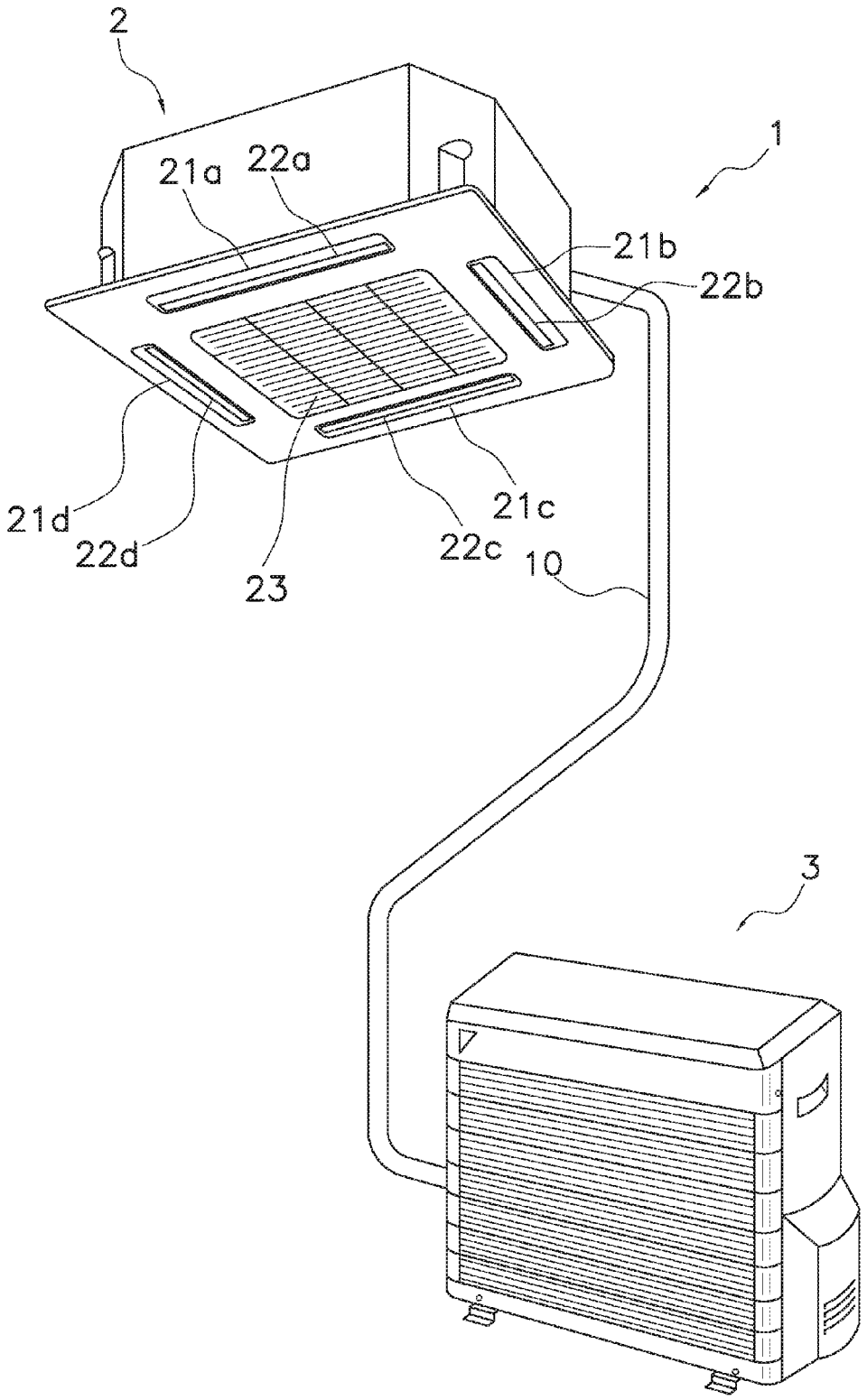
FIG. 1 is an external perspective view of the air conditioning apparatus according to an embodiment of the present invention.

FIG. 1 shows an external perspective view of the air conditioning apparatus 1 according to an embodiment of the present invention.

The air conditioning apparatus 1 is a system for performing air conditioning control for improving the comfort of a user by an indoor unit 2 (of which there is one in the present embodiment) disposed in the room of a building used by the user, and the air conditioning apparatus has primarily the indoor unit 2 and an outdoor unit 3. The indoor unit 2 according to the present embodiment is a ceiling-mounted indoor unit which can blow air out in four directions. The indoor unit 2 and the outdoor unit 3 are connected via a refrigerant communication tube 10, forming a refrigerant circuit (not shown). In the present embodiment, one indoor unit 2 is connected to one outdoor unit. The outdoor unit 3 functions as a heat source unit for processing the heat load of the indoor unit 2. The indoor unit 2 functions as a usage unit and performs air conditioning (an air-cooling operation, an air-warming operation, or the like) of the indoor space. The interior of the outdoor unit 3 has an air-conditioning control unit 4. The air-conditioning control unit 4 is a device for performing various operation controls on the air conditioning apparatus 1.

The indoor unit 2 has a main body 21 and flaps 22*a*, 22*b*, 22*c*, 22*d*, as shown in FIG. 1. The main body 21 has the shape of a box, wherein a square-shaped intake port 23 is formed in the substantial center of the bottom surface, and four discharge ports 21*a*, 21*b*, 21*c*, 21*d* are formed (FIGS. 1 and 2). At the outer sides of the intake port 23, the four discharge ports 21*a* to 21*d* are formed in long, thin rectangular shapes so as to extend along the four sides of the intake port 23. The discharge ports 21*a* to 21*d* are assigned discharge port IDs 1 to 4 as information for distinguishing the discharge ports 21*a* to 21*d*.

The flaps 22*a* to 22*d* are respectively provided in proximity to the discharge ports 21*a* to 21*d* of the main body 21. The flaps 22*a* to 22*d* are airflow direction adjustment plates for vertically guiding the air-conditioning air blown out from the discharge ports 21*a* to 21*d*, and are formed into long, thin rectangular shapes similar to the shapes of the discharge ports 21*a* to 21*d*. The flaps 22*a* to 22*d* can open and close the discharge ports 21*a* to 21*d* by turning up and down relative to the main body 21 as shown in FIG. 2A.

Figure 2A:
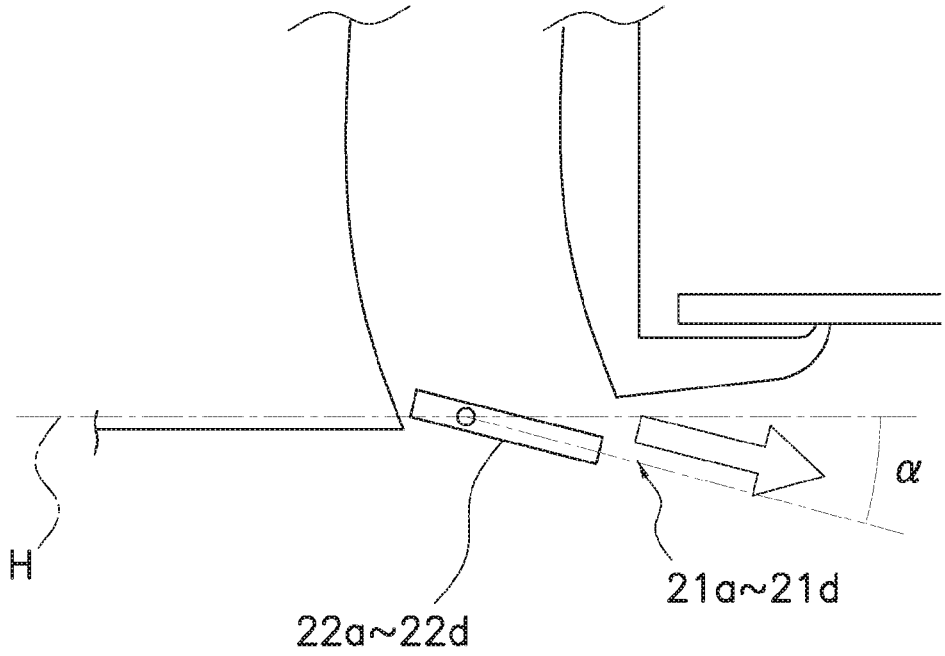
FIG. 2A is an enlarged cross-sectional view of a discharge port, showing the flap in a position (horizontal blowing) tilted at a first angle relative to a horizontal plane.
Figure 2B:
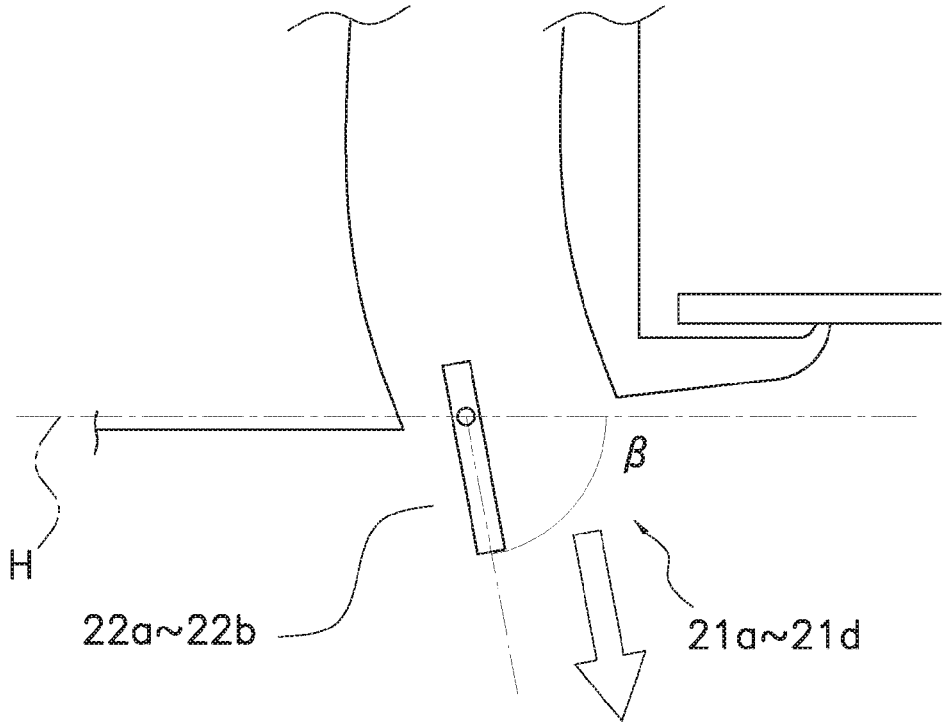
FIG. 2B is an enlarged cross-sectional view of a discharge port, showing the flap in a position (downward blowing) tilted at a second angle relative to a horizontal plane.

FIG. 2A shows the flaps 22*a* to 22*d* in positions tilted at a first angle $\alpha$ relative to a horizontal plane H (horizontal blowing), and FIG. 2B shows the flaps 22*a* to 22*d* in positions tilted at a second angle $\beta$ relative to the horizontal plane H (downward blowing). The second angle $\beta$ is greater than the first angle $\alpha$ relative to the horizontal plane H, as shown in FIG. 2. When the tilt of the flaps 22*a* to 22*d* is adjusted to the position of the first angle $\alpha$ from the horizontal plane H, the flow direction of air-conditioned air blown out from the discharge ports 21*a* to 21*d* runs along the ceiling in a nearly horizontal direction, flowing to the outer sides of the main body 21. When the tilt of the flaps 22*a* to 22*d* is adjusted to the position of the second angle β from the horizontal plane H, the flow direction of air-conditioned air blown out from the discharge ports 21*a* to 21*d* runs downward in a nearly vertical direction.

In the present embodiment, the indoor unit 2 has an indoor fan 24 as an air-blowing fan for supplying air into the room as supplied air after indoor air has been drawn into the main body 21 and subjected to heat exchange with a refrigerant in a usage-side heat exchanger (not shown). The indoor fan 24 is a fan capable of varying the airflow quantity of air supplied to the usage-side heat exchanger. In the present embodiment, the indoor fan 24 is a centrifugal air-blowing device driven by a motor 24*m* comprising a DC fan motor or the like.

In the present embodiment, the indoor unit 2 has a discharge temperature sensor 25 for detecting the temperature of supplied air blown out from the discharge port 21*a*, an intake temperature sensor 26 for detecting the temperature of indoor air drawn into the intake port 23, and a non-contact floor temperature sensor 27 for detecting the temperature of the floor by detecting the amount of infrared rays from the floor. The discharge temperature sensor 25 and the intake temperature sensor 26 are composed of thermistors, and the floor temperature sensor 27 is composed of a thermopile. In the present embodiment, the discharge temperature sensor 25 is disposed only in the discharge port 21*a* of the four discharge ports 21*a* to 21*d*, but is not limited and may be provided to one or more of any of the discharge ports 21*a* to 21*d*. In the present embodiment, the floor temperature sensor 27 is a non-contact temperature sensor that is not disposed directly on the floor, but is not limited as such and a temperature sensor (i.e., a thermistor) capable of detecting the floor temperature directly may be disposed on the floor and connected either by a communication wire or wirelessly (ZigBee or the like) to the air-conditioning control unit 4, so that the detected temperature value is obtained.

Figure 3:
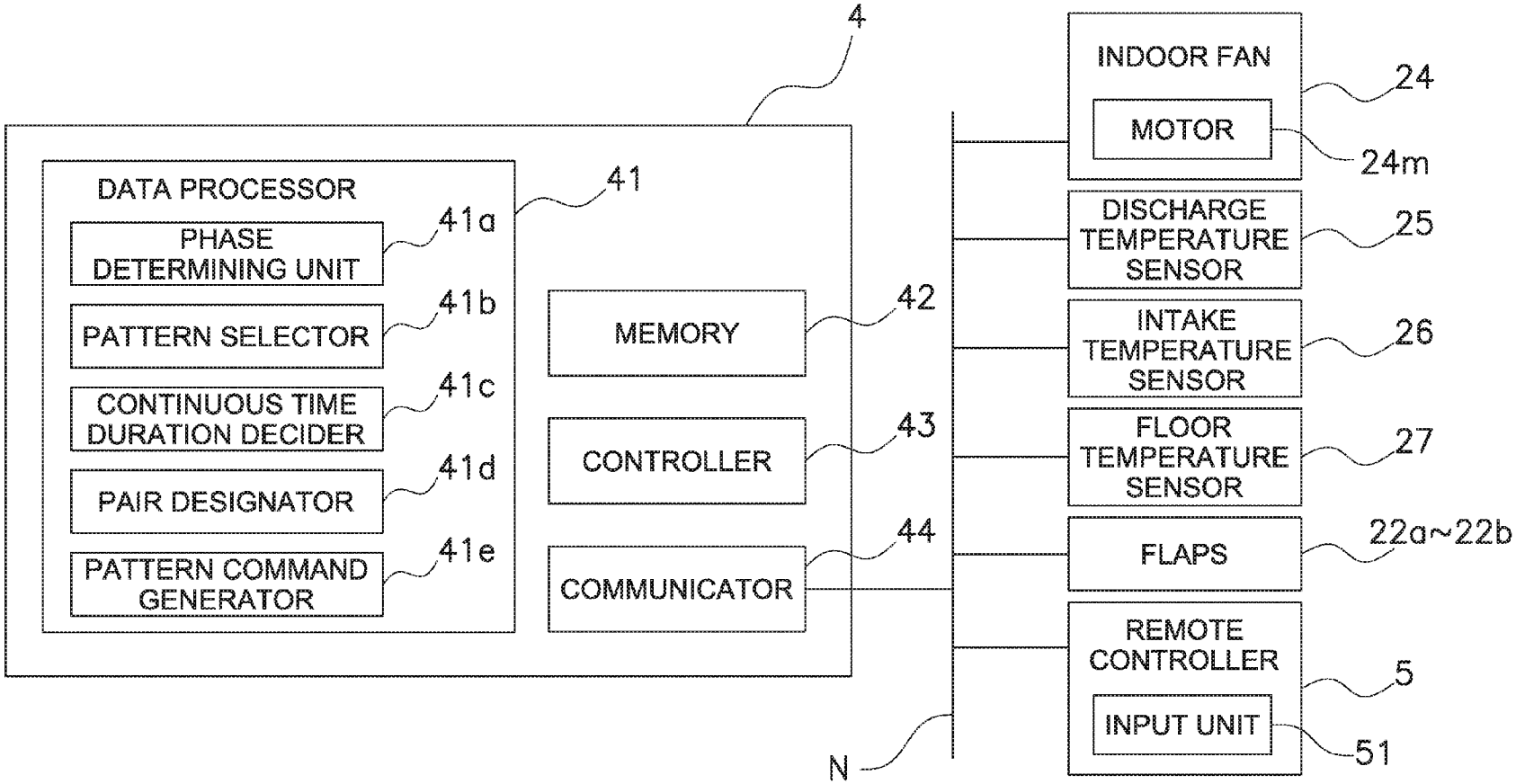
FIG. 3 is a block diagram showing the relationship between the air-conditioning controller, various sensors, and various devices.

The air-conditioning control unit 4 has a data processor 41, a memory 42, a control unit 43, and a communicator 44 in order to control the operations of the indoor unit 2, as shown in FIG. 3. The communicator 44, which is connected via a communication wire N with the indoor fan 24, the various temperature sensors 25 to 27, a remote controller 5, and other components; receives various operation data from the indoor fan 24, the various temperature sensors 25 to 27, the remote controller 5, and other components; and also sends control signals and the like to the indoor fan 24, the various temperature sensors 25 to 27, the remote controller 5, and other components.

According to a computation program stored in the memory 42, the data processor 41 computes and processes an operation data process, a display process, and other various information obtained from the memory 42, the communicator 44, and the like; derives specified information, and sends this information to the memory 42 and the communicator 44. The data processor 41 also comprises a phase determining unit 41*a*, a pattern selector 41*b*, a continuous time duration decider 41*c*, a pair designator 41*d*, and a pattern command generator 41*e*.

The phase determining unit 41*a* performs a phase determination which is described hereinafter. The phase determining unit 41*a* is also capable of determining the operation mode. The pattern selector 41*b* selects the optimum swing pattern on the basis of the phase determined by the phase determining unit 41*a*. Based on a hereinafter-described continuous time duration table and swing pattern table, the continuous time duration decider 41*c* decides a continuous time duration (see below) which is a time duration for keeping the flaps 22*a* to 22*d* in a given position. The pair designator 41*d* designates the adjacent flaps 22*a* and 22*d* as a pair, and also designates the other adjacent flaps 22*b* and 22*c* as a pair. The pair designator 41*d* may vary the pairs depending on the conditions. For example, the flap 22*a* and the flap 22*b* may be designated as a pair, and the flap 22*c* and the flap 22*d* may be designated as a pair. Based on the continuous time duration decided by the continuous time duration decider 41*c*, the pattern command generator 41*e* generates control commands for the flaps 22*a* to 22*d* designated by the pair designator 41*d*.

Stored in the memory 42 are various control tables (not shown) needed in order to control the air conditioning apparatus 1, information pertaining to the air conditioning apparatus 1 including position data needed for the communication of the air conditioning apparatus 1, and various computation programs, and the like. Also stored in the memory 42 are a continuous time duration table defining the continuous time durations (see below); a condition table correlating hereinafter-described phases, conditions for determining the phases, and swing patterns; and a swing pattern table correlating discharge port IDs and the swing patterns of the flaps 22*a* to 22*d* corresponding to the discharge ports 21*a* to 21*d*.

In the continuous time duration table, the length of the continuous time duration is defined for each continuous time duration number, as shown in FIG. 4. The term "continuous time duration" used herein refers to the time duration in which the flaps 22*a* to 22*d* remain in either the horizontal blowing position or the downward blowing position. In the present embodiment, there are six continuous time durations from t0 to t5, defined in 10-second units from 0 seconds to 50 seconds, as shown in FIG. 4. The continuous time durations are not limited to the six t0 to t5. Nor are the continuous time durations limited to the time durations (seconds) defined in the present embodiment.

The condition table as shown in FIG. 5 correlates operation modes such as the air-cooling operation mode and the air-warming operation mode, the phases, and the swing patterns corresponding to the phases, of which there are seven in the operation modes such as startup periods and stable periods: the startup period of the air-cooling operation mode, the stable period 1 (no temperature nonuniformity) of the air-cooling operation mode, the stable period 2 (temperature nonuniformity) of the air-cooling operation mode, the startup period of the air-warming operation mode, the intermediate period 1 of the air-warming operation mode, the intermediate period 2 of the air-warming operation mode, and the stable period of the air-warming operation mode. The phrase "the startup period of the air-cooling operation mode" used herein refers to a case in which the discharge temperature is determined to be higher than the set temperature, assuming that the air-cooling operation mode has just been started up. The phrases "the stable period 1 of the air-cooling operation mode" and "the stable period 2 of the air-cooling operation mode" refer to cases in which the discharge temperature remains below 10 K less than the set temperature for 10 minutes, assuming that the temperature of the indoor space during the air-cooling operation mode is stable. The "stable period 1 of the air-cooling operation mode" is a case in which there is no variation in the temperature distribution in the vertical direction in the indoor space (i.e., there is no temperature nonuniformity), and the "stable period 2 of the air-cooling operation mode"

is a case in which there is variation in the temperature distribution in the vertical direction in the indoor space (i.e., there is temperature nonuniformity). The phrase "startup period of the air-warming operation mode" used herein refers to a case in which the discharge temperature is determined to be lower than the set temperature, assuming that the air-warming operation mode has just been started up. The phrase "the intermediate period 1 of the air-warming operation mode" refers to a case in which the discharge temperature is determined to be equal to or greater than the set temperature, assuming a first stage before the stable period in which the temperature of the indoor space stabilizes during the air-warming operation mode (an intermediate period). The phrase "the intermediate period 2 of the air-warming operation mode" used herein refers to a case in which the discharge temperature remains above 5 K more the set temperature for 3 minutes, assuming a second stage of the intermediate period of the air-warming operation mode. The phrase "the stable period of the air-warming operation mode" refers to a case in which the discharge temperature remains above 10 K more than the set temperature for 10 minutes, assuming that the temperature of the indoor space is stable during the air-warming operation mode.

The swing pattern table correlates the flap IDs, initial positions, initial actions, and continuous time duration patterns of the activated flaps 22*a* to 22*d* with the seven swing patterns correlated with the seven phases described above, as shown in FIG. 6. The term "initial position" used herein refers to the first orientation of each of the flaps 22*a* to 22*d* in that swing pattern, and there are two of these positions: horizontal blowing and downward blowing in the positions of the flaps 22*a* to 22*d* described above. The term "initial action" used herein refers to the first action of each of the flaps 22*a* to 22*d* in that swing pattern, and there are three of these actions: swing, keep, and keep for 10 s. The term "swing" refers to either the flaps 22*a* to 22*d* shifting orientations from the horizontal blowing position to the downward blowing position or the flaps 22*a* to 22*d* shifting orientations from the downward blowing position to the horizontal blowing position, specifically which is determined by the positions of the flaps immediately before the swinging. In the present embodiment, the time duration required for a single swing is set at 20 seconds, but is not limited as such and may be varied. The term "keep" refers to the position being maintained for the established continuous time duration, and the continuous time duration is determined by a continuous time duration pattern described hereinafter. The term "keep for 10 s" refers to the position being maintained for 10 seconds regardless of the established continuous time duration, and this term is limited to the initial action. The term "continuous time duration pattern" refers to a pattern made by multiple arrangements of the different types of continuous time durations, which are time durations in which the flaps 22*a* to 22*d* keep their positions (specifically, refer to swing pattern control hereinbelow). After swinging, the flaps 22*a* to 22*d* will always keep their positions for the established continuous time duration, and will then swing after keeping. Therefore, the flaps alternate between swinging and keeping, and the keeping time durations defined in order according to the corresponding pattern constitute a continuous time duration pattern.

The control unit 43 controls the air conditioning apparatus 1 according to the computation program stored in the memory 42, the control commands generated by the pattern command generator 41*e*, and other factors.

A remote controller 5 having an input unit 51 is provided to the air conditioning apparatus 1 so as to be connected to the communication wire N, and various data can be inputted via the input unit 51. Specifically, with this remote controller 5, the user can perform operations corresponding to the control of the indoor unit 2, such as switching between operation modes including the air-cooling operation mode and the air-warming operation mode, inputting the set temperature in the various operation modes, and setting between on and off (setting a timer). The remote controller 5 can be a wireless remote controller or a wired remote controller corresponding to the indoor unit 2, but is not limited and may be a centralized remote controller capable of managing multiple air conditioning apparatuses installed in a building, a management device capable of managing the operating conditions of all the equipment in the building, or the like. The term "set temperature" used herein refers to a target temperature that the temperature in the room (the indoor temperature) will ultimately be made to approach. Specifically, the set temperature is set in the air conditioning apparatus 1, whereby the air in the room is conditioned so that the indoor temperature approaches the set temperature.

(2) Swing Pattern Control

In the air conditioning apparatus 1, the above-described phases are judged, and the swing pattern is varied according to the phase so as to alleviate the user's discomfort. In the present embodiment, the air conditioning apparatus 1 uses the above-described system configuration to vary the swing pattern according to the seven phases.

Hereinbelow, the swing patterns (patterns 1 through 7) in the seven phases are specifically described based on FIGS. 7 to 13. FIGS. 7 to 13 show the transition in the orientations of the four flaps 22*a* to 22*d* with the passage of time, with time shown on the horizontal axis and the orientations of the flaps 22*a* to 22*d* shown on the vertical axis. Each graduation indicated on the horizontal axis is 10 seconds. The flaps 22*a* to 22*d* change the degree of which the discharge ports 21*a* to 21*d* are open, according to the flap orientations. Specifically, the ports are slightly open when the flaps are in the horizontal blowing position, and the ports are fully open when the flaps are in the downward blowing position. Since the four flaps 22*a* to 22*d* are individually controlled between being slightly open and fully open, the percentages of the airflow quantities blown out from the discharge ports 21*a* to 21*d* change according to the opening degrees of the flaps. For example, when two flaps are slightly open and two flaps are fully open, an airflow of about 10% of the total airflow quantity is blown out from the each of two discharge ports in which the slightly open flaps are positioned, and an airflow of about 40% of the total airflow quantity is blown out from the each of two discharge ports in which the fully open flaps are positioned. The percentages of the airflow quantities blown out from the discharge ports relative to the total airflow quantity are given at the bottom of the flap time charts in FIGS. 7 to 13. The units of these numerical values are expressed in terms of percentage. When the airflow quantity is low, such as 10%, for example, the airflow rate is high and the distance covered by the flow of air in this case is greater. Conversely, when the airflow quantity is high, such as 40%, for example, the airflow rate is low and the distance covered by the flow of air is smaller.

The four flaps 22*a* to 22*d* are capable of swinging individually. In the present embodiment, the swing patterns of the four flaps 22*a* to 22*d* are such that the swing pattern set for at least one flap is either out of phase or in phase with the swing pattern set for the other flaps. Therefore, in the description of the swing patterns, the swing pattern of the flap 22*a* is used as a representative example.

(2-1) Pattern 1

During the startup period of the air-cooling operation, there are often instances in which the discharge temperature blown out from the air conditioning apparatus is not low enough, and there is not much of an air-cooling effect with horizontal blowing alone, therefore causing discomfort to the user. When the time duration of downward blowing is too long, the user experiences a tepid airflow, which presumably causes discomfort. Pattern 1 is set as the pattern performed during the startup period of the air-cooling operation, and is a swing pattern designed so as to allow variation in the airflow quantity immediately after the start of the air-cooling operation in order to resolve problems such as those described above.

Figure 7:
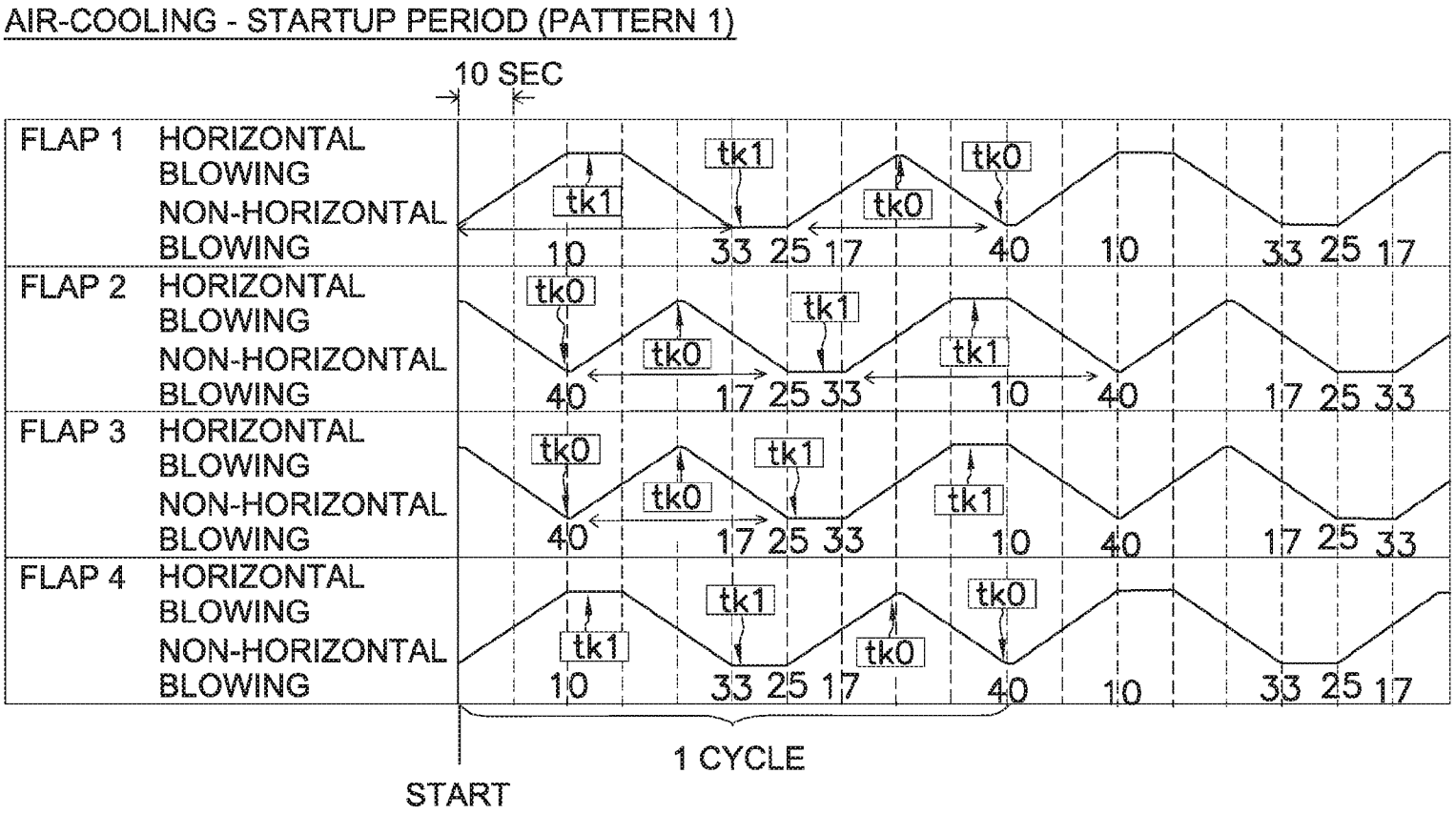
FIG. 7 is a timing chart for describing the actions of the flaps in pattern 1.

Pattern 1 is described specifically based on the swing pattern table of FIG. 6 and the time chart showing the flap orientations in pattern 1 in FIG. 7.

The initial position of flap 22*a* (flap ID1) in pattern 1 is downward blowing, and the initial action is swing. In pattern 1, two continuous time durations (tk0 and tk1) are arranged in four sets (1st through 4th), and the keeping of the first (1st) continuous time duration is performed after the initial action of swinging. Swinging is then performed and the keeping of the second (2nd) continuous time duration is performed. Swinging and keeping are then repeated until the fourth (4th) set, and when the keeping of the fourth (4th) set ends, the flap swings back to resume the first (1st) keeping. Thus, swinging and keeping are alternated.

Pattern 1 is a swing pattern in which the flap 22*a* and the flap 22*d* perform synchronized swing actions, and the flap 22*b* and the flap 22*c* perform synchronized swing actions. The continuous time duration patterns of the flap 22*b* and the flap 22*c* are the same as the continuous time duration patterns of the flap 22*a* and the flap 22*d* when rearranging the order so as to begin with the third (3rd) continuous time duration pattern and progressively switch to the fourth (4th), the first (1st), and the second (2nd) pattern. With such rearranged progression, in pattern 1, the initial position (the position immediately before swinging to the keep position in the first continuous time duration) for the flap 22*a* and the flap 22*d* is downward blowing, while the initial position (the position immediately before swinging to the keep position in the third continuous time duration) for the flap 22*b* and the flap 22*c* in the rearranged progression described above is horizontal blowing; the positions corresponding to the initial position are entirely opposite.

With the control described above, the airflow quantity blown out from the discharge ports 21*a* to 21*d* at 20 seconds since the start of pattern 1 is such that the discharge ports 21*a* and 21*d* each blow out 10% of the airflow quantity and the discharge ports 21*b* and 21*c* each blow out 40% of the airflow quantity. At 50 seconds since the start of pattern 1, an airflow quantity of 17 to 33% is blown out by the each of the discharge ports 21*a* to 21*d*, and 10 seconds later, an airflow quantity of 25% is blown out from the each of the discharge ports 21*a* to 21*d*. At 10 more seconds, an airflow quantity of 17 to 33% is blown out by the each of the discharge ports 21*a* to 21*d*. Thus, during the startup period of the air-cooling operation, multiple different (at least two) airflow quantities of 10 to 40% are blown out from the each of the discharge ports 21*a* to 21*d*. Assuming two flaps swing in synchronization, at most an airflow quantity of 40% comes out of one discharge port, which is considered to be a relatively large airflow quantity. Conversely, an airflow quantity of 10% is considered to be comparatively small.

Pattern 1 has two continuous time durations tk0 (0 seconds) and tk1 (10 seconds) of the continuous time duration pattern, the longest of which is still short at 10 seconds, and it is therefore rare for an airflow quantity of the same percentage to continue to blow out of one discharge port. Specifically, by setting the continuous time duration to a short time duration of 10 seconds even at its longest, the airflow quantities blown out from the discharge ports each can be set randomly between 10 and 40%. Moreover, since the flaps 22*a* to 22*d* are swinging, the air in the indoor space can be actively agitated, and temperature nonuniformity in the indoor space can be resolved.

When the airflow quantity is 40%, the positions of the flaps 22*a* to 22*d* are downward blowing, and when the airflow quantity is 10%, the positions of the flaps 22*a* to 22*d* are horizontal blowing. Therefore, an airflow with a low airflow rate is blown downward (i.e., to the user) when the airflow quantity is large, and agitating in the vertical direction of the space can therefore be promoted so that the user will not feel a draft even during downward blowing. When the airflow quantity is small, an airflow with a high airflow rate is blown horizontally, the flow of air can therefore be circulated throughout a wide range, and the room can be cooled quickly. Downward blowing has a frequency of twice per cycle (100 seconds in pattern 1), or 0.2 times per 10 seconds, which is frequent compared with other patterns (see below), and there are numerous downward blowings. This is because it can be assumed there is virtually no discomfort to the user even when the user is directly exposed because the discharge temperature is not low enough.

(2-2) Pattern 2 and Pattern 3 (Stable Periods of Air-Cooling Operation Mode)

In the stable periods of the air-cooling operation, sufficient time has passed since the start of the air-cooling operation, and the discharge temperature blown out from the air conditioning apparatus has been determined to be low enough. In the stable periods of the air-cooling operation, the indoor space is divided into a layer of cold air and a layer of warm air. Thus, when there are deviations in the temperature distribution of the air within the space in the vertical direction, air-conditioning efficiency decreases and the user feels discomfort. During the air-cooling operation, when the user is directly exposed to an airflow supplied from a discharge port, there is a risk of the user feeling discomfort due to a draft. When the swing action is a mere fixed pattern, the comfort felt by the user gradually decreases. Therefore, during the stable periods of the air-cooling operation, in order to resolve these problems, a distinction is made between cases of deviations in the temperature distribution (cases of temperature nonuniformity) and cases of no deviations (cases of no temperature nonuniformity), and the appropriate swing pattern is applied in either case.

Hereinbelow is a description of pattern 2, which is the swing pattern applied in the case of temperature nonuniformity, and pattern 3, which is the swing pattern applied in the case of no temperature nonuniformity.

Figure 8:
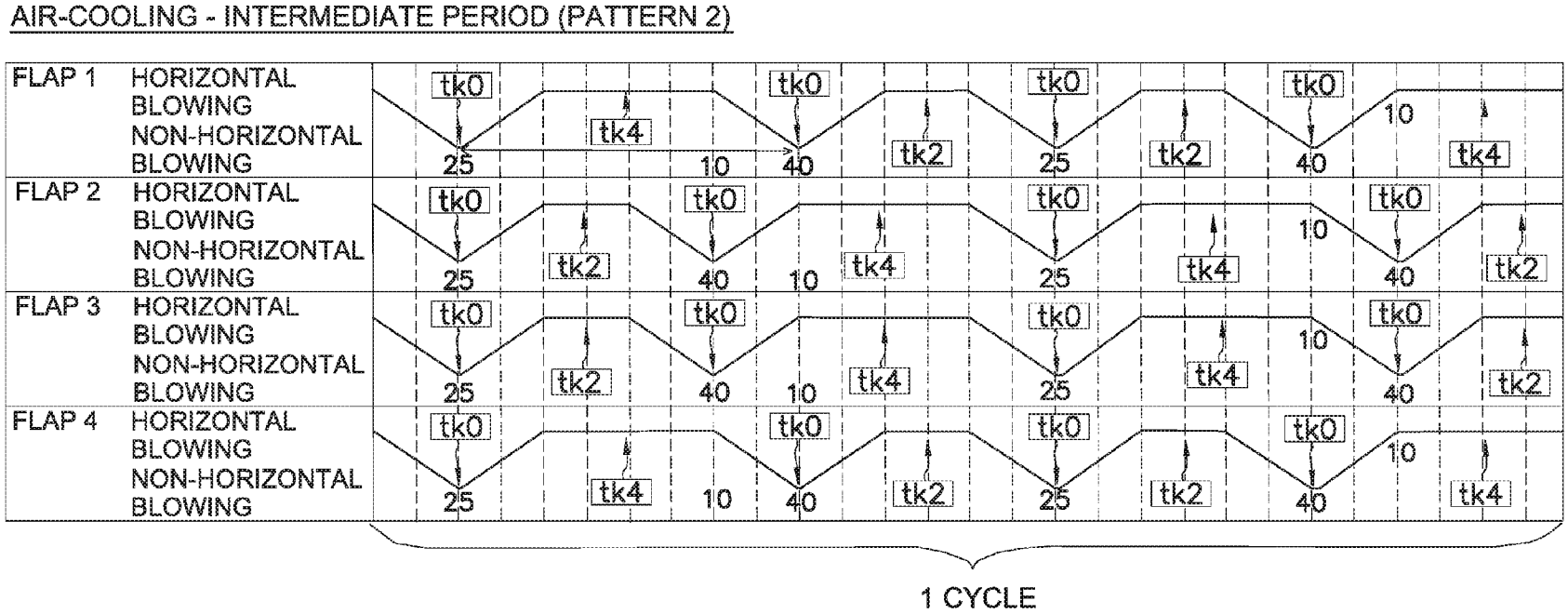
FIG. 8 is a timing chart for describing the actions of the flaps in pattern 2.
Figure 9:
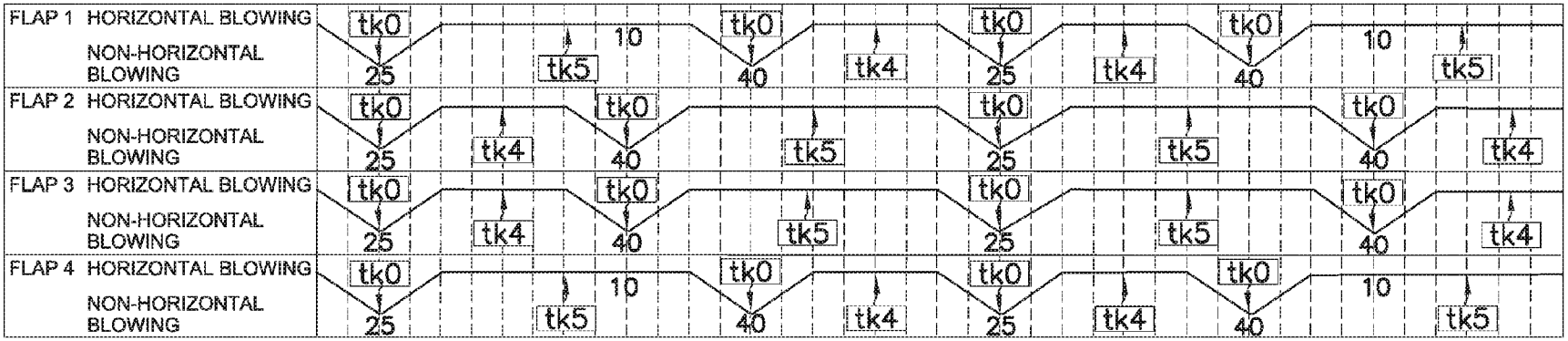
FIG. 9 is a timing chart for describing the actions of the flaps in pattern 3.

Pattern 2 is specifically described based on the swing pattern table in FIG. 6 and the time chart showing the orientations of the flaps in pattern 2 in FIG. 8.

The initial position of the flap 22*a* (flap ID1) in pattern 2 is horizontal blowing, and the initial action is to swing. In pattern 2, three different continuous time durations (tk0, tk2, and tk4) are arranged in a set of eight (1st through 8th), and keeping of the first (1st) continuous time duration takes place after the initial action of swinging. The flap then swings, and keeping of the second (2nd) continuous time duration takes place. Swinging and keeping are then repeated until the fourth (4th) time, and when the eighth (8th) keeping has ended, the flap returns to the first (1st) action by swinging. Thus, the flap alternates between swinging and keeping.

In pattern 2, the flap 22*a* and the flap 22*d* have a synchronized swing pattern, and the flap 22*b* and the flap 22*c* have a synchronized swing pattern. The continuous time duration patterns of the flap 22*b* and the flap 22*c* are the same as the continuous time duration patterns in the swing pattern of the flap 22*a* and the flap 22*d* when rearranging the order so as to begin with the fifth (5th) continuous time duration pattern and subsequently switch to the sixth (6th), the seventh (7th), the eighth (8th), the first (1st), the second (2nd), the third (3rd), and the fourth (4th) pattern.

With the control described above, the airflow quantity blown out from the discharge ports 21*a* to 21*d* at 20 seconds after the start of pattern 2 is such that an airflow quantity of 25% is blown out from each of the discharge ports 21*a* to 21*d*. At 80 seconds after the start of pattern 2, the discharge ports 21*a* and 21*d* each blow out an airflow quantity of 10% and the discharge ports 21*b* and 21*c* each blow out an airflow quantity of 40%, and at 20 more seconds, the discharge ports 21*a* and 21*d* each blow out an airflow quantity of 40% and the discharge ports 21*b* and 21*c* each blow out an airflow quantity of 10%. At 140 seconds after the start of pattern 2, the swing pattern during the 140-second first half of pattern 2 ends. The second half of pattern 2 is mostly the same as the first half, but is different from the first half in that at 80 seconds and 100 seconds after the start of the second half, the airflow quantity of the discharge ports 21*a* and 21*d* and the airflow quantity of the discharge ports 21*b* and 21*c* are opposite. Although the description of pattern 2 identifies a first half and a second half, the first half and second half are merely defined for the sake of convenience in the description and there is actually no particular distinction made between the first half and the second half.

In pattern 2, at 20 seconds after the start of both the first half and the second half in one cycle, an airflow quantity of 25% is blown out all together from each of the four discharge ports 21*a* to 21*d*. Therefore, the air within the indoor space can be agitated by a gentle airflow. At 80 to 100 seconds after the start of the first half and second half, the discharge ports 21*a* and 21*d* and the discharge ports 21*b* and 21*c* alternate between blowing out an airflow quantity of 40% and blowing out an airflow quantity of 10%. As described above, since an airflow with a low airflow rate is blown downward (i.e., onto the user) when the airflow quantity is large, agitating in the vertical direction of the space can be promoted so that the user will not feel a draft even during downward blowing. Since an airflow with a high airflow rate is blown horizontally when the air is blown horizontally with a small airflow quantity of 10%, the flow of air can be circulated throughout a wide range and the room can be cooled quickly. Specifically, an airflow quantity of 40% and an airflow quantity of 10% are combined and this combination is maintained for a comparatively short time duration of 20 seconds, whereby the air can be agitated to the corners of the space, contributing to the effect of resolving temperature nonuniformity. The frequency of downward blowing is four times per cycle (240 seconds in pattern 2), which at 0.14 times per 10 seconds is less than in pattern 1.

Pattern 3 is a swing pattern resembling pattern 2. The difference between pattern 3 and pattern 2 is the continuous time durations of the continuous time duration pattern. In the continuous time duration of pattern 3, tk2 (20 seconds) of the continuous time duration of pattern 2 is replaced by tk4 (40 seconds), and tk4 (40 seconds) of the continuous time duration of pattern 2 is replaced by tk5 (80 seconds). Specifically, in pattern 3, the predetermined continuous time durations (2nd, 4th, 6th, 8th) are twice as long as those of pattern 2. This means that the time interval from one downward blowing to the next in pattern 3 is twice as long. Pattern 3 is a swing pattern performed when there is no temperature nonuniformity during a stable period of the air-cooling operation, and the frequency of downward blowing, 0.1 times per 10 seconds, is therefore lower than in the cases of temperature nonuniformity in pattern 2.

In pattern 2, the continuous time durations of keeping in horizontal blowing may be reduced by 10 seconds each, for example. In this case, temperature nonuniformity in the room can be resolved because the frequency of downward blowing is greater than in pattern 2.

In the stable periods of the air-cooling operation, the set temperature may be set to +T° C. (e.g., 1° C.). Discomfort from drafts can thereby be reduced, and the operation can be performed with less energy consumption.

(2-3) Pattern 4 (Startup Period of Air-Warming Operation Mode)

During the startup period of the air-warming operation, the discharge temperature blown out from the air conditioning apparatus is not high enough, the user is directly exposed to a cold airflow merely by the downward blowing, and the user experiences discomfort due to a draft. With horizontal blowing alone, a warm airflow cannot be sent to the bottom of the indoor space where the user is positioned. Therefore, downward blowing must be used with an appropriate frequency. Pattern 4 is a pattern performed during this manner of startup period of the air-warming operation, wherein the frequency of downward blowing immediately after the start of the air-warming operation is reduced in order to resolve the problems described above.

Figure 10:
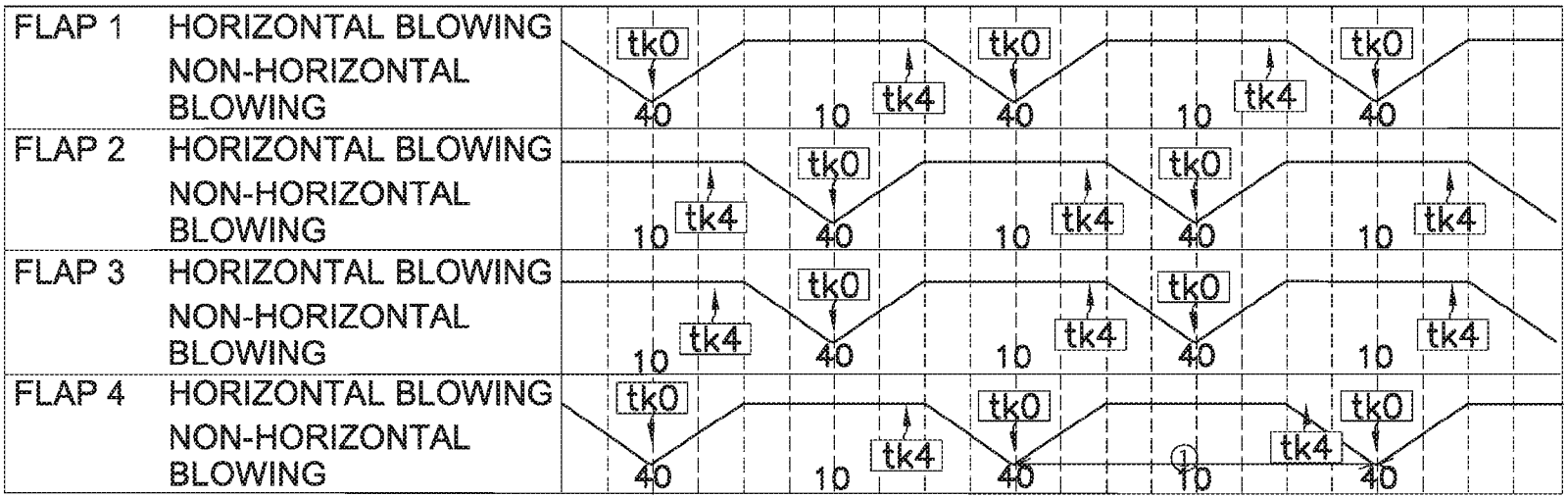
FIG. 10 is a timing chart for describing the actions of the flaps in pattern 4.
Figure 11:
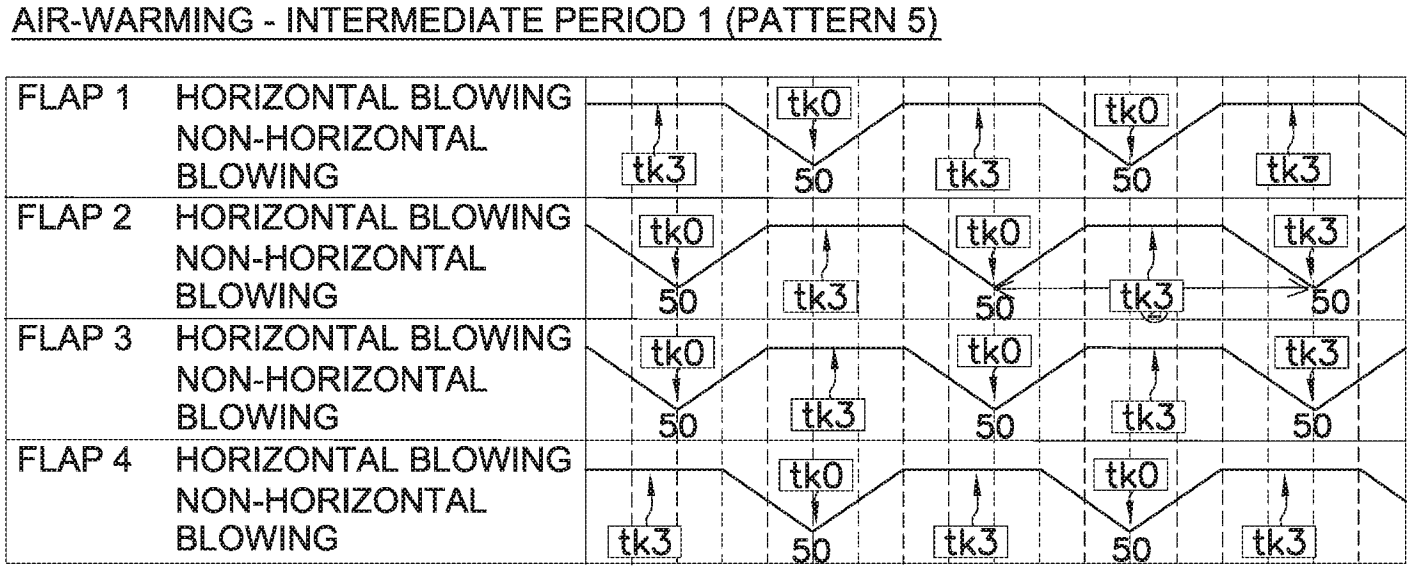
FIG. 11 is a timing chart for describing the actions of the flaps in pattern 5.
Figure 12:
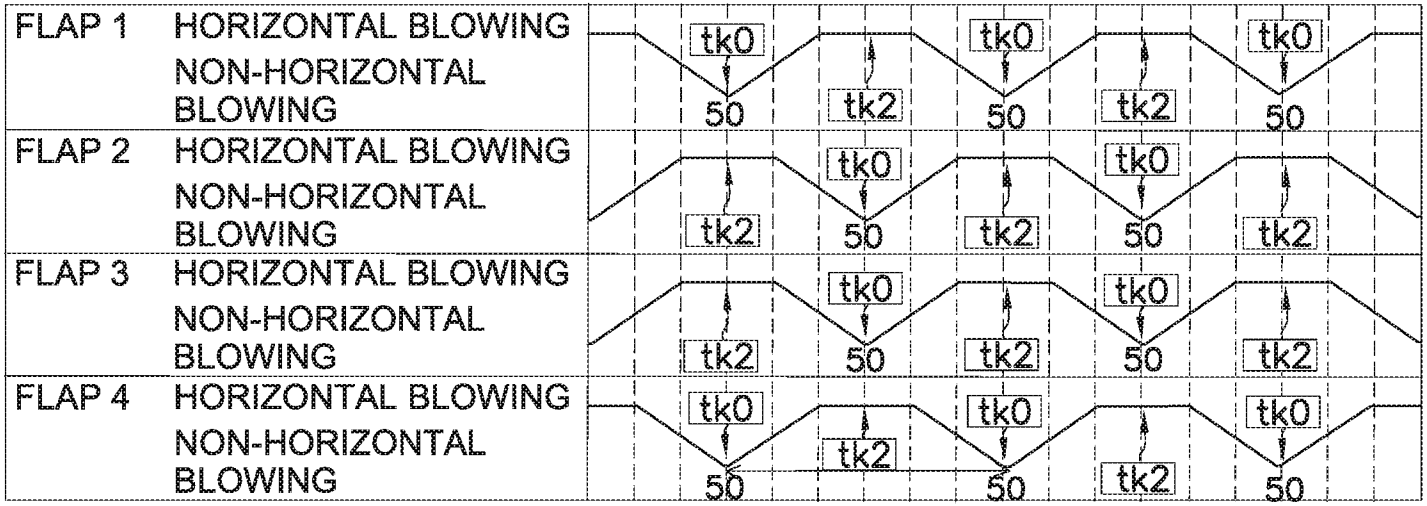
FIG. 12 is a timing chart for describing the actions of the flaps in pattern 6.
Figure 13:
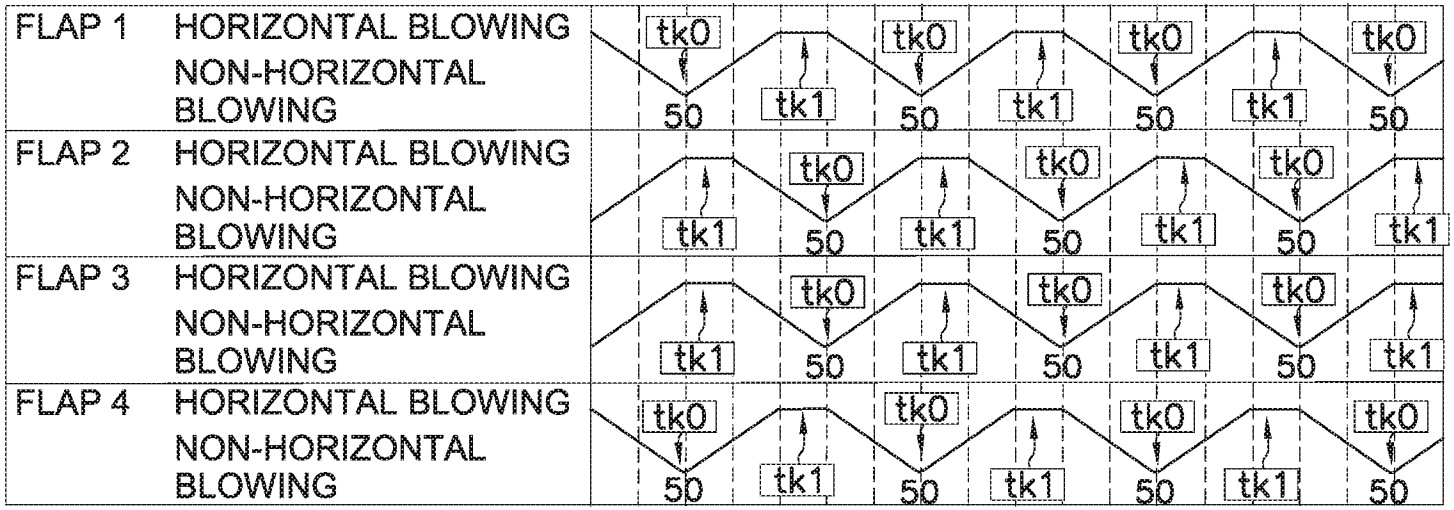
FIG. 13 is a timing chart for describing the actions of the flaps in pattern 7.
Figure 14:
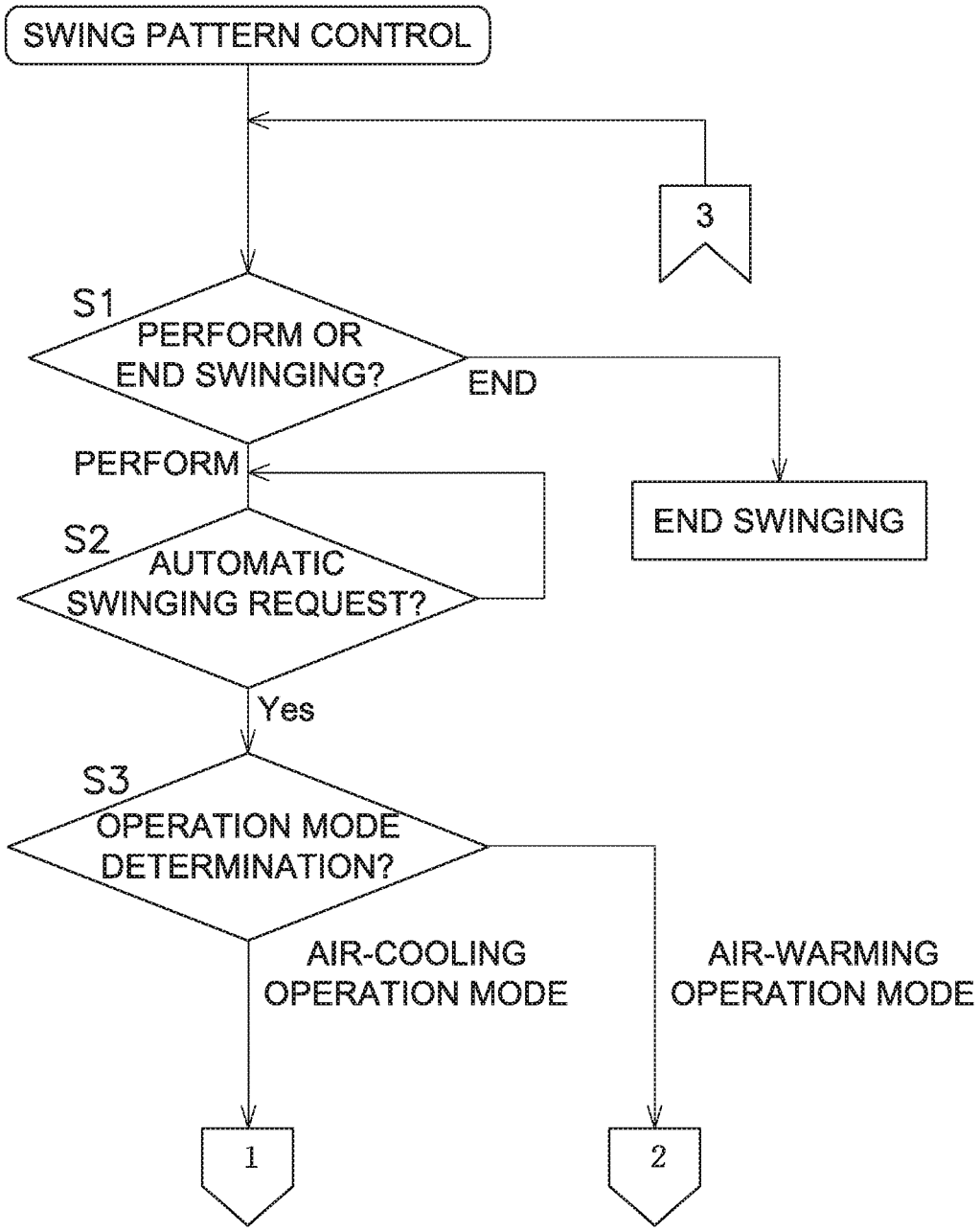
FIG. 14 is a flowchart showing the flow of the process for determining the phases.

Pattern 4 is specifically described based on the swing pattern table in FIG. 6 and the time chart showing the flap orientations in pattern 4 in FIG. 10.

The initial position of the flap 22*a* (flap ID1) in pattern 4 is horizontal blowing, and the initial action is swinging. In pattern 4, two continuous time durations (tk0 and tk4) are arranged in two sets (1st and 2nd), and the keeping of the first (1st) continuous time duration is performed after the initial action of swinging. Swinging is then performed and the keeping of the second (2nd) continuous time duration is performed. When the keeping of the second (2nd) continuous time duration ends, the flap swings back to resume the keeping of the first (1st) continuous time duration. Thus, swinging and keeping are alternated.

Pattern 4 is a swing pattern in which the flap 22*a* and the flap 22*d* performed synchronized swing actions, and the flap 22*b* and the flap 22*c* perform synchronized swing actions. The swing pattern of the flaps 22*b* and 22*c* is the opposite of the flaps 22*a* and 22*d*, with the continuous time duration pattern progressing in order from the second (2nd) to the first (1st). The swing pattern of the flaps 22*b* and 22*c* differs in that the initial action is keeping. Specifically, in the swing pattern of the flaps 22*b* and 22*c* in pattern 4, the keeping of the first (1st) continuous time duration is first performed, after which swinging is performed and the keeping of the second (2nd) continuous time duration is performed. When the keeping of the second (2nd) continuous time duration ends, swinging is performed last and the keeping of the first (1st) continuous time duration is resumed. Thus, swinging and keeping will be alternated even when the initial action is keeping.

With the control described above, the time at which the flaps 22*a* and 22*d* reach the downward blowing state is when exactly half of the continuous time duration has elapsed during the keeping of the flaps 22*b* and 22*c* in the horizontal blowing orientation, and the flaps 22*a* and 22*d* and the flaps 22*b* and 22*c* alternate swinging. In pattern 4, it takes 20 seconds for the flaps 22*a* to 22*d* to swing once, and the continuous time duration of downward blowing in pattern 4 is 0 seconds. The continuous time duration in which the flaps 22*a* to 22*d* keep the horizontal blowing state is 40 seconds. Therefore, when one pair is swinging, the other pair is keeping in the horizontal blowing state. When one pair is in the downward blowing state, the discharge ports over which that pair is positioned each blow out an airflow quantity of 40%, and the discharge ports over which the other pair is positioned each blow out an airflow quantity of 10%.

Since pattern 4 is a swing pattern performed during the air-warming operation, the continuous time duration of downward blowing is 0. Furthermore, since pattern 4 is in effect during the startup period of the air-warming operation, the airflow blown out is not warm enough, and a long time period (i.e., the continuous time duration of horizontal blowing) of 40 seconds is needed to reach downward blowing. Therefore, air that has not been warmed much can be prevented as much as possible from reaching the user, and drafty sensations can be reduced. Since downward blowing is performed periodically in addition to horizontal blowing, an insufficiently warmed airflow is blown to the bottom of the space, and the occurrence of temperature nonuniformity in the vertical direction of the indoor space can therefore be reduced. The frequency of downward blowing is once per cycle (80 seconds in pattern 4), or 0.13 times per 10 seconds, which is less than other patterns (see below).

(2-4) Pattern 5 and Pattern 6 (Intermediate Period of the Air-Warming Operation)

The term "intermediate period of the air-warming operation" refers to a state in which the discharge temperature is higher than in the startup period of the air-warming operation but is still not warm enough. Specifically, the intermediate period of the air-warming operation is a state defined in stages from the startup period of the air-warming operation until the stable period of the air-warming operation in which the discharge temperature is warm enough and the indoor temperature is also warm. The intermediate period of the air-warming operation is also divided into two stages. In the intermediate period of the air-warming operation, the discharge temperature is higher than in the startup period, and the possibility of the user experiencing discomfort due to a draft is therefore reduced even if the blowing is more frequent than in the startup period. Pattern 5 and pattern 6 are swing patterns performed during such an intermediate period of the air-warming operation, wherein the frequency of downward blowing is higher than in the startup period of the air-warming operation.

Pattern 5 is a swing pattern resembling pattern 4. Pattern 5 differs from pattern 4 in the continuous time durations of the continuous time duration pattern. In the continuous time durations of pattern 5, the continuous time duration tk4 (40 seconds) of pattern 4 is replaced with tk3 (30 seconds). Specifically, in pattern 5, a predetermined continuous time duration (the continuous time duration of horizontal blowing) is ¾ that of pattern 4. Pattern 5 takes place during the intermediate period 1 of the air-warming operation (the first stage of the intermediate period), wherein the discharge temperature is higher than in the startup period and lower than in the intermediate period 2 (the second stage of the intermediate period). Therefore, the frequency of downward blowing is greater than in pattern 4, at 0.14 times per 10 seconds.

Like pattern 5, pattern 6 is also a swing pattern resembling pattern 4. Pattern 6 differs from pattern 4 in the continuous time durations of the continuous time duration pattern. In the continuous time durations of pattern 6, the continuous time duration tk4 (40 seconds) of pattern 4 is replaced with tk2 (20 seconds). Specifically, in pattern 6, a predetermined continuous time duration (the continuous time duration of horizontal blowing) is ½ that of pattern 4. Pattern 6 takes place during the intermediate period 2 of the air-warming operation, wherein the discharge temperature is higher than in the intermediate period 1 of the air-warming operation and lower than in the stable period of the air-warming operation. Therefore, the frequency of downward blowing is greater than in pattern 5, at 0.17 times per 10 seconds.

(2-5) Pattern 7 (Stable Period of the Air-Warming Operation)

The stable period of the air-warming operation is a state in which the discharge temperature is high enough and the room interior is warm enough. During the stable period of the air-warming operation, since the discharge temperature is higher than in the intermediate periods, there is less of a possibility that the user will experience discomfort due to a draft even if blowing is more frequent than in the startup period. Pattern 7 is the swing pattern performed during this stable period of the air-warming operation, and the frequency of downward blowing is even higher than in the intermediate periods of the air-warming operation.

Pattern 7 is a swing pattern resembling pattern 4. Pattern 7 differs from pattern 4 in the continuous time durations of the continuous time duration pattern. In the continuous time durations of pattern 7, the continuous time duration tk4 (40 seconds) of pattern 4 is replaced by tk1 (10 seconds). Specifically, in pattern 7, a predetermined continuous time duration (the continuous time duration of horizontal blowing) is ¼ that of pattern 4. Pattern 7 is in effect during the stable period of the air-warming operation, and the discharge temperature is higher than in the intermediate period 2. Therefore, the frequency of downward blowing is higher than in pattern 6 at 0.2 times per 10 seconds.

(3) Swing Pattern Selection Control

In the air conditioning apparatus 1, the discharge temperature, the indoor temperature (the intake temperature in the present embodiment), the set temperature, and other factors are observed to determine the seven phases described above. FIGS. 14 through 17 are flowcharts showing the flow of the process for determining the phases.

The phase determination method is described hereinbelow based on FIGS. 14 through 17.

First, in step S1, a determination is made as to whether swinging will be performed or ended. This determination is made based on settings implemented by the user through the remote controller 5 or other input means. Specifically, it is determined that swinging will be performed when the user sets swinging to on through the remote controller 5 or other input means, and it is determined that swinging will be ended when swinging is set to off. When swinging is set to on in step S1, the process transitions to the next step S2, and when swinging is set to off, the swing action is stopped.

In step S2, a determination is made as to whether or not there is an automatic swinging request. The swing pattern control according to the present embodiment is thereby performed only when automatic swinging has been set. In step S2, when it is determined that there is an automatic swinging request, the process transitions to step S3, and when it is determined that there is no automatic swinging request, the process returns to step S1.

In step S3, a determination is made as to whether the operation mode is the air-cooling operation mode or the air-warming operation mode. In step S3, when it is determined to be the air-cooling operation mode, the process transitions to step S4 (see FIG. 15), and when it is determined to be the air-warming operation mode, the process transitions to step S13 (see FIGS. 16 and 17).

(3-1) Phase Determination of Air-Cooling Operation Mode

Figure 15:
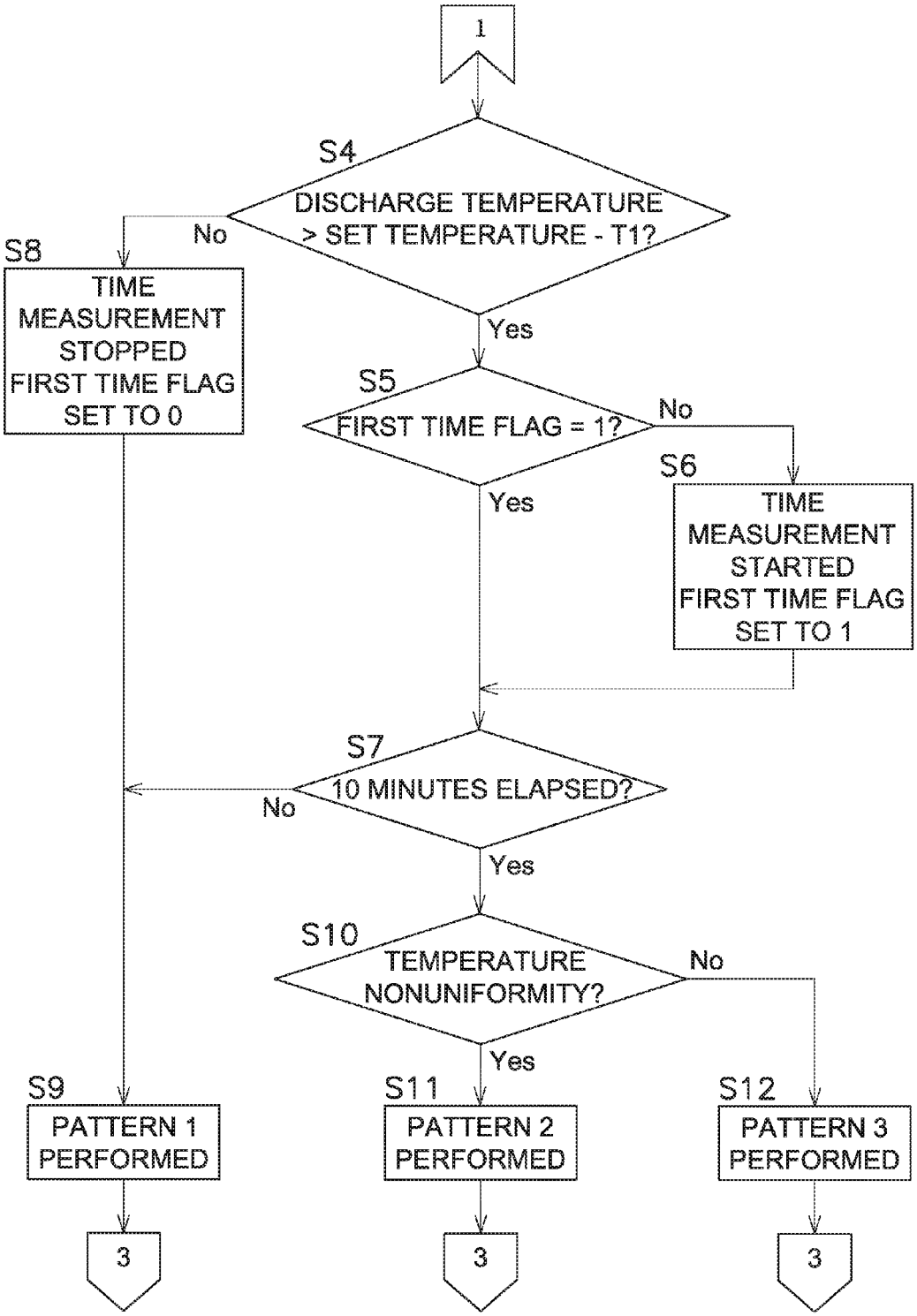
FIG. 15 is a flowchart showing the flow of the process for determining the phases.

The following is a description based on FIG. 15 of a case in which the operation mode is determined in step S3 to be the air-cooling operation mode (steps S4 to S12).

In step S4, a determination is made as to whether or not the discharge temperature is less than a temperature of T1 (K) (e.g., 10 K) subtracted from the set temperature. When the discharge temperature is determined to be less than a temperature of T1 (K) subtracted from the set temperature, the process transitions to step S5, and when the discharge temperature is not determined to be less than a temperature of T1 (K) subtracted from the set temperature, the process transitions to step S8.

In step S5, a determination is made as to whether or not a first time flag is 1. The first time flag is used as a basis to determine whether or not time has been measured with the condition of step S4 having been fulfilled. In step S5, when the first time flag is 1, it is determined that time has been measured with the condition of step S4 having been fulfilled and the process transitions to step S6, and when the first time flag is not 1 (when it is 0), it is determined that time has not been measured with the condition of step S4 having been fulfilled and the process transitions to step S7.

In step S6, time measurement is started and the first time flag is set to 1. Setting the first time flag to 1 makes it possible to determine that time has been measured with the condition of step S4 having been fulfilled. When step S6 ends, the process transitions to step S7.

Step S7 is performed when the condition of step S5 is fulfilled (i.e., when time has been measured with the condition of step S4 having been fulfilled). In step S7, a determination is made as to whether or not 10 minutes have elapsed since the start of time measurement. In step S7, when 10 minutes have elapsed since the start of time measurement, the process transitions to step S10, and when 10 minutes have not elapsed since the start of time measurement, the process transitions to step S9.

Step SS8 is performed when the condition of step S4 has not been fulfilled. In step SS8, time measurement is stopped in the case that time measurement has been performed, the first time flag is set to 0, and the process then transitions to step S9. In the case that time measurement has not been performed, the process transitions to step S9 without any change.

In step S9, the swing pattern of pattern 1 is selected according to a swing pattern table. The swing pattern of pattern 1 is performed, after which the process returns to step S1.

In step S10, a determination is made as to whether or not there is temperature nonuniformity in the vertical direction in the space inside the room (the indoor space). Specifically, the determination performed herein determines that there is temperature nonuniformity in the vertical direction in the indoor space when the difference between the intake temperature detected by the intake temperature sensor 26 and the floor temperature detected by the floor temperature sensor 27 is determined to be Δt (K) (e.g., 4 K) or greater. In step S10, when there is determined to be temperature nonuniformity in the vertical direction in the indoor space, the process transitions to step S11, and when there is determined to be no temperature nonuniformity in the vertical direction in the indoor space, the process transitions to step S12.

In step S11, the swing pattern of pattern 2 is selected according to the swing pattern table. The swing pattern of pattern 2 is performed, after which the process returns to step S1.

In step S12, the swing pattern of pattern 3 is selected according to the swing pattern table. The swing pattern of pattern 3 is performed, after which the process returns to step S1.

Steps S4 through S8 determine whether the operation mode is the startup period of the air-cooling operation mode or the stable period of the air-cooling operation mode. The phrase "the stable period of the air-cooling operation mode" in the present embodiment refers to a case in which the discharge temperature continues to be less than the temperature of T1 (K) (e.g., 10 K) subtracted from the set temperature for t1 (min) (e.g., 10 minutes) or more. The phrase "the startup period of the air-cooling operation mode" refers to cases other than "the stable period of the air-cooling operation mode." Specifically, when the process progresses through steps S4 through SS8 to reach step S9, it is considered as the startup period of the air-cooling operation mode, and when the process reaches step S10, it is considered as the stable period of the air-cooling operation mode. In step S10, the stable period of the air-cooling operation mode is further divided into cases of temperature nonuniformity and cases of no temperature nonuniformity.

Thus, in steps S4 through S8 and step S10, a distinction is made between the three phases of the air-cooling operation mode, and swing patterns corresponding to these phases are performed. Specifically, the swing pattern of pattern 1 is performed in the startup period of the air-cooling operation mode, the swing pattern of pattern 2 is performed in the stable period of the air-cooling operation mode (temperature nonuniformity), and the swing pattern of pattern 3 is performed in the stable period of the air-cooling operation mode (no temperature nonuniformity).

(3-2) Phase Determination in Air-Cooling Operation Mode

Figure 16:
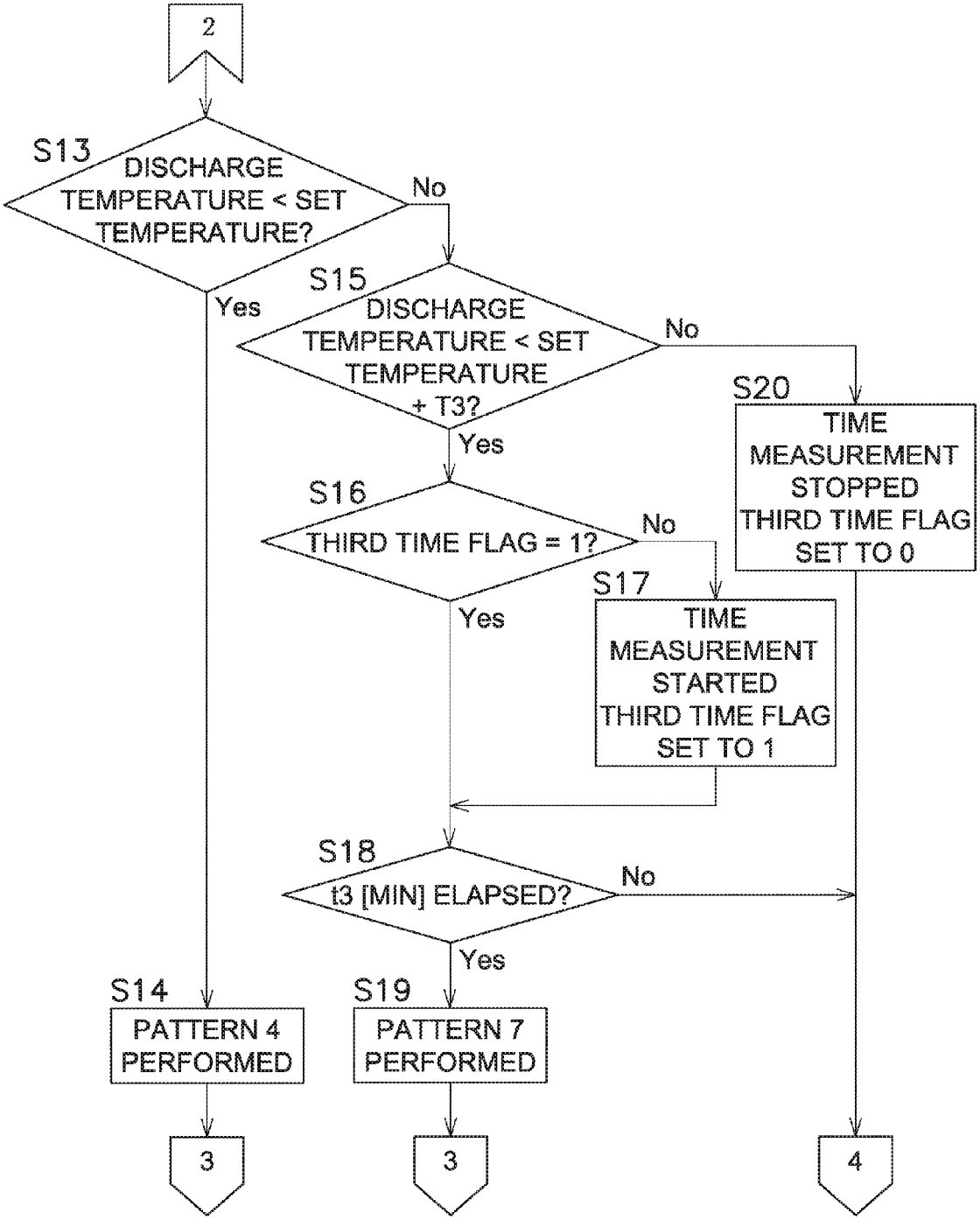
FIG. 16 is a flowchart showing the flow of the process for determining the phases.
Figure 17:
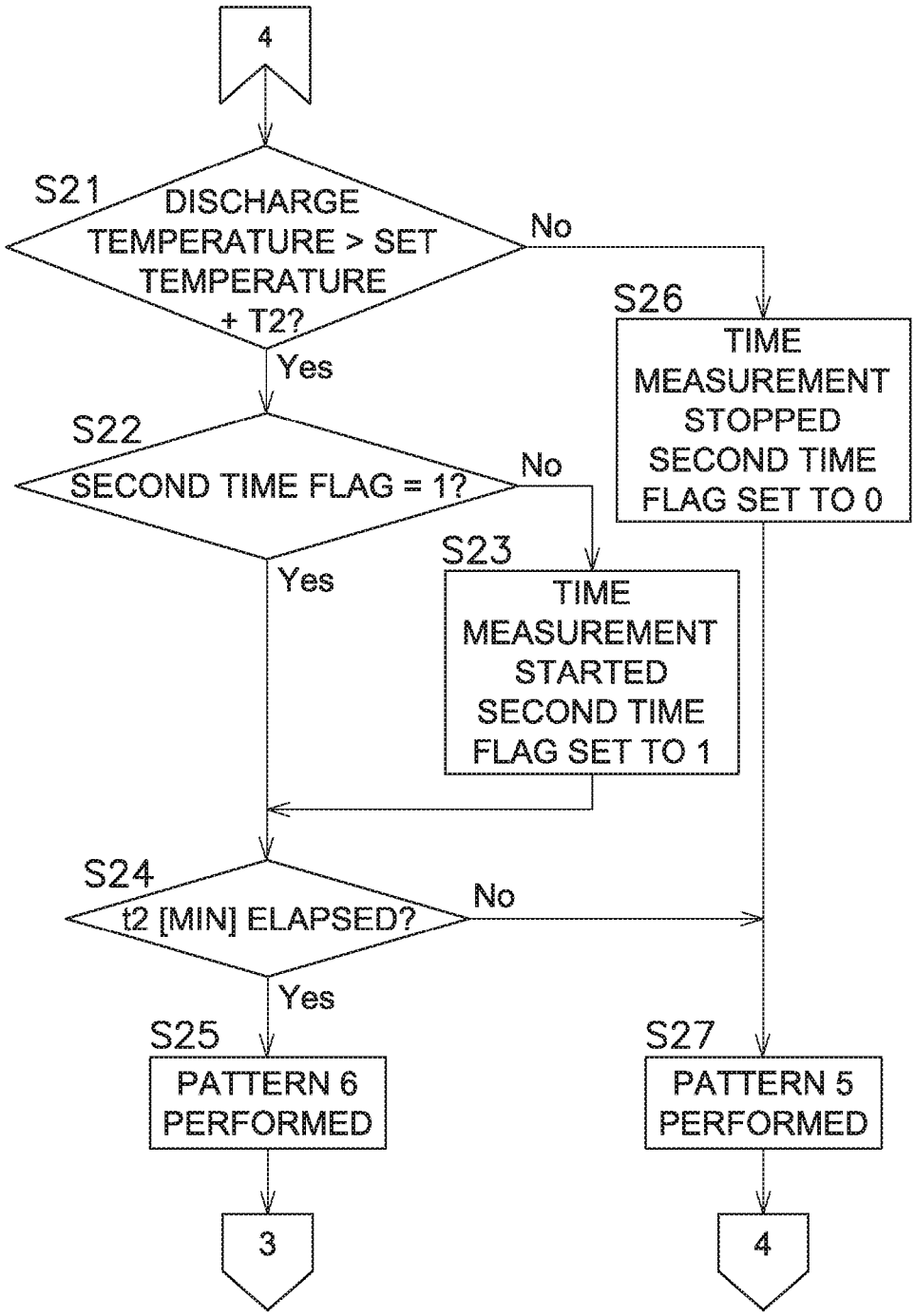
FIG. 17 is a flowchart showing the flow of the process for determining the phases.

The following is a description based on FIGS. 16 and 17 of a case in which it is determined to be the air-warming operation mode in step S3 (steps S13 to S27).

Step S13 determines whether or not the discharge temperature is less than the set temperature. When the discharge temperature is determined to be less than the set temperature, the process transitions to step S14, and when the discharge temperature is not determined to be less than the set temperature, the process transitions to step S15.

In step S14, the swing pattern of pattern 4 is selected according to the swing pattern table. The swing pattern of pattern 4 is then performed, after which the process returns to step S1.

In step S15, a determination is made as to whether or not the discharge temperature is higher than a temperature of T3 (K) (e.g., 10 K) added to the set temperature. When the discharge temperature is determined to be higher than a temperature of T3 (K) added to the set temperature, the process transitions to step S16, and when the discharge temperature is not determined to be higher than a temperature of T3 (K) added to the set temperature, the process transitions to step S20.

Step S16 determines whether or not a third time flag is 1. The third time flag is used as a basis to determine whether or not time has been measured with the condition of step S15 having been fulfilled. In step S16, when the third time flag is 1, it is determined that time has been measured with the condition of step S15 having been fulfilled and the process transitions to step S18, and when the third time flag is not 1 (when it is 0), it is determined that time has not been measured with the condition of step S15 having been fulfilled and the process transitions to step S17.

In step S17, time measurement is started and the third time flag is set to 1. Setting the third time flag to 1 makes it possible to determine that time has been measured with the condition of step S15 having been fulfilled. When step S17 ends, the process transitions to step S18.

Step S18 is performed when the condition of step S16 is fulfilled (i.e., when time has been measured with the condition of step S15 having been fulfilled). In step S18, a determination is made as to whether or not 10 minutes have elapsed since the start of time measurement. In step S18, when 10 minutes have elapsed since the start of time measurement, the process transitions to step S19, and when 10 minutes have not elapsed since the start of time measurement, the process transitions to step S1.

In step S19, the swing pattern of pattern 7 is selected according to the swing pattern table. The swing pattern of pattern 7 is performed, after which the process returns to step S1.

Step S20 is performed when the condition of step S15 has not been fulfilled. In step S20, time measurement is stopped in the case that time measurement has been performed, the third time flag is set to 0, and the process then transitions to step S1. In the case that time measurement has not been performed, the process transitions to step S1 without any change.

In step S21, a determination is made as to whether or not the discharge temperature is higher than a temperature of T2 (K) (e.g., 5 K) added to the set temperature. When the discharge temperature is determined to be higher than a temperature of T2 (K) added to the set temperature, the process advances to step S22, and when the discharge temperature is not determined to be higher than a temperature of T2 (K) added to the set temperature, the process advances to step S26.

Step S22 determines whether or not a second time flag is 1. The second time flag is used as a basis to determine whether or not time has been measured with the condition of step S21 having been fulfilled. In step S22, when the second time flag is 1, it is determined that time has been measured with the condition of step S21 having been fulfilled and the process transitions to step S24, and when the second time flag is not 1 (when it is 0), it is determined that time has not been measured with the condition of step S21 having been fulfilled and the process transitions to step S23.

In step S23, time measurement is started and the second time flag is set to 1. Setting the second time flag to 1 makes it possible to determine that time has been measured with the condition of step S21 having been fulfilled. When step S23 ends, the process transitions to step S24.

Step S24 is performed when the condition of step S22 is fulfilled (i.e., when time has been measured with the condition of step S21 having been fulfilled). In step S23, a determination is made as to whether or not 3 minutes have elapsed since the start of time measurement. In step S24, when 3 minutes have elapsed since the start of time measurement, the process transitions to step S25, and when 3 minutes have not elapsed since the start of time measurement, the process transitions to step S27.

In step S25, the swing pattern of pattern 6 is selected according to the swing pattern table. The swing pattern of pattern 6 is performed, after which the process returns to step S1.

Step S26 is performed when the condition of step S21 has not been fulfilled. In step S27, time measurement is stopped in the case that time measurement has been performed, the second time flag is set to 0, and the process then transitions to step S27. In the case that time measurement has not been performed, the process transitions to step S27 without any change.

In step S27, the swing pattern of pattern 5 is selected according to the swing pattern table. The swing pattern of pattern 5 is performed, after which the process returns to step S1.

Steps S13 to S27 determine cases when the startup period of the air-warming operation mode is in effect in step S13 and cases when it is not. The term "the startup period of the air-warming operation mode" refers to cases in which the discharge temperature is less than the set temperature, as is determined in step S13. Cases in which the startup period of the air-warming operation mode is not in effect are classified in stages into three phases by steps S15 to S27, and the swing patterns corresponding to each of the phases are performed. Specifically, cases in which the startup period of the air-warming operation mode is not in effect are classified into the following three phases as described above: the intermediate period 1 of the air-warming operation mode, the intermediate period 2 of the air-warming operation mode, and the stable period of the air-warming operation mode. The term "the intermediate period 1 of the air-warming operation mode" refers to cases in which the discharge temperature is equal to or greater than the set temperature neither the intermediate period 2 of the air-warming operation mode nor the stable period of the air-warming operation mode, described hereinafter, are in effect. The term "the intermediate period 2 of the air-warming operation mode" refers to cases in which the discharge temperature continues to be higher than a temperature of T2 (K) added to the set temperature for 3 minutes. The term "the stable period of the air-warming operation mode" refers to cases in which the discharge temperature continues to be higher than a temperature of T3 (K) added to the set temperature for 10 minutes.

Thus, in steps S13 to S27, a distinction is made between the four phases in the air-warming operation mode, and the swing patterns corresponding to each of the phases are performed. Specifically, the swing pattern of pattern 4 is performed in the startup period of the air-warming operation mode, the swing pattern of pattern 5 is performed in the intermediate period 1 of the air-warming operation mode, the swing pattern of pattern 6 is performed in the intermediate period 2 of the air-warming operation mode, and the swing pattern of pattern 7 is performed in the stable period of the air-warming operation mode.

In the flowcharts performed in the determination of phases described above, the units of t1 to t3 are in (minutes) but are not limited thereto. Furthermore, t1 to t3 are given specific numerical values, but t1 to t3 are not limited to these numerical values either.

(4) Characteristics (4-1)

In the air conditioning apparatus 1 of the present embodiment, the seven phases (three in the air-cooling operation and four in the air-warming operation) and seven swing patterns are correlated and stored in the memory 42, the phases being a further division of the two operation modes (the air-cooling operation mode and the air-warming operation mode) according to their conditions (startup periods, stable periods, and intermediate periods). The pattern selector 41*b* selects swing patterns according to the seven phases determined by the phase determining unit 41*a*. Each of the phases, from the startup period of the air conditioning apparatus 1 to the stable period in which air-conditioning control of the room interior is performed sufficiently by the air conditioning apparatus 1, are determined by the phase determining unit 41*a*. Based on the selected swing pattern, the pattern command generator 41*e* then generates a control command pertaining to the swing actions of flaps of the air conditioning apparatus. Specifically, the air conditioning apparatus 1 executes the swing patterns taking into account the comfort level (e.g., discomfort index and the like) in the space where the air conditioning apparatus is installed, in accordance with the phase determined according to the conditions in the air conditioning apparatus at the time. In the air conditioning apparatus 1, when the swing pattern processor executes a swing pattern, the continuous time duration decider 41*c* decides a time duration in which a flap maintains a predetermined orientation to be a continuous time duration on the basis of a plurality of swing patterns, and the decided continuous time duration is set to the data processor 41. The state from the startup period to the stable period of the air conditioning apparatus includes intermediate periods and the like, which are states in which there is temperature nonuniformity in the room. According to the selected swing pattern, in the air-cooling operation mode, air is blown out more frequently in a nearly vertical direction during the startup period than in the stable period, and in the air-warming operation mode, air is blown out more frequently in a nearly vertical direction during the stable period than in the startup period.

Therefore, the optimal swing pattern for the phase can be executed for each of the seven phases of different conditions. When a swing pattern is executed, the frequency of the swing action can be varied. Therefore, deviations in the temperature distribution in the vertical direction occurring in the air-conditioned space can be resolved, discomfort due to drafts can be reduced, and the comfort level in the room can be improved.

(4-2)

In the air conditioning apparatus of the present embodiment, the discharge temperature, the intake temperature, and the floor temperature are detected, and the phase determining unit 41*a* determines the seven phases on the basis of the detected temperatures and the operation modes at the times thereof.

Thus, since the phase determining unit determines the seven phases in accordance with the state of the indoor temperature conditions, the optimal swing pattern for the temperature conditions at the time can be selected.

(4-3)

In the air conditioning apparatus 1 of the present embodiment, the memory 42 stores a plurality of swing patterns correlated with each of the four flaps 22*a* to 22*d* of the air conditioning apparatus. In the air conditioning apparatus 1 of the present embodiment, IDs corresponding to the four discharge ports 21*a* to 21*d* are stored in the memory 42. Based on the stored IDs, pairs of two flaps are decided by the pair designator 41*d*, the flaps being provided to the discharge ports 21*a* and 21*d* and the discharge ports 21*b* and 21*c*, which are pairs of adjacent discharge ports. The swing patterns of the flaps 22*a* to 22*d* set in the same pair are synchronized based on the control command generated by the swing pattern processor. In the air conditioning apparatus 1, of the four flaps provided to the four discharge ports 21*a* to 21*d*, the pairs execute the same swing pattern at different timings. Specifically, two flaps of the same pair (a first pair) and the two flaps (a second pair) other than those of the first pair execute a swing pattern at different timings, and at this time the swing patterns executed by the first pair and the second pair are the same.

When the swing patterns of two flaps provided to two adjacent discharge ports are synchronized and the airflow directions blown out from these discharge ports are made to have the same up-and-down motion, a swirl flow readily arises in the vertical direction of the space. Therefore, a swirl flow of the air in the longitudinal direction can be created with the control device of the present invention. Since the pairs execute the same swing pattern with different timings, an irregular flow of air can be produced within the space. It is therefore possible to minimize the discomfort a user would experience due to being accustomed to a single swing pattern.

(5) Modifications (5-1) Modification 1A

In the air conditioning apparatus 1 in the embodiment described above, an example was given in which the indoor unit 2 of the air conditioning apparatus 1 was a ceiling-mounted indoor unit capable of blowing out air in four directions, but the indoor unit is not limited as such and may be, for example, a ceiling-mounted indoor unit capable of blowing out air in two directions, or a ceiling-mounted or wall-mounted indoor unit capable of blowing out air in one direction.

An indoor unit that blows out air in two directions (hereinbelow referred to as a double-flow indoor unit) is an indoor unit in which two long, thin rectangular discharge ports are disposed in parallel. In a double-flow indoor unit, horizontal blowing blows in a horizontal direction opposite of the center direction of the indoor unit (i.e., to the outside of the indoor unit), and downward blowing blows below the indoor unit. In the embodiment described above, the four flaps are divided into two pairs whose swing actions are controlled, but a double-flow indoor unit is controlled so that one of the two flaps corresponds to one four-direction pair and the other flap corresponds to the other pair.

An indoor unit that blows out air in one direction (hereinbelow referred to as a single-flow indoor unit) is an indoor unit in which one long, thin rectangular discharge port is disposed. There are ceiling-mounted and wall-mounted single-flow indoor units (room air conditioners). A single-flow indoor unit has one discharge port and therefore also has one corresponding flap. The swing action thereof is controlled so as to correspond to the swing pattern of one flap (e.g., the flap 22*a*) of the embodiment described above.

The control such as is described above makes it possible to achieve substantially the same effects as the embodiment described above with either a double-flow or single-flow indoor unit.

(5-2) Modification 1B

In the embodiment described above, the air-conditioning control unit 4 is placed in the outdoor unit 3, but is not limited and may function alone without being installed in the air conditioning apparatus 1, such as being installed in a centralized remote controller, an air-conditioning controller, or a central monitoring device. In this case, the air-conditioning control unit 4 is connected with the air conditioning apparatus 1 by a communication wire, and the air-conditioning control unit 4 sends and receives various information.

(5-3) Modification 1C

In the embodiment described above, the air conditioning apparatus 1 is a pair type of air conditioning apparatus in which one indoor unit 2 corresponds to one outdoor unit 3, but is not limited as such and may be a multiple type air conditioning apparatus in which a plurality of indoor units 2 correspond to one outdoor unit 3.

In this case, when the determination of temperature nonuniformity in the air-cooling operation determines that there is temperature nonuniformity in X % (e.g., 50%) of the total number of indoor units 2 in the operating state, the determination is that there is temperature nonuniformity.

(5-4) Modification 1D

In the embodiment described above, the determination of the air-cooling operation phases and the determination of the air-warming operation phases were performed based on the relationship between the discharge temperature and the set temperature, but the determinations are not limited as such.

For example, the phase may be determined to be the stable period of the air-cooling operation or the air-warming operation when the absolute value of the difference between the indoor temperature and the set temperature is less than T11 (K). The phase may also be determined to be the stable period of the air-cooling operation or the air-warming operation when the absolute value of the difference between the set temperature and a detected floor temperature is less than T12 (K). The phase may also be determined to be the stable period of the air-cooling operation or the air-warming operation when the absolute value of the difference between the indoor temperature (or floor temperature) prior to a predetermined time duration and the current indoor temperature (or floor temperature) is less than T13 (K).

(5-5) Modification 1E

In the embodiment described above, a swing pattern (pattern 2) was executed in which temperature nonuniformity is automatically determined in the air-cooling operation to resolve temperature nonuniformity, but the swing pattern is not limited as such and a swing pattern for resolving temperature nonuniformity may be executed when the user feels temperature nonuniformity.

(5-6) Modification 1F

In the embodiment described above, temperature nonuniformity determination was not performed in the air-warming operation, but a temperature nonuniformity determination may be performed in the same manner as the temperature nonuniformity determination (see step S10) in the air-cooling operation.

In this case, when there is determined to be temperature nonuniformity, a swing pattern with a high frequency of downward blowing may be selected to resolve the temperature nonuniformity.

(5-7) Modification 1G

In the embodiment described above, a temperature value obtained by the intake temperature sensor 26 was used as the indoor temperature, but obtaining the indoor temperature is not limited as such and an indoor temperature near the height where the user is located may be estimated from the detected intake temperature and floor temperature, or an indoor temperature sensor capable of obtaining the indoor temperature may be provided (e.g., at the height where the user is located) and a temperature value obtained by this temperature sensor may be used as the indoor temperature. When an indoor temperature sensor is provided, the sensor may be connected with the air-conditioning control unit 4 either by a communication wire or wirelessly (ZigBee or the like).

(5-8) Modification 1H

Figure 18:
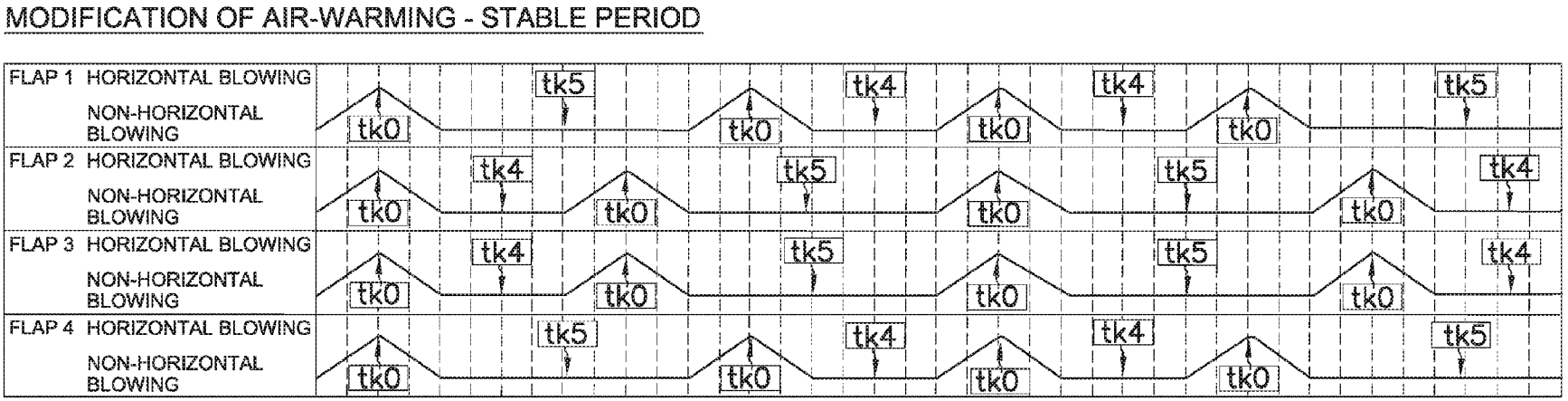
FIG. 18 is a timing chart for describing the actions of the flaps in the pattern of Modification (8).

In the embodiment described above, the air-cooling operation and air-warming operation both provide swing patterns that are effective in terms of draft avoidance so as not to subject the user to a drafty feeling, but the swing patterns are not limited as such in the case of the air-warming operation (particularly in the stable period of the air-warming operation). Since the discharge temperature is high enough in the stable period of the air-warming operation, another option is to make it possible to select a swing pattern (see FIG. 18) that warms the feet rather than avoiding a drafty feeling, in accordance with the user's preference (such as the user operating with a remote controller, for example).

Second Embodiment

An air conditioning apparatus 110 according to the second embodiment of the present invention is described hereinbelow. The air conditioning apparatus 110 comprises an outdoor unit 120 set up outdoors and an indoor unit 130 set up indoors, and can execute various operations such as an air-cooling operation and an air-warming operation.

(1) Outdoor Unit

Figure 19:
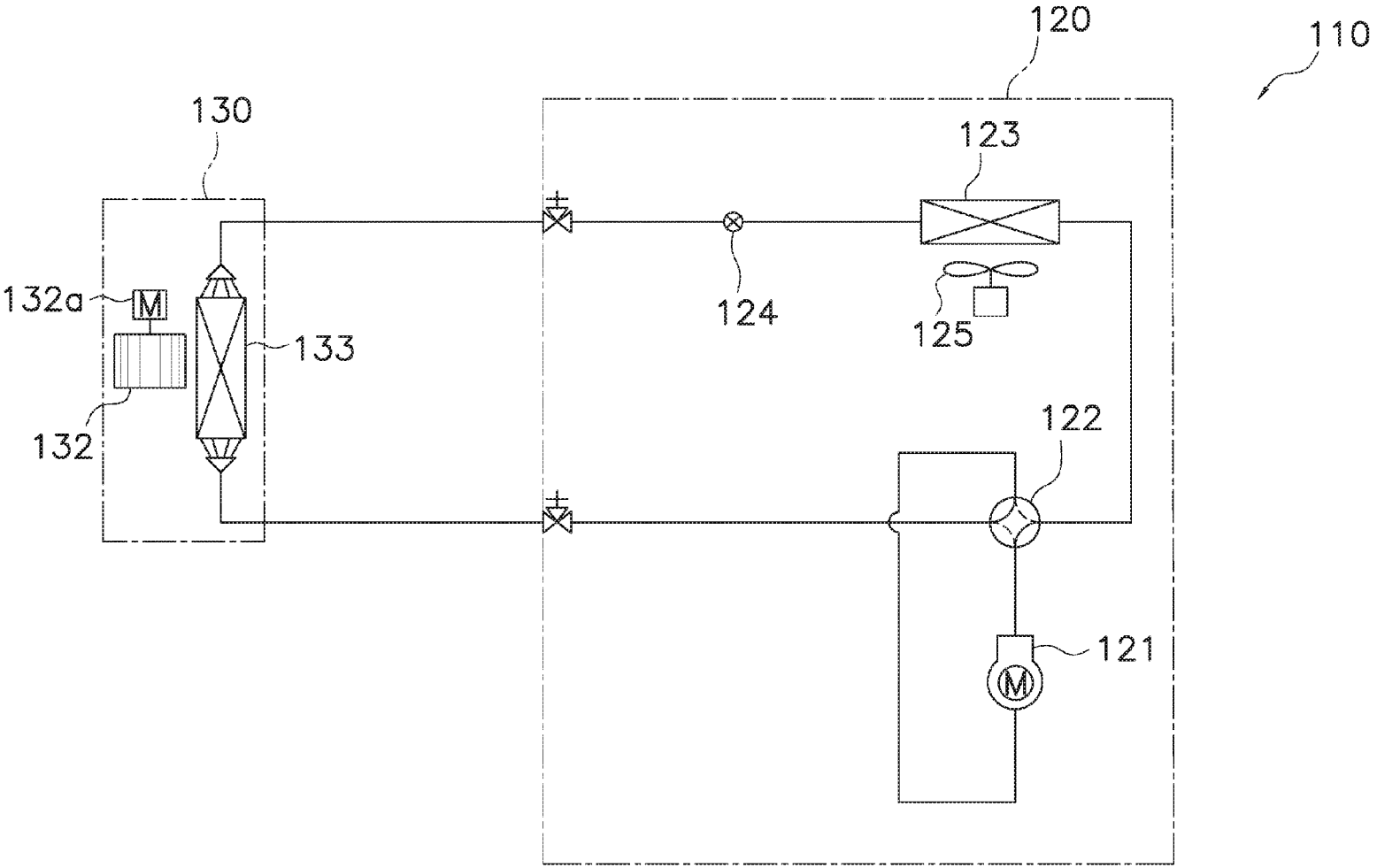
FIG. 19 is a schematic refrigerant circuit drawing of the air conditioning apparatus according to an embodiment of the present invention.

The outdoor unit 120 has a compressor 121, a four-way switching valve 122 connected to the discharge side of the compressor 121, an outdoor heat exchanger 123 connected to the four-way switching valve 122, and an expansion valve 124 connected to the outdoor heat exchanger 123 (see FIG. 19).

The compressor 121 is a mechanism for discharging high-pressure gas refrigerant after a low-pressure gas refrigerant has been drawn in and compressed into a high-pressure gas refrigerant. The four-way switching valve 122 is a valve for switching the direction of refrigerant flow during switching between the air-cooling operation and the air-warming operation. During the air-cooling operation, the four-way switching valve 122 connects the discharge side of the compressor 121 and the gas side of the outdoor heat exchanger 123, and also connects a hereinafter-described indoor heat exchanger 133 and the intake side of the compressor 121. During the air-warming operation, the four-way switching valve 122 connects the discharge side of the compressor 121 and the indoor heat exchanger 133, and also connects the gas side of the outdoor heat exchanger 123 and the intake side of the compressor 121. The outdoor heat exchanger 123 is a heat exchanger that functions as a radiator of the refrigerant during the air-cooling operation and functions as an evaporator of the refrigerant during the air-warming operation. During the air-cooling operation, the expansion valve 124 depressurizes high-pressure liquid refrigerant whose heat has been radiated in the outdoor heat exchanger 123 before the refrigerant is sent to the indoor heat exchanger 133. During the air-warming operation, the expansion valve 124 depressurizes the high-pressure liquid refrigerant whose heat has been radiated in the indoor heat exchanger 133 before the refrigerant is sent to the outdoor heat exchanger 123. Furthermore, an outdoor fan 125 is provided inside the outdoor unit 120. The outdoor fan 125 is a propeller fan for taking in outdoor air and expelling the air out of the outdoor unit 120 after heat exchange in the outdoor heat exchanger 123.

(2) Indoor Unit

The indoor unit 130 is a ceiling-mounted indoor unit referred to as the ceiling-embedded type, and is set up in proximity to the ceiling of the room interior. The indoor unit 130 has a casing 131 for storing various structural devices in its interior, an indoor fan 132, an indoor heat exchanger 133, a plurality of (four in the present embodiment) flaps 134*a*, 134*b*, 134*c*, 134*d*, an intake temperature sensor T1, a floor temperature sensor T2, and a remote controller 180 (see FIGS. 19, 20, 21, 22, 23, and 24).

(2-1) Casing

The casing 131 is configured from a casing main body 135 and a decorative panel 136 disposed on the bottom side of the casing main body 135. The casing main body 135 is disposed as being inserted into an opening O formed in a ceiling U. The decorative panel 136 is also disposed so as to fit into the opening O of the ceiling U.

The casing main body 135 is a substantially 8-sided box-shaped member formed so that long sides and short sides alternate in a plan view, the bottom surface of which is open. Housed inside the casing main body 135 are the indoor fan 132, the indoor heat exchanger 133, and other components.

The decorative panel 136 is a plate-shaped member which substantially has the shape of a square in a plan view. Discharge ports 137 and an intake port 136*a* are formed in the decorative panel 136. The discharge ports 137 are openings for blowing air out into the room, and are positioned so as to encircle the peripheral edges of the decorative panel 136 in a plan view. The intake port 136*a* is an opening for drawing in the indoor air, and is positioned in the substantial center of the decorative panel 136 in a plan view, i.e., so as to be encircled by the discharge ports 137. Specifically, the intake port 136*a* is a substantially 4-corner shaped opening, and the discharge ports 137 are substantially 4-corner annular openings.

(2-2) Indoor Fan

The indoor fan 132 is a centrifugal air blower capable of generating a flow of air by being driven. Specifically, the indoor fan 132 draws indoor air into the casing main body 135 through the intake port 136*a*, and blows the air out of the casing main body 135 through the discharge ports 137 after the air has undergone heat exchange in the indoor heat exchanger 133. The indoor fan 132 also has a fan motor 132*a* whose rotational speed can be varied by an inverter device (not shown). The airflow quantity of the indoor fan 132 can be controlled by controlling the rotational speed of the fan motor 132*a*.

(2-3) Indoor Heat Exchanger

The indoor heat exchanger 133 is a heat exchanger that functions as an evaporator of refrigerant during the air-cooling operation and functions as a heat radiator of refrigerant during the air-warming operation. The indoor heat exchanger 133 performs heat exchange between the refrigerant and the indoor air drawn into the casing main body 135, and can cool the indoor air during the air-cooling operation and heat the indoor air during the air-warming operation.

(2-4) Flaps

The four flaps 134*a*, 134*b*, 134*c*, 134*d* are positioned so as to correspond to the sides of the four-cornered shape of the decorative panel 136, and are provided to the discharge ports 137 so as to be capable of turning. The flaps 134*a*, 134*b*, 134*c*, 134*d* are capable of varying the vertical airflow directions of the conditioned air blown out into the room from the discharge ports 137. Specifically, the flaps 134*a*, 134*b*, 134*c*, 134*d* are long, thin plate-shaped members extending along the sides of the four-cornered shapes of the discharge ports 137. Both longitudinal ends of each of the flaps 134*a*, 134*b*, 134*c*, 134*d* are supported on the decorative panel 136 by a pair of support parts 139*a*, 139*b* disposed so as to close off part of each discharge port 137, the ends being supported so as to be capable of turning about their longitudinal axes. Furthermore, the flaps 134*a*, 134*b*, 134*c*, 134*d* are driven by drive motors 138*a*, 138*b*, 138*c*, 138*d* provided to the support parts 139*a*, 139*b*. The flaps 134*a*, 134*b*, 134*c*, 134*d* are thereby capable of individually changing their vertical airflow direction angles, and the flaps can perform a swing action of turning back and forth vertically relative to the discharge ports 137.

Figure 20:
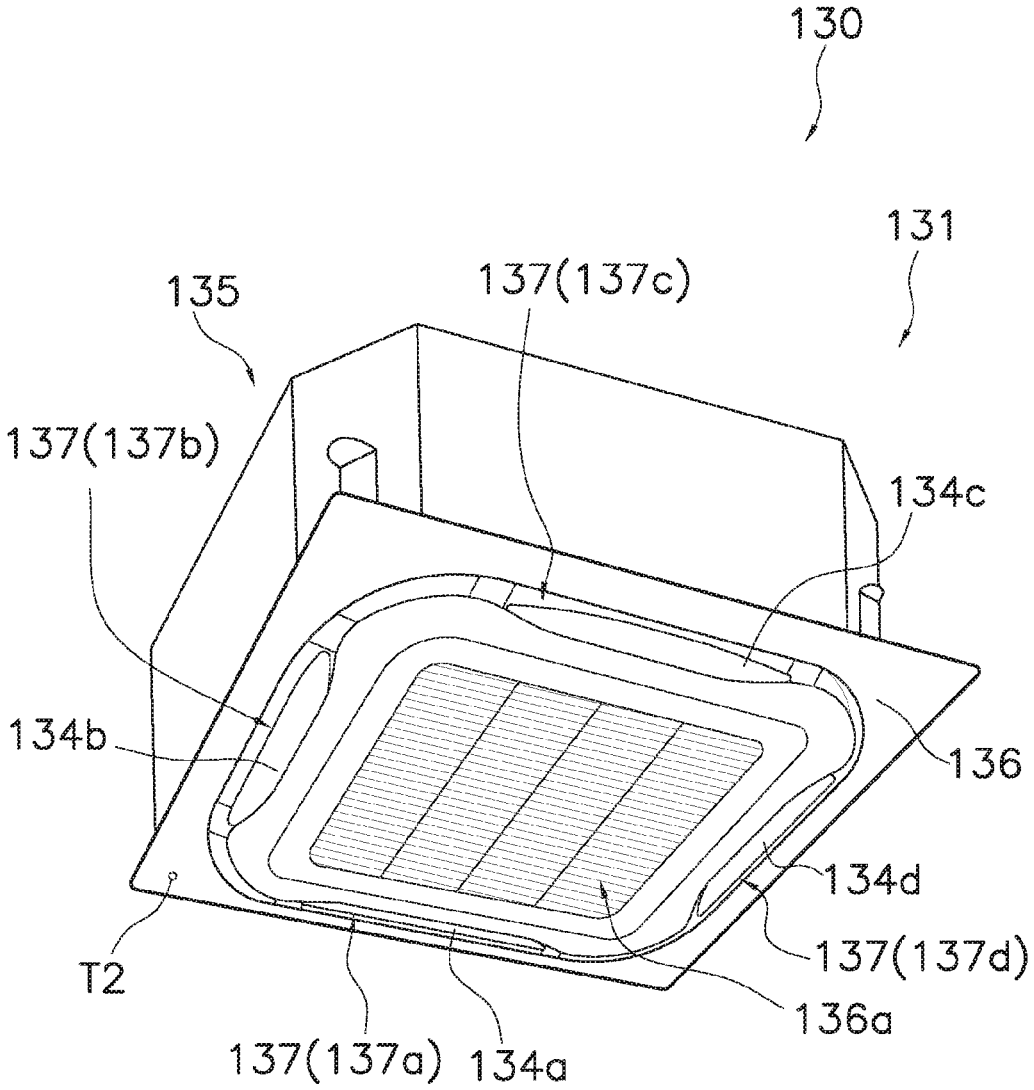
FIG. 20 is an external perspective view of an indoor unit.
Figure 21:
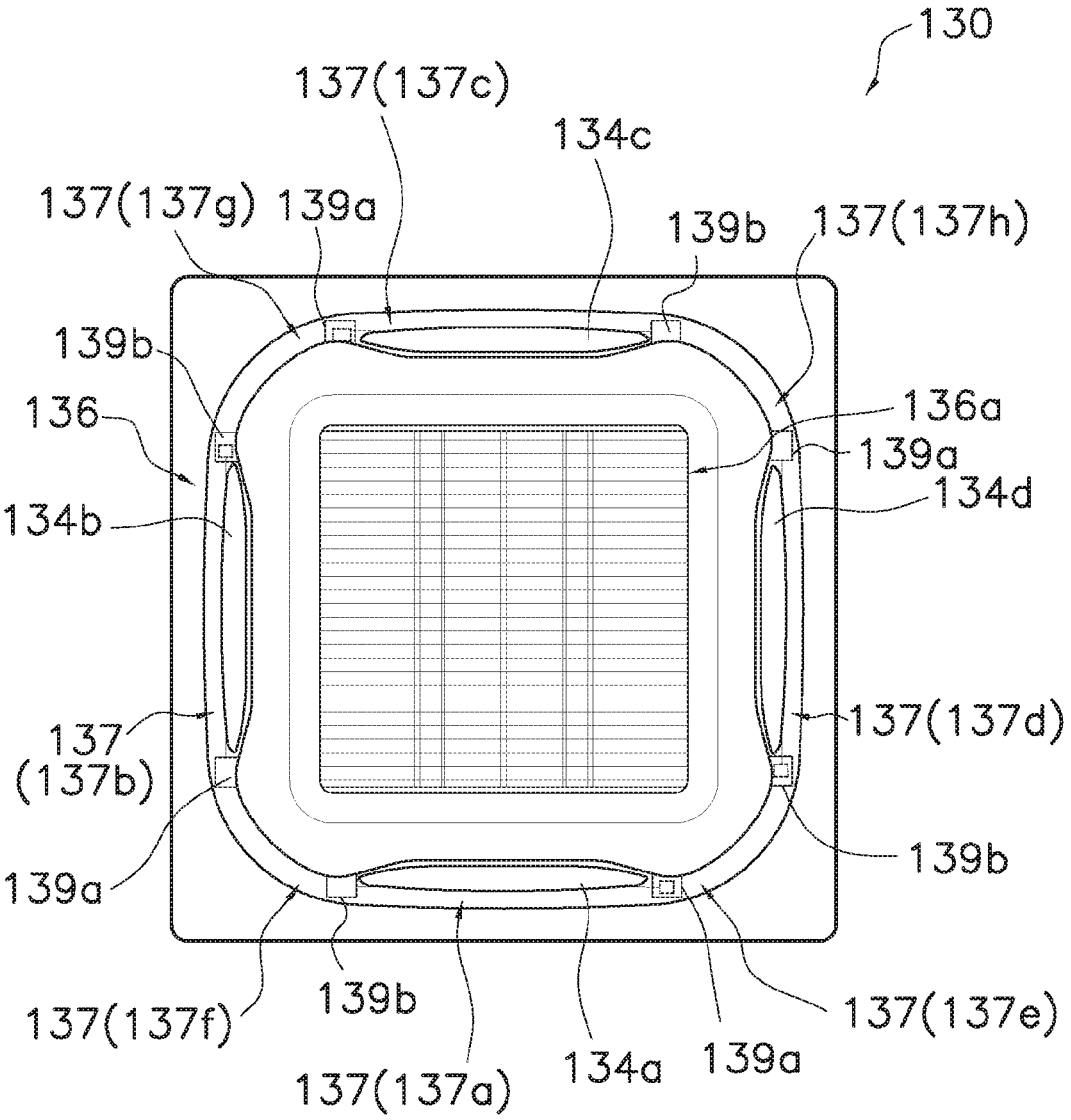
FIG. 21 is a plan view of the indoor unit as seen from the inside.

The support parts 139*a*, 139*b* divide up the discharge ports 137 into a discharge port 137*a*, a discharge port 137*b*, a discharge port 137*c*, and a discharge port 137*d* corresponding to the sides of the four-cornered shape of the decorative panel 136; and a discharge port 137*e*, a discharge port 137*f*, a discharge port 137*g*, and a discharge port 137*h* corresponding corners the four-cornered shape of the decorative panel 136. In the present embodiment, the flap 134*a* is disposed so as to cover the discharge port 137*a*, the flap 134*b* is disposed so as to cover the discharge port 137*b*, the flap 134*c* is disposed so as to cover the discharge port 137*c*, and the flap 134*d* is disposed so as to cover the discharge port 137*d*, as shown in FIGS. 20 and 21.

(2-5) Intake Temperature Sensor

Figure 22:
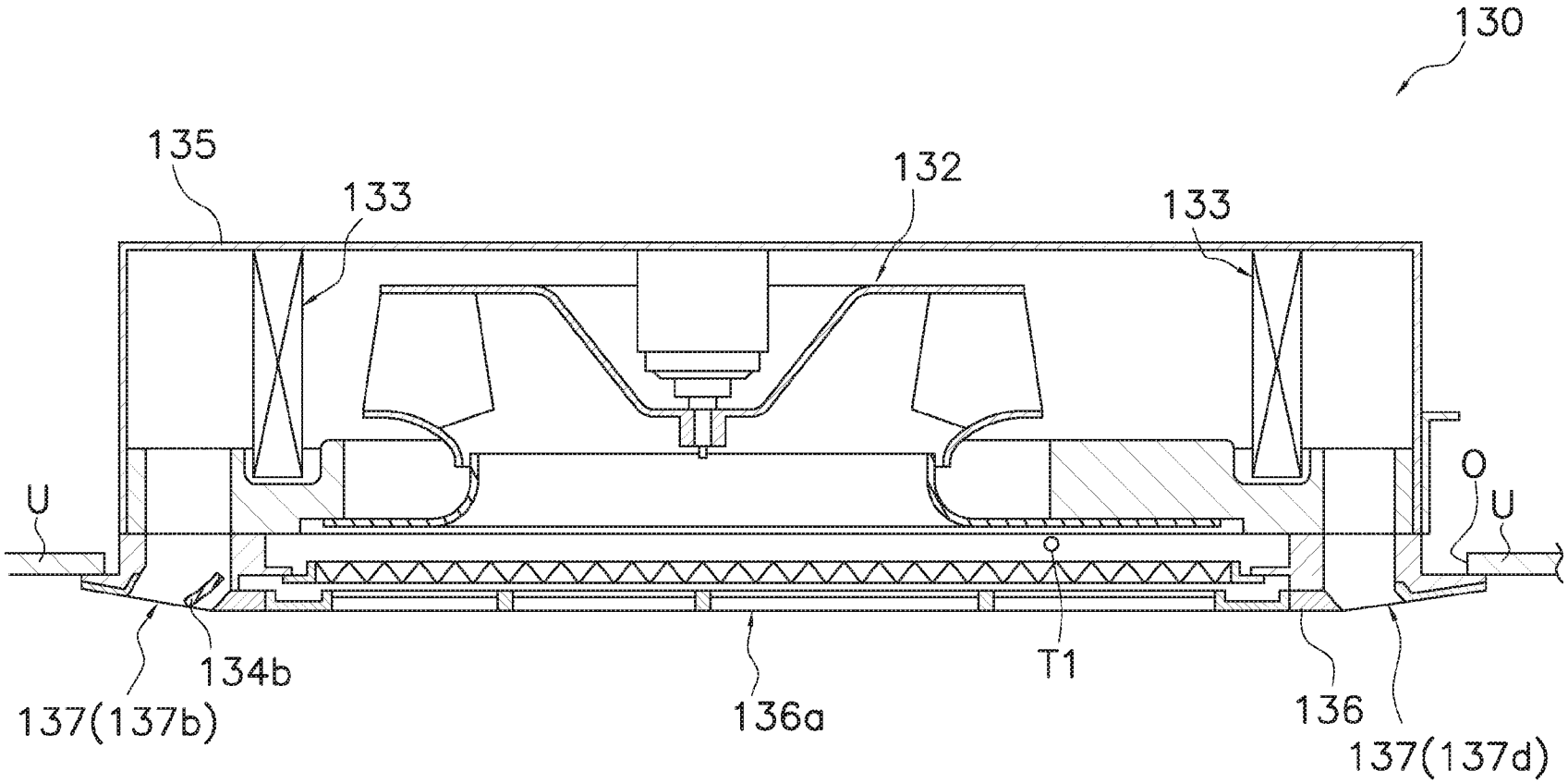
FIG. 22 is a schematic longitudinal cross-sectional view of the indoor unit.

The intake temperature sensor T1 is a temperature sensor for detecting the intake air temperature (hereinbelow referred to as the intake temperature Tr), which is the temperature of indoor air drawn into the casing main body 135 through the intake port 136*a*. The intake temperature sensor T1 is provided in the intake port 136*a* as shown in FIG. 22. The intake temperature sensor T1 also sends the detected intake temperature Tr to a control unit 160 described hereinafter.

(2-6) Floor Temperature Sensor

The floor temperature sensor T2 is an infrared sensor for detecting the temperature of the floor surface (hereinbelow referred to as the floor temperature Tf) in the room. The floor temperature sensor T2 is disposed in the bottom of the decorative panel 136. The floor temperature sensor T2 also detects the temperature of the floor surface in the room through infrared radiation energy radiated from a physical object. The floor temperature sensor T2 sends the detected floor temperature Tf to the control unit 160 described hereinafter.

(2-7) Remote Controller

The remote controller 180 is a device for the user to remotely operate the air conditioning apparatus 110. The remote controller 180 sends various commands issued by the user for the air conditioning apparatus 110 to the control unit 160 described hereinafter. The remote controller 180 is provided with operation switches such as an operation start/stop switch 184, an airflow direction adjustment switch 181, an airflow quantity adjustment switch 182, and a manual/automatic selection switch 183 (see FIG. 24).

The operation start/stop switch 184 is a switch operated when the user issues a command to start or stop the operation of the air conditioning apparatus 110. By operating the operation start/stop switch 184, the user can start or stop the various operations of the air conditioning apparatus 110, such as the air-cooling operation or the air-warming operation.

The airflow direction adjustment switch 181 is a switch operated when the user issues an airflow direction setting command. By operating the airflow direction adjustment switch 181, the user can adjust the airflow directions of the air blown out from the discharge ports 137*a*, 137*b*, 137*c*, 137*d* to the desired airflow directions. Specifically, due to the user pressing the airflow direction adjustment switch 181, the flaps 134*a*, 134*b*, 134*c*, 134*d* are driven so that either the airflow directions are fixed in the airflow direction P0 or the airflow direction P1 shown in FIG. 23, or the airflow directions are automatically varied.

The airflow quantity adjustment switch 182 is a switch operated when the user issues an airflow quantity setting command. By operating the airflow quantity adjustment switch 182, the user can adjust the airflow quantity of air blown out from the discharge ports 137 to the desired airflow quantity. Specifically, due to the user pressing the airflow quantity adjustment switch 182, the airflow quantity generated by the indoor fan 132 is switched among a first airflow quantity H, a second airflow quantity M, and a third airflow quantity L, described hereinafter.

The manual/automatic selection switch 183 is a switch operated when the user issues a mode setting command during the air-warming operation. By operating the manual/automatic selection switch 183, the user can set the mode to a manual control mode or an automatic control mode. In the case that the mode is set to the manual control mode, the various devices of the air conditioning apparatus 110 are controlled so as to achieve a set temperature Trs, the set airflow quantity, and the set airflow direction which are set by the user. In the case that the mode is set to the automatic control mode, when a deviation occurs in the temperature distribution in the room, i.e., when there is a temperature difference between the top and bottom of the room (hereinbelow referred to as a state of temperature nonuniformity), the various devices of the air conditioning apparatus 110 are controlled so that the state of temperature nonuniformity is automatically resolved. Even in the case that the mode is set to the automatic control mode, when the room interior is not in a state of temperature nonuniformity, the various devices of the air conditioning apparatus 110 are controlled so as to achieve the set temperature Trs, the set airflow quantity, and the set airflow direction set by the user.

(3) Control Unit

Figure 24:
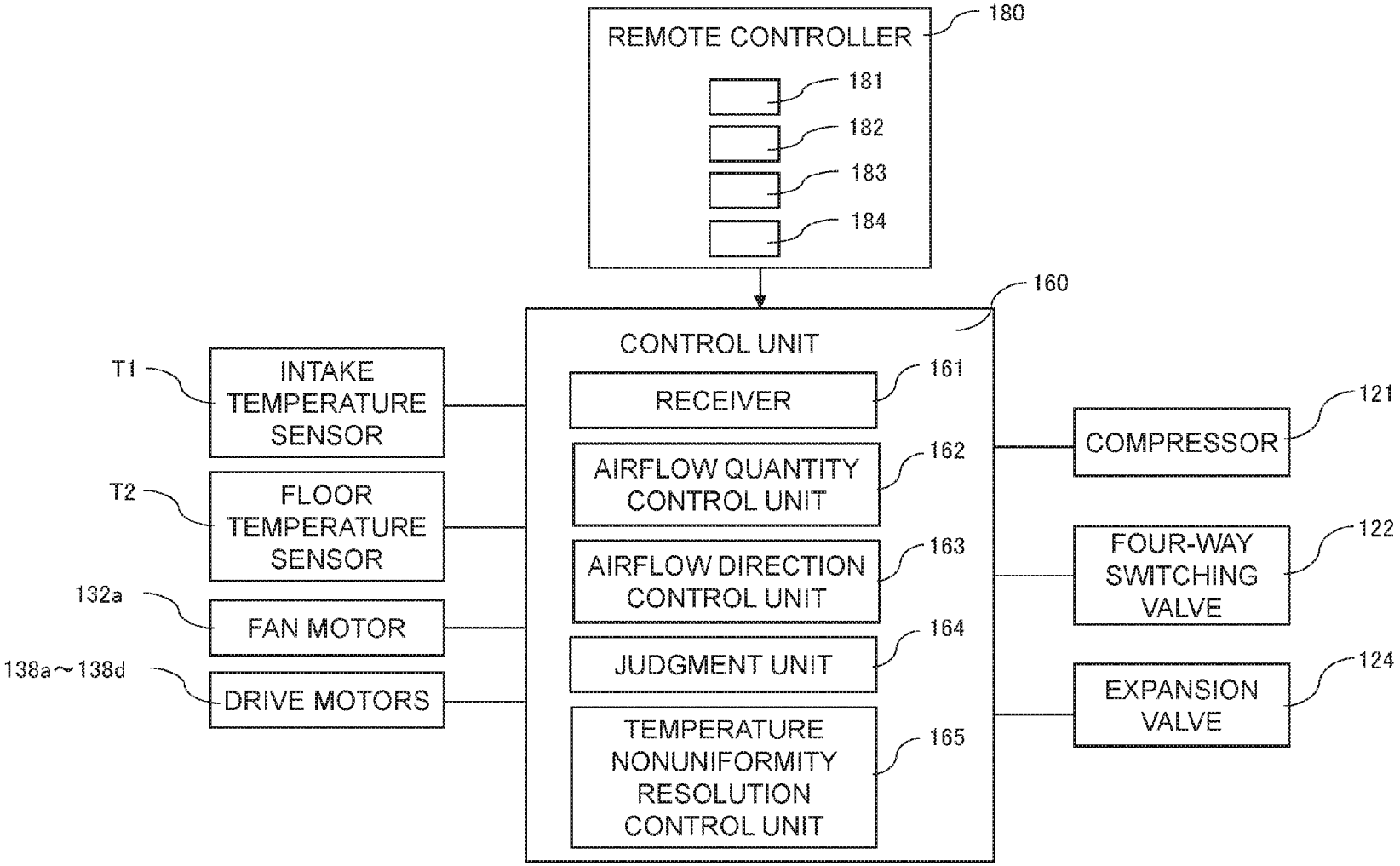
FIG. 24 is a control block diagram of the controller provided to the air conditioning apparatus according to the second embodiment of the present invention.

The control unit 160 is a microcomputer comprising a CPU and memory, and the control unit controls the actions of the various devices of the indoor unit 130 and the outdoor unit 120. Specifically, the control unit 160 is electrically connected with various devices such as the floor temperature sensor T2, the intake temperature sensor T1, the fan motor 132*a*, the drive motors 138*a*, 138*b*, 138*c*, 138*d*, the compressor 121, the four-way switching valve 122, and the expansion valve 124, as shown in FIG. 24. The control unit 160 performs drive control on the compressor 121 and the other various devices on the basis of the detection results of the intake temperature sensor T1 and the floor temperature sensor T2, and the various commands issued by the user via the remote controller 180.

When causing the air conditioning apparatus 110 to perform the air-warming operation, the control unit 160 switches the state of the four-way switching valve 122 so that the outdoor heat exchanger 123 functions as a refrigerant evaporator and the indoor heat exchanger 133 functions as a refrigerant heat radiator, and drives the compressor 121. In the air-warming operation, the control unit 160 controls the various devices so that the intake temperature Tr reaches the set temperature Trs. Specifically, when the intake temperature Tr is lower than the set temperature Trs in the air-warming operation, the compressor 121 is driven, whereby the above-described operation control is performed for circulating the refrigerant in the refrigerant circuit (the state in which this operation control is performed is hereinbelow referred to as the air-warming thermo-on state). When the intake temperature Tr has reached the set temperature Trs, control is performed in which the compressor 121 is stopped so that refrigerant is not circulated in the refrigerant circuit, and the rotation of the indoor fan 132 is stopped so that air is not blown out of the discharge ports 137*a*, 137*b*, 137*c*, 137*d* (the state in which this control is performed is hereinbelow referred to as the air-warming thermo-off state).

Furthermore, the control unit 160 comprises a receiver 161, an airflow quantity control unit 162, and an airflow direction control unit 163. The receiver 161 receives various commands sent from the remote controller 180. Specifically, the receiver 161 is capable of receiving commands for starting for the air-cooling operation and air-warming operation issued by the user via the remote controller 180, and of receiving airflow quantity setting commands, airflow direction setting commands, and the like. The receiver 161 also sends signals based on various commands issued from the user to a temperature nonuniformity resolution control unit 165, described hereinafter.

When the air conditioning apparatus 110 performs the air-warming operation or the air-cooling operation, the airflow quantity control unit 162 controls the rotational speed of the fan motor 132*a* on the basis of an airflow quantity setting command sent from the remote controller 180 and of the detection results of the intake temperature sensor T1 and floor temperature sensor T2. The airflow quantity control unit 162 can vary the airflow quantity of the indoor fan 132 by controlling the rotational speed of the fan motor 132*a*. Due to the rotational speed of the fan motor 132*a* being varied, the airflow quantity of the indoor fan 132 is varied among a first airflow quantity H for which the rotational speed is highest, a moderate second airflow quantity M for which the rotational speed is less than the first airflow quantity H, and a third airflow quantity L for which the rotational speed is even less than the second airflow quantity M.

When the air conditioning apparatus 110 performs the air-warming operation or the air-cooling operation, the airflow direction control unit 163 controls the drive motors 138*a*, 138*b*, 138*c*, 138*d* on the basis of an airflow direction setting command sent from the remote controller 180 and of the detection results of the intake temperature sensor T1 and floor temperature sensor T2. The airflow direction control unit 163 can vary the orientations and actions of the flaps 134*a*, 134*b*, 134*c*, 134*d* by controlling the drive motors 138*a*, 138*b*, 138*c*, 138*d*. Due to the orientations of the flaps 134*a*, 134*b*, 134*c*, 134*d* being varied, the airflow directions of the air blown out from the discharge ports 137*a*, 137*b*, 137*c*, 137*d* are varied.

Figure 23:
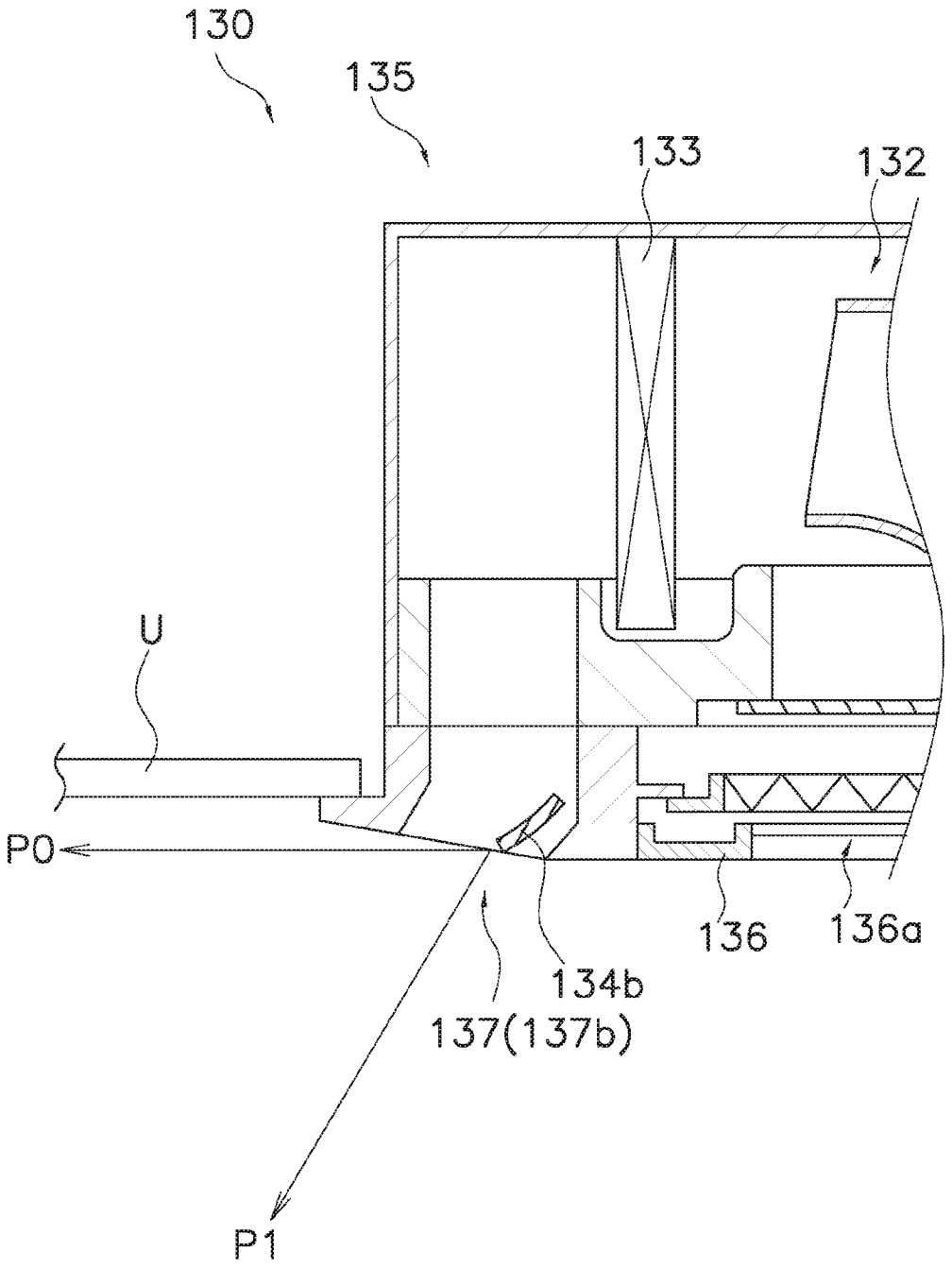
FIG. 23 is a drawing showing the variable range of the flaps.

The airflow directions include the airflow direction P0 in which air is blown out in a substantially horizontal direction, and the airflow direction P1 which is more downward blowing than the airflow direction P0, as shown in FIG. 23. Furthermore, the actions of the flaps 134*a*, 134*b*, 134*c*, 134*d* include a stationary action and a swing action. The stationary action is an action in which the orientations of the flaps 134*a*, 134*b*, 134*c*, 134*d* are maintained due to the drive motors 138*a*, 138*b*, 138*c*, 138*d* being controlled. The swing action is an action in which the orientations of the flaps 134*a*, 134*b*, 134*c*, 134*d* are repeatedly varied up and down within a variable range (between the airflow direction P0 and the airflow direction P1) due to the drive motors 138*a*, 138*b*, 138*c*, 138*d* being driven. The airflow direction control unit 163 can control the airflow directions and actions individually relative to the drive motors 138*a*, 138*b*, 138*c*, 138*d*, but in the present embodiment, the drive motors 138*a*, 138*b*, 138*c*, 138*d* are controlled so that the flaps 134*a*, 134*b*, 134*c*, 134*d* are driven synchronously.

When the air conditioning apparatus 110 is not performing the air-warming operation, the air-cooling operation, or any of the other various operations, the drive motors 138*a*, 138*b*, 138*c*, 138*d* are controlled so that the flaps 134*a*, 134*b*, 134*c*, 134*d* assume the orientations of closing up the discharge ports 137*a*, 137*b*, 137*c*, 137*d*. Furthermore, when the air conditioning apparatus 110 is performing the air-warming operation, the air-cooling operation, or any of the other various operations, the drive motors 138*a*, 138*b*, 138*c*, 138*d* are controlled so that the flaps 134*a*, 134*b*, 134*c*, 134*d* assume the orientations of opening up the discharge ports 137*a*, 137*b*, 137*c*, 137*d*. For the sake of the convenience in the description hereinbelow, the term "downward blowing orientation" is used to refer to the orientations assumed by the flaps 134*a*, 134*b*, 134*c*, 134*d* so that the airflow direction is the airflow direction P1.

Furthermore, the control unit 160 comprises a judgment unit 164 and a temperature nonuniformity resolution control unit 165. When the air conditioning apparatus 110 is operating, the judgment unit 164 judges whether or not there are deviations in the indoor temperature distribution. Specifically, the judgment unit 164 judges whether or not the room interior is in a state of temperature nonuniformity on the basis of the intake temperature Tr sent from the intake temperature sensor T1 and the floor temperature Tf sent from the floor temperature sensor T2. More specifically, the judgment unit 164 judges that there is a state of temperature nonuniformity when the difference between the intake temperature Tr and the floor temperature Tf is equal to or greater than a predetermined temperature (e.g., 6° C.). The judgment unit 164 also judges that there is not a state of temperature nonuniformity when the difference between the intake temperature Tr and the floor temperature Tf is less than a predetermined temperature (e.g., 6° C.).

The temperature nonuniformity resolution control unit 165 executes temperature nonuniformity resolution control when the mode is set to automatic control mode and the air-warming operation is performed in the air conditioning apparatus 110.

The temperature nonuniformity resolution control unit 165 starts the temperature nonuniformity resolution control either when a signal based on a swing action start command from among the airflow direction setting commands (hereinbelow referred to as a swing action command signal) is sent from the receiver 161, or when the judgment unit 164 has judged there to be a state of temperature nonuniformity. During temperature nonuniformity resolution control, the temperature nonuniformity resolution control unit 165 first sends a control signal to the airflow direction control unit 163 and the airflow quantity control unit 162 so that the flaps 134*a*, 134*b*, 134*c*, 134*d* start the swing action and the airflow quantity of the indoor fan 132 reaches the first airflow quantity H. Next, when an execution continuous time duration (hereinbelow referred to as the optimal time duration) of the swing action, obtained experimentally in advance, elapses after temperature nonuniformity resolution control has begun to be executed, the temperature nonuniformity resolution control unit 165 sends a control signal to the airflow direction control unit 163 so that the flaps 134*a*, 134*b*, 134*c*, 134*d* assume the downward blowing orientation and perform the stationary action. When the state is determined to have switched from air-warming thermo-on to air-warming thermo-off after temperature nonuniformity resolution control has begun to be executed, the temperature nonuniformity resolution control unit 165 ends temperature nonuniformity resolution control by sending a control signal to the airflow quantity control unit 162 so that the airflow quantity of the indoor fan 132 returns from the first airflow quantity H to a set airflow quantity that has been set by the user. For the sake of the convenience in the description hereinbelow, the state of the flaps 134*a*, 134*b*, 134*c*, 134*d* performing the swing action is referred to as the swing state, and the state of the flaps 134*a*, 134*b*, 134*c*, 134*d* assuming the downward blowing orientation and performing the stationary action is referred to as the downward blowing stationary state. In the present embodiment, the optimal time duration is 13 minutes and 30 seconds.

Figure 25:
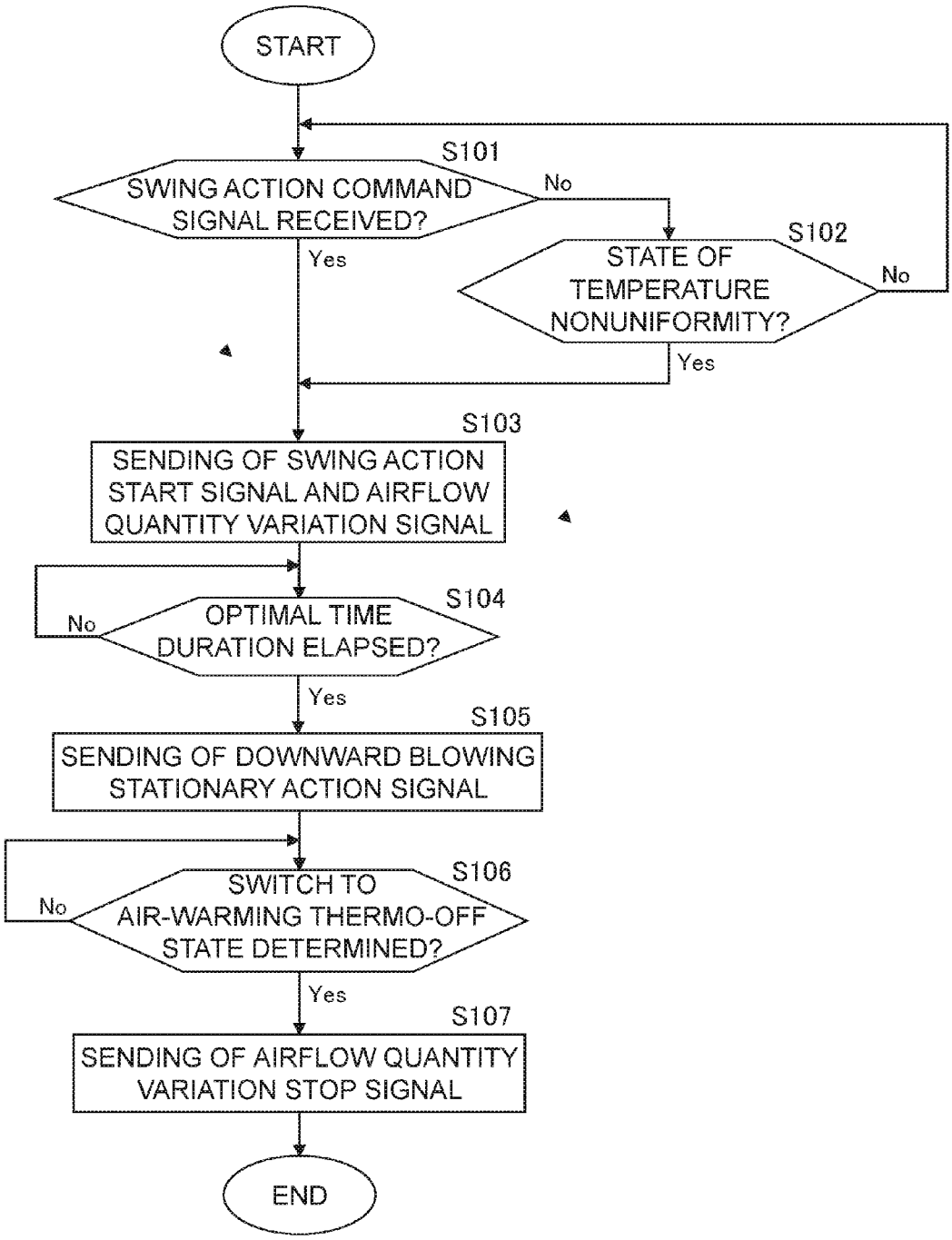
FIG. 25 is a flowchart showing the flow of the control action of the temperature nonuniformity resolution control unit in the air conditioning apparatus according to the second embodiment of the present invention.

(4) Control Action by Temperature Nonuniformity Resolution Control Unit During Air-Warming Operation Next, FIG. 25 is used to describe the control action by the temperature nonuniformity resolution control unit 165. As described above, the temperature nonuniformity resolution control unit 165 executes temperature nonuniformity resolution control only in cases in which the air-warming operation is in effect and automatic control mode has been set by the user. Specifically, temperature nonuniformity resolution control by the temperature nonuniformity resolution control unit 165 is not executed when manual control mode has been set by the user, whether the air-cooling operation or the air-warming operation be in effect.

The temperature nonuniformity resolution control unit 165 starts temperature nonuniformity resolution control either when a swing action command signal sent from the receiver 161 has been received (step S101), or when the judgment unit 164 has judged there to be a state of temperature nonuniformity (step S102). Specifically, the temperature nonuniformity resolution control unit 165 receives a swing action command signal sent from the receiver 161 which has received a swing action start command issued by the user who has felt temperature nonuniformity in the room, whereby the temperature nonuniformity resolution control unit 165 starts temperature nonuniformity resolution control. Even if a swing action command signal is not sent from the receiver 161, the temperature nonuniformity resolution control unit 165 starts temperature nonuniformity resolution control when the judgment unit 164 has judged there to be a state of temperature nonuniformity.

During temperature nonuniformity resolution control, the temperature nonuniformity resolution control unit 165 sends a swing action start signal to the airflow direction control unit 163 and sends an airflow quantity variation signal to the airflow quantity control unit 162 (step S103). Having been sent a swing action start signal from the temperature nonuniformity resolution control unit 165, the airflow direction control unit 163 controls the drive motors 138*a*, 138*b*, 138*c*, 138*d* so that the flaps 134*a*, 134*b*, 134*c*, 134*d* go into the swing state. Having been sent an airflow quantity variation signal from the temperature nonuniformity resolution control unit 165, the airflow quantity control unit 162 controls the rotational speed of the fan motor 132*a* so that the airflow quantity of the indoor fan 132 is varied from the set airflow quantity set by the user to the first airflow quantity H.

When the optimal time duration has elapsed following the sending of the swing action start signal and the airflow quantity variation signal in step S103 (step S104), the temperature nonuniformity resolution control unit 165 sends a downward blowing stationary action signal to the airflow direction control unit 163 (step S105). Having been sent a downward blowing stationary action signal from the temperature nonuniformity resolution control unit 165, the airflow direction control unit 163 controls the drive motors 138*a*, 138*b*, 138*c*, 138*d* so that the flaps 134*a*, 134*b*, 134*c*, 134*d* go into the downward blowing stationary state. The state of the flaps 134*a*, 134*b*, 134*c*, 134*d* is thereby switched from the swing state in which the airflow direction is varied automatically to the downward blowing stationary state in which the airflow direction is maintained at the airflow direction P1. The temperature nonuniformity resolution control unit 165 does not send a downward blowing stationary action signal to the airflow direction control unit 163 until the optimal time duration has elapsed following the sending of the swing action start signal and the airflow quantity variation signal.

After the downward blowing stationary action signal has been sent in step S105 when the state is determined to have switched from the air-warming thermo-on state to the air-warming thermo-off state (step S106), the temperature nonuniformity resolution control unit 165 sends an airflow quantity variation stop signal to the airflow quantity control unit 162 (step S107). Having been sent an airflow quantity variation stop signal from the temperature nonuniformity resolution control unit 165, the airflow quantity control unit 162 controls the fan motor 132*a* and thereby varies the airflow quantity of the indoor fan 132 from the first airflow quantity H to the set airflow quantity, which is the airflow quantity prior to temperature nonuniformity resolution control being executed. Temperature nonuniformity resolution control by the temperature nonuniformity resolution control unit 165 thereby ends. After the downward blowing stationary action signal is sent in step S105, the temperature nonuniformity resolution control unit 165 does not sent an airflow quantity variation stop signal to the airflow quantity control unit 162 until it has been determined that the state has switched from the air-warming thermo-on state to the air-warming thermo-off state.

Figure 27:
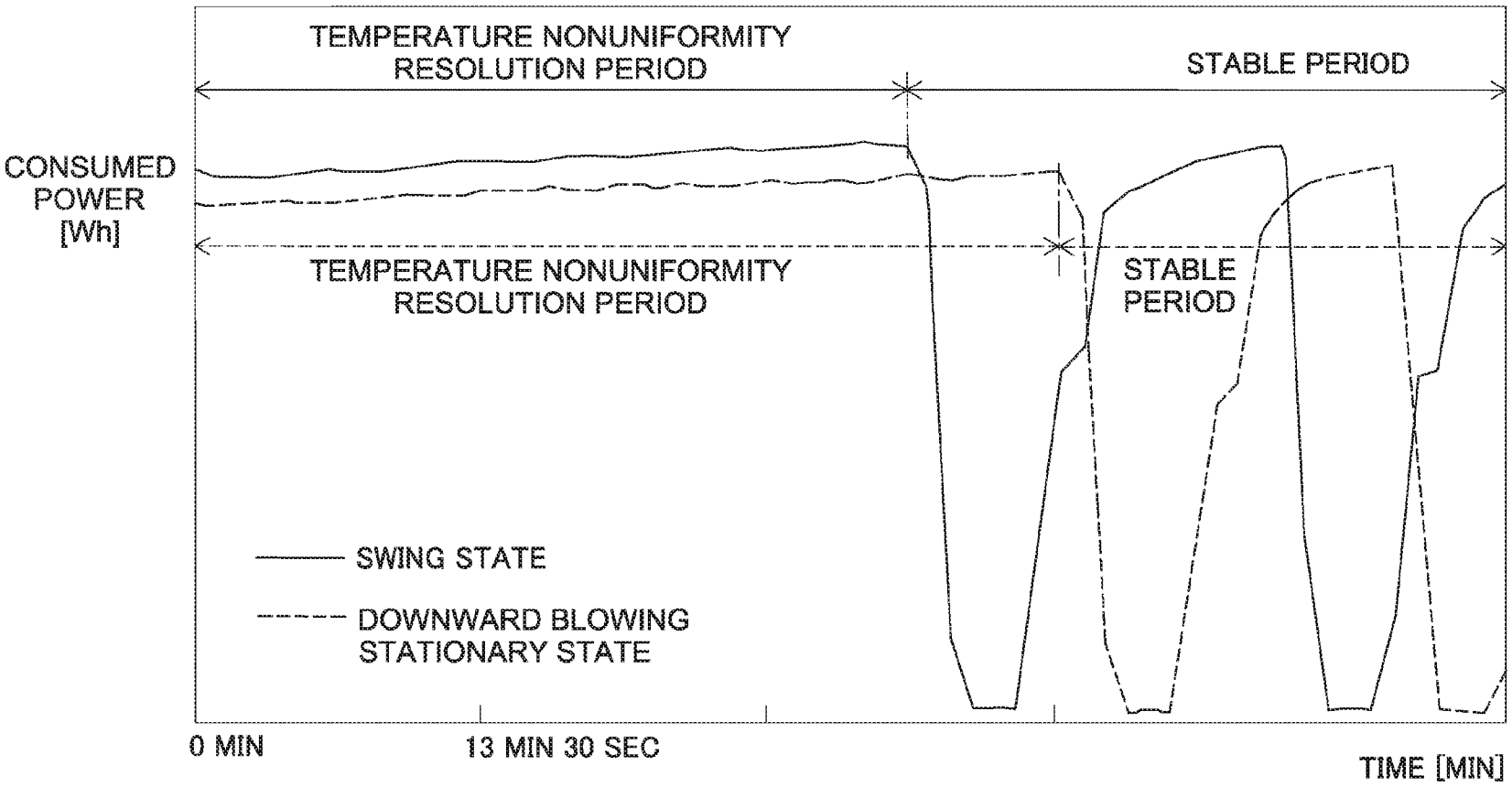
FIG. 27 is a graph showing the transition in the power consumption both in a case in which the air conditioning apparatus performs the air-warming operation with the indoor unit installed in the test room in the downward blowing stationary state, and a case in which the air conditioning apparatus performs the air-warming operation with the indoor unit installed in the test room in the swing state.

FIGS. 26, 27, and 28, which show the results of evaluation testing, are used to describe the reasons that control is performed during temperature nonuniformity resolution control so that the state of the flaps 134*a*, 134*b*, 134*c*, 134*d* is switched sequentially to the swing state and the downward blowing stationary state.

FIG. 26 shows the power consumed by the entire air conditioning apparatus 110 from the start of the operation to resolve the state of temperature nonuniformity until the first air-warming thermo-off state (hereinbelow referred to as the temperature nonuniformity resolution period), either when the air conditioning apparatus 110 performs the air-warming operation with the flaps 134*a*, 134*b*, 134*c*, 134*d* of the indoor unit 130 installed in a test room in the downward blowing stationary state, or when the air conditioning apparatus 110 performs the air-warming operation with the flaps 134*a*, 134*b*, 134*c*, 134*d* of the indoor unit 130 installed in a test room in the swing state; and also shows the power consumed by the entire air conditioning apparatus 110 until the average room temperature (the average value of a plurality of temperature detection sensors disposed in a grid in the space in the test room, i.e., the average value of temperatures measured in all locations in the test room) reaches the set temperature Trs.

FIG. 27 shows the transition of consumed power after the start of the operation to resolve the state of temperature nonuniformity, either when the air conditioning apparatus 110 performs the air-warming operation with the flaps 134*a*, 134*b*, 134*c*, 134*d* of the indoor unit 130 installed in a test room in the downward blowing stationary state, or when the air conditioning apparatus 110 performs the air-warming operation with the flaps 134*a*, 134*b*, 134*c*, 134*d* of the indoor unit 130 installed in a test room in the swing state.

FIG. 28 shows the power consumed by the entire air conditioning apparatus 110 during the temperature nonuniformity resolution period, either when the air conditioning apparatus 110 performs the air-warming operation with the flaps 134*a*, 134*b*, 134*c*, 134*d* of the indoor unit 130 installed in a test room in the swing state, or when the air conditioning apparatus 110 performs the air-warming operation with the flaps 134*a*, 134*b*, 134*c*, 134*d* of the indoor unit 130 installed in a test room in the swing state until the optimal time duration elapses and in the downward blowing stationary state after the optimal time duration has elapsed.

FIGS. 26, 27, and 28 show the results of evaluation testing under the air-warming conditions and in an environment in which temperature nonuniformity is imposed so that the temperature difference between the top and bottom of the test room is 6° C. or greater. FIGS. 26, 27, and 28 also show the results of setting the set temperature Trs to 20° C., setting the set airflow quantity to the first airflow quantity H, and synchronously driving all of the flaps 134*a*, 134*b*, 134*c*, 134*d*. In conventional practice, the Predicted Percentage of Dissatisfied (PPD: indicates what percent of people in the room feel dissatisfied with the environment) is known to exceed 50% when the temperature difference between the top and bottom of the room is 6° C. or greater. The set temperature of 20° C. is based on JIS standards for the air-warming operation, and is the recommended temperature of "Warm Biz" (a 2005 winter campaign to reduce electric consumption by limiting use of indoor heating). Thereby, it is fair to say that the evaluation testing is universal and useful.

When the power consumed during the temperature nonuniformity resolution period was compared between the case of the swing state and the case of the downward blowing stationary state, the power consumed during the temperature nonuniformity resolution period in the swing state was less by 10% than in the downward blowing stationary state, as shown in FIG. 26. The consumed power needed for the average room temperature to reach the set temperature Trs following the start of the operation to resolve the state of temperature nonuniformity in the test room was approximately 50% less in the swing state than in the downward blowing stationary state.

When the flaps 134*a*, 134*b*, 134*c*, 134*d* are in the swing state, the power consumed during the temperature nonuniformity resolution period is approximately 5% greater than when the flaps 134*a*, 134*b*, 134*c*, 134*d* are in the downward blowing stationary state, and the power consumed during the stable period after the temperature nonuniformity resolution period is approximately 10% greater (see FIG. 27).

Furthermore, as a result of comparing the temperature distribution in the test room between the swing state and the downward blowing stationary state, the temperature difference between a first reference point (a position at a distance of 4 m from the main body and a height of 30 cm from the floor) and a second reference point (a position at a height of 60 cm from the floor along a line passing vertically through the first reference point) was a maximum of 5° C. in the downward blowing stationary state, and was about 2° C. in the swing state. A uniform temperature distribution was also successfully achieved in a shorter amount of time (about half the time) in the swing state than in the downward blowing stationary state. Therefore, when the flaps 134*a*, 134*b*, 134*c*, 134*d* perform the swing action during the air-warming operation, temperature nonuniformity can be resolved in about half the time compared to when the flaps 134*a*, 134*b*, 134*c*, 134*d* assume the downward blowing orientation and perform the stationary action during the air-warming operation. Therefore, it was ascertained that when the flaps 134*a*, 134*b*, 134*c*, 134*d* perform the swing action during the air-warming operation, the temperature nonuniformity resolution effect is higher compared to when the flaps 134*a*, 134*b*, 134*c*, 134*d* assume the downward blowing orientation and perform the stationary action during the air-warming operation.

From these results, it was ascertained during the air-warming operation, due to the flaps 134*a*, 134*b*, 134*c*, 134*d* performing the swing action in the temperature nonuniformity resolution period and the flaps 134*a*, 134*b*, 134*c*, 134*d* assuming the downward blowing orientation and performing the stationary action in the stable period, the amount of time needed to resolve the state of temperature nonuniformity in the room is shorter and the consumed power is less, compared with cases in which the flaps 134*a*, 134*b*, 134*c*, 134*d* assume the downward blowing orientation and perform the stationary action continuously through the temperature nonuniformity resolution period and the stable period. Furthermore, it was ascertained during the air-warming operation, due to the flaps 134*a*, 134*b*, 134*c*, 134*d* performing the swing action in the temperature nonuniformity resolution period and the flaps 134*a*, 134*b*, 134*c*, 134*d* assuming the downward blowing orientation and performing the stationary action in the stable period, the power consumed in order to resolve the state of temperature nonuniformity in the room is less compared with cases in which the flaps 134*a*, 134*b*, 134*c*, 134*d* perform the swing action continuously through the temperature nonuniformity resolution period and the stable period (see FIG. 28).

In view of this, the inventors have obtained the knowledge that when the room interior is in a state of temperature nonuniformity, starting the swing action of the flaps 134*a*, 134*b*, 134*c*, 134*d*, then stopping the swing action after a predetermined time duration (the optimal time duration) has elapsed following the start of the swing action of the flaps 134*a*, 134*b*, 134*c*, 134*d*, and causing the flaps 134*a*, 134*b*, 134*c*, 134*d* to assume the downward blowing orientation and perform the stationary action constitute control for resolving temperature nonuniformity in the room and reducing the consumed power.

In the air conditioning apparatus 110 of the present embodiment, such knowledge is used to employ a control method for controlling the flaps 134*a*, 134*b*, 134*c*, 134*d* so that the state of the flaps 134*a*, 134*b*, 134*c*, 134*d* switches sequentially to the swing state and then to the downward blowing stationary state.

From the results of measuring the temperature distribution in the test room, it was ascertained that in the swing state, there is a point in time during the temperature nonuniformity resolution period in which the average room temperature reaches the set temperature Trs. This point in time comes during the evaluation testing, 13 minutes and 30 seconds after the flaps 134*a*, 134*b*, 134*c*, 134*d* start the swing action in order to resolve temperature nonuniformity. Therefore, the continuous time duration (optimal time duration) of executing the swing action that can resolve the temperature nonuniformity and reduce the consumed power is preferably around 13 minutes and 30 seconds after the flaps 134*a*, 134*b*, 134*c*, 134*d* start the swing action in order to resolve the temperature nonuniformity. When the optimal time duration is around 13 minutes and 30 seconds, it is a precondition needed to satisfy the condition that the capacity of the air conditioning apparatus 110 substantially match the air-conditioning load of the room in which the air conditioning apparatus 110 is installed (a state such that the capacity is not excessive or insufficient), and the condition that all the flaps 134*a*, 134*b*, 134*c*, 134*d* be driven synchronously.

The consumed power can thereby be reduced in comparison with an air conditioning apparatus 110 in which the flaps 134*a*, 134*b*, 134*c*, 134*d* continuously perform the swing action until the first air-warming thermo-off state after the start of the operation to resolve the state of temperature nonuniformity.

In the present embodiment, since the optimal time duration in temperature nonuniformity resolution control is 13 minutes and 30 seconds, temperature nonuniformity in the room can be resolved and the amount of power consumed in temperature nonuniformity resolution control can be reduced.

(5) Characteristics (5-1)

When the air-warming operation of the air conditioning apparatus 110 is performed, there is a risk of causing discomfort to the user in the room because of a state of temperature nonuniformity in which there is a temperature difference between the top and bottom of the room interior, due to warm air accumulating near the ceiling and cold air accumulating near the floor. The inventors have obtained the knowledge that to resolve the state of temperature nonuniformity in the room, it is effective for the flaps 134*a*, 134*b*, 134*c*, 134*d* to perform the swing action and stir up the air in the room, but in a case in which the flaps 134*a*, 134*b*, 134*c*, 134*d* perform the swing action and the air conditioning apparatus 110 is operated, the consumed power is greater compared with a case in which the flaps 134*a*, 134*b*, 134*c*. 134*d* assume the downward blowing orientation and perform the stationary action and the air conditioning apparatus 110 is operated.

In view of this, in the present embodiment, the swing action of the flaps 134*a*, 134*b*, 134*c*, 134*d* is stopped upon fulfilling of the condition (equivalent to the first condition) that the optimal time duration, obtained experimentally in advance, has elapsed following the start of executing temperature nonuniformity resolution control. Therefore, the swing action of the flaps 134*a*, 134*b*, 134*c*, 134*d*, which was started in order to resolve the state of temperature nonuniformity in the room, can be automatically stopped due to the optimal time duration elapsing even with no command from the user.

Temperature nonuniformity in the room can thereby be resolved, and the consumed power can be reduced.

(5-2)

In the present embodiment, the temperature nonuniformity resolution control unit 165 sends an airflow quantity variation signal to the airflow quantity control unit 162 during temperature nonuniformity resolution control so that the airflow quantity of the indoor fan 132 reaches the first airflow quantity H. Therefore, while temperature nonuniformity resolution control is being performed, the rotational speed of the fan motor 132*a* is controlled so that the airflow quantity of the indoor fan 132 reaches the first airflow quantity H which is the maximum airflow quantity of the indoor fan 132. Therefore, during temperature nonuniformity resolution control, for example, the temperature nonuniformity in the room can be resolved in a shorter amount of time than in cases in which the rotational speed of the fan motor 132*a* is controlled so that the airflow quantity of the indoor fan 132 reaches the third airflow quantity L which is less than the first airflow quantity H.

(5-3)

In the present embodiment, when the optimal time duration elapses following the start of execution of temperature nonuniformity resolution control, the temperature nonuniformity resolution control unit 165 sends a control signal to the airflow direction control unit 163 so that the flaps 134*a*, 134*b*, 134*c*, 134*d* assume the downward blowing orientation and perform the stationary action. Therefore, the state of the flaps 134*a*, 134*b*, 134*c*, 134*d* is switched from the swing state in which the airflow direction varies automatically to the downward blowing stationary state in which the airflow direction is maintained in the airflow direction P1. Therefore, during the air-warming operation, after the state of temperature nonuniformity in the room has been resolved, warm air can be impeded from accumulating in the top of the room because air is blown out in a downward direction from the discharge ports 137*a*, 137*b*, 137*c*, 137*d*.

In temperature nonuniformity resolution control, when the optimal time duration has elapsed following the start of the swing action of the flaps 134*a*, 134*b*, 134*c*, 134*d*, the swing action is stopped and the flaps 134*a*, 134*b*, 134*c*, 134*d* assume the downward blowing orientation and perform the stationary action, whereby the consumed power can be reduced compared with a case in which the flaps 134*a*, 134*b*, 134*c*, 134*d* continuously perform the swing action until the air-warming thermo-off state after the optimal time duration has elapsed.

(5-4)

In the present embodiment, the intake temperature sensor T1 for detecting the intake temperature Tr is disposed in proximity to the intake port 136*a*. The intake port 136*a* is formed in the decorative panel 136 installed in proximity to the ceiling. Therefore, the judgment unit 164 can judge whether or not the room interior is in a state of nonuniformity, on the basis of the temperature difference between the intake temperature Tr which is the temperature of the top of the indoor space and the floor temperature Tf which is the temperature of the bottom of the indoor space. Therefore, it is possible to more accurately judge whether or not there is a state of temperature nonuniformity, compared with an air conditioning apparatus in which whether or not the room interior is in a state of temperature nonuniformity is estimated from the temperature of the air in the top of the indoor space.

(6) Modifications (6-1) Modification 2A

In the present embodiment, all of the flaps 134*a*, 134*b*, 134*c*, 134*d* are driven synchronously in temperature nonuniformity resolution control, but instead of this, the flaps 134*a*, 134*b*, 134*c*, 134*d* may be driven individually.

When the flaps 134*a*, 134*b*, 134*c*, 134*d* are driven individually, in temperature nonuniformity resolution control, the flaps 134*a*, 134*b*, 134*c*, 134*d* may be driven so that flaps 134*a*, 134*b*, 134*c*, 134*d* positioned at opposite sides of each other perform the swing action synchronously, or the flaps 134*a*, 134*b*, 134*c*, 134*d* may be driven so that flaps 134*a*, 134*b*, 134*c*, 134*d* positioned at opposite angles of each other perform the swing action synchronously.

The inventors have obtained the following knowledge as a result of performing evaluation testing on the temperature nonuniformity resolution results in a case of performing the swing action with all of the flaps 134*a*, 134*b*, 134*c*, 134*d* driven synchronously (hereinbelow referred to as the all-synchronous swing action), a case of performing the swing action with flaps 134*a*, 134*b*, 134*c*, 134*d* positioned at opposite angles of each other driven synchronously (hereinbelow referred to as the opposite-angle swing action), and a case of performing the swing action with flaps 134*a*, 134*b*, 134*c*, 134*d* positioned at opposite sides of each other driven synchronously (hereinbelow referred to as the opposite-side swing action).

When the opposite-angle swing action or the opposite-side swing action is performed, it is clear that a uniform temperature distribution is achieved in a shorter amount of time than when the all-synchronous swing action is performed. When the power consumed in the temperature nonuniformity resolution period is compared between the all-synchronous swing action being performed and the opposite-angle swing action being performed, the consumed power was approximately 30% less when the opposite-angle swing action is performed than when the all-synchronous swing action is performed. When the power consumed in the temperature nonuniformity resolution period is compared between the all-synchronous swing action being performed and the opposite-side swing action being performed, the consumed power was approximately 40% less when the opposite-side swing action is performed than when the all-synchronous swing action is performed. Thereby, the knowledge was obtained that in the swing action during temperature nonuniformity resolution, synchronously driving flaps 134*a*, 134*b*, 134*c*, 134*d* positioned at opposite angles or opposite sides of each other has a greater effect of temperature nonuniformity resolution than driving all of the flaps 134*a*, 134*b*, 134*c*, 134*d* synchronously. In the test room where evaluation testing was performed, synchronously driving flaps 134*a*, 134*b*, 134*c*, 134*d* at opposite sides of each other had the highest temperature nonuniformity resolution effect, then driving opposite-side flaps, then driving all the flaps.

Therefore, when flaps 134*a*, 134*b*, 134*c*, 134*d* positioned at opposite angles or opposite sides from each other perform the swing action synchronously, a greater energy conservation effect can be expected than when all of the flaps 134*a*, 134*b*, 134*c*, 134*d* perform the swing action synchronously. Depending on the size or shape of the room in which the indoor unit 130 is installed, or on the positions of obstacles in the room where the indoor unit 130 is installed, an agitating effect of the indoor air can be expected for synchronously driving the flaps 134*a*, 134*b*, 134*c*, 134*d* in the sequence of the opposite-side flaps, the opposite-angle flaps, and all of the flaps.

(6-2) Modification 2B

In the embodiments described above, the judgment unit 164 judges whether or not the room interior is in a state of temperature nonuniformity by comparing the intake temperature Tr sent from the intake temperature sensor T1 and the floor temperature Tf sent from the floor temperature sensor T2.

Instead of this, the judgment unit 164 may estimate from the intake temperature Tr whether or not the room interior is in a state of temperature nonuniformity. For example, the judgment unit 164 may estimate whether or not the room interior is in a state of temperature nonuniformity from information pertaining to the difference between the intake temperature Tr and the outside air temperature, information pertaining to the operating time duration of the air conditioning apparatus 110 (e.g., immediately after startup, after a predetermined time duration elapses following stabilization, etc.), information combining the operation mode of the air conditioning apparatus 110 and the airflow direction and airflow quantity (e.g., information indicating that temperature nonuniformity occurs when the air-warming operation is performed for a predetermined time duration with a predetermined airflow quantity and a predetermined airflow direction), and other information. In this case, the floor temperature sensor T2 can be omitted from the configuration of the embodiments described above.

(6-3) Modification 2C

In the embodiments described above, the indoor unit 130 provided to the air conditioning apparatus 110 is a ceiling-embedded indoor unit, but no limitation is provided thereby;

the indoor unit may be a ceiling-hanging indoor unit installed with the casing hanging from the ceiling, or an indoor unit installed on a wall in the room.

Third Embodiment

Before the third embodiment of the present invention is described, first is a description of the knowledge of the inventors that was an important basis for the inventors in devising the present invention.

From the results of the evaluation testing described above, the inventors discovered that the swing action's executed continuous time duration (the optimal time duration) of 13 minutes and 30 seconds is substantially equivalent to a third of the time duration needed for the temperature nonuniformity resolution period in the downward blowing stationary state (see FIG. 27). Therefore, by focusing on this point, the inventors have obtained the knowledge that the swing action's executed continuous time duration corresponding to the room in which the indoor unit 130 is installed can be decided from the time duration needed for the temperature nonuniformity resolution period in the downward blowing stationary state.

The following is a description of an air conditioning apparatus according to the third embodiment of the present invention which the inventors completed based on the aforementioned knowledge. In the present embodiment, components other than the control unit 260 are the same as those of the second embodiment; therefore, only (3) the control unit 260 is described, and descriptions are omitted of (1) the outdoor unit 120 and (2) the indoor unit 130, which are components other than the control unit 260.

(3) Control Unit

Figure 29:
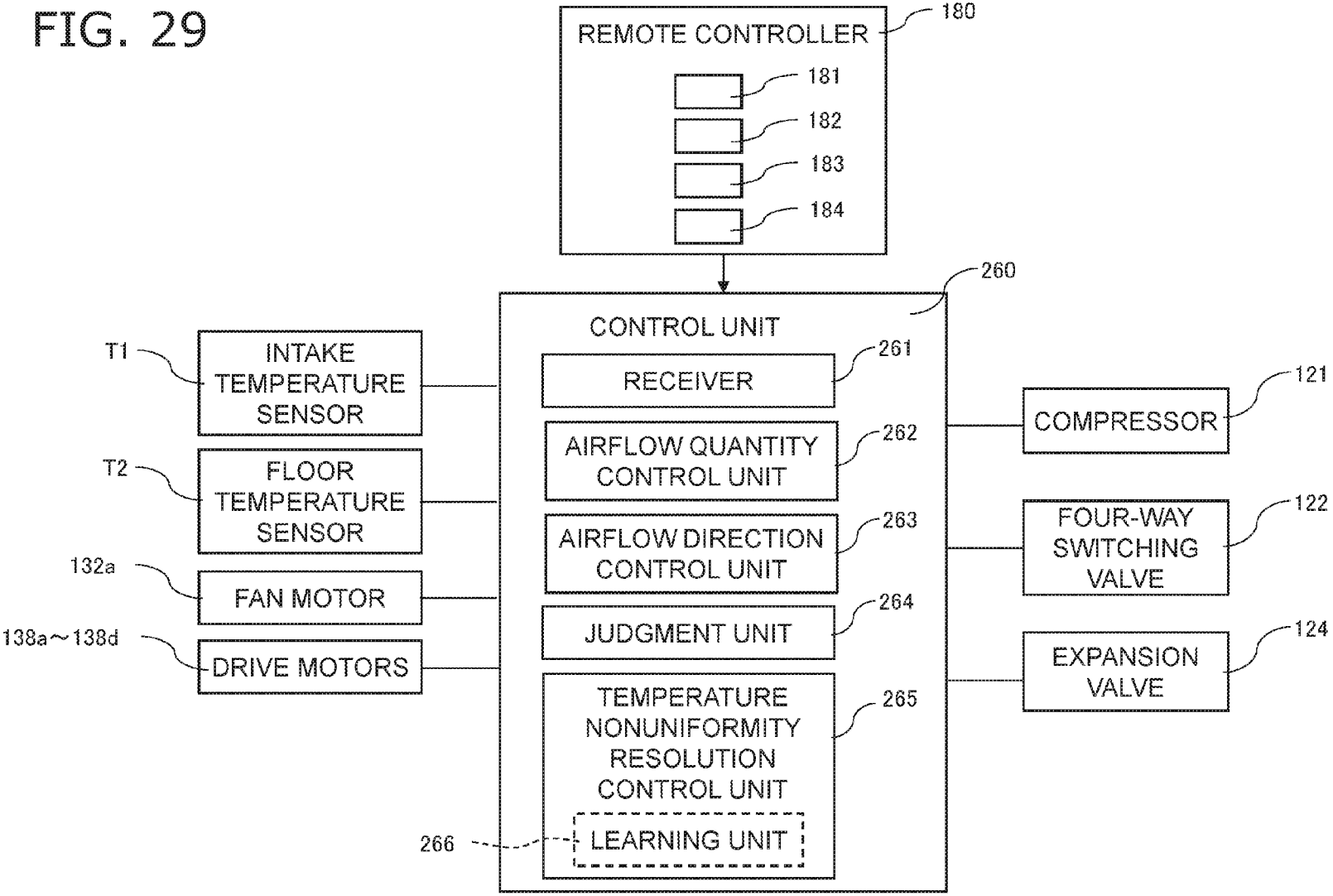
FIG. 29 is a control block diagram of the control unit provided to the air conditioning apparatus according to the third embodiment of the present invention.

The control unit 260, which is a microcomputer composed of a CPU and memory, controls the actions of the various devices of the indoor unit 130 and the outdoor unit 120. The control unit 260 comprises a receiver 261, an airflow quantity control unit 262, an airflow direction control unit 263, a judgment unit 264, and a temperature nonuniformity resolution control unit 265, as shown in FIG. 29. The configurations of the receiver 261, the airflow quantity control unit 262, the airflow direction control unit 263, and the judgment unit 264 are the same as those of the second embodiment and are therefore not described.

The temperature nonuniformity resolution control unit 265 executes temperature nonuniformity resolution control when automatic control mode is set and the air-warming operation is being performed in the air conditioning apparatus. The temperature nonuniformity resolution control unit 265 also has a learning unit 266 for deciding a learning operation time duration by learning past operation records.

The temperature nonuniformity resolution control unit 265 determines whether or not learning by the learning unit 266 is needed either when a swing action command signal is sent from the receiver 261, or when the judgment unit 264 judges that there is a state of temperature nonuniformity. The temperature nonuniformity resolution control unit 265 counts from the time the learning operation time duration is decided by the learning unit 266 and determines that the learning unit 266 needs to decide a learning operation time duration when the number of switches between the air-warming thermo-on state and the air-warming thermo-off state is a predetermined number (e.g., 30) or greater. In other words, the temperature nonuniformity resolution control unit 265 counts from the time the learning operation time duration is decided by the learning unit 266 and determines that the learning unit 266 does not need to decide a learning operation time duration when the number of switches between the thermo-on state and the thermo-off state is less than a predetermined number. When learning by the learning unit 266 is determined to not be necessary, temperature nonuniformity resolution control is started.

In temperature nonuniformity resolution control, the temperature nonuniformity resolution control unit 265 first sends control signals to the airflow direction control unit 263 and the airflow quantity control unit 262 so that the flaps 134*a*, 134*b*, 134*c*, 134*d* start the swing action and the airflow quantity of the indoor fan 132 reaches the first airflow quantity H. Next, when the learning operation time duration decided by the learning unit 266 has elapsed after temperature nonuniformity resolution control has started, the temperature nonuniformity resolution control unit 265 sends a control signal to the airflow direction control unit 263 so that the flaps 134*a*, 134*b*, 134*c*, 134*d* assume the downward blowing orientation and perform the stationary action. When it is then determined the air-warming thermo-on state has switched to the air-warming thermo-off state after temperature nonuniformity resolution control has started, the temperature nonuniformity resolution control unit 265 ends temperature nonuniformity resolution control by sending a control signal to the airflow quantity control unit 262 so that the airflow quantity of the indoor fan 132 returns from the first airflow quantity H to the set airflow quantity that was set by the user.

The learning unit 266 decides a learning operation time duration when the temperature nonuniformity resolution control unit 265 has determined that deciding a learning operation time duration is necessary. The learning operation time duration is written into a storage unit (not shown) every time it is decided by the learning unit 266.

The learning unit 266 decides the learning operation time duration using the time duration in which the air-warming thermo-on state continues, which is measured in advance. Specifically, when the room interior is in a state of temperature nonuniformity and the air-warming operation is performed with all of the flaps 134*a*, 134*b*, 134*c*, 134*d* in the downward blowing stationary state, the learning unit 266 measures the time duration in which the air-warming thermo-on state continues, i.e., the air-warming thermo-on continuous time duration from the start of the air-warming operation until the air-warming thermo-off state, and decides a time duration calculated from the measured air-warming thermo-on continuous time duration to be the learning operation time duration. In the present embodiment, the learning unit 266 decides one third of the measured air-warming thermo-on continuous time duration to be the learning operation time duration. In the present embodiment, the learning unit 266 decides one third of the measured air-warming thermo-on continuous time duration to be the learning operation time duration, but is not limited to doing so and may decide anywhere from one half to one fourth of the measured air-warming thermo-on continuous time duration to be the learning operation time duration.

Figure 30:
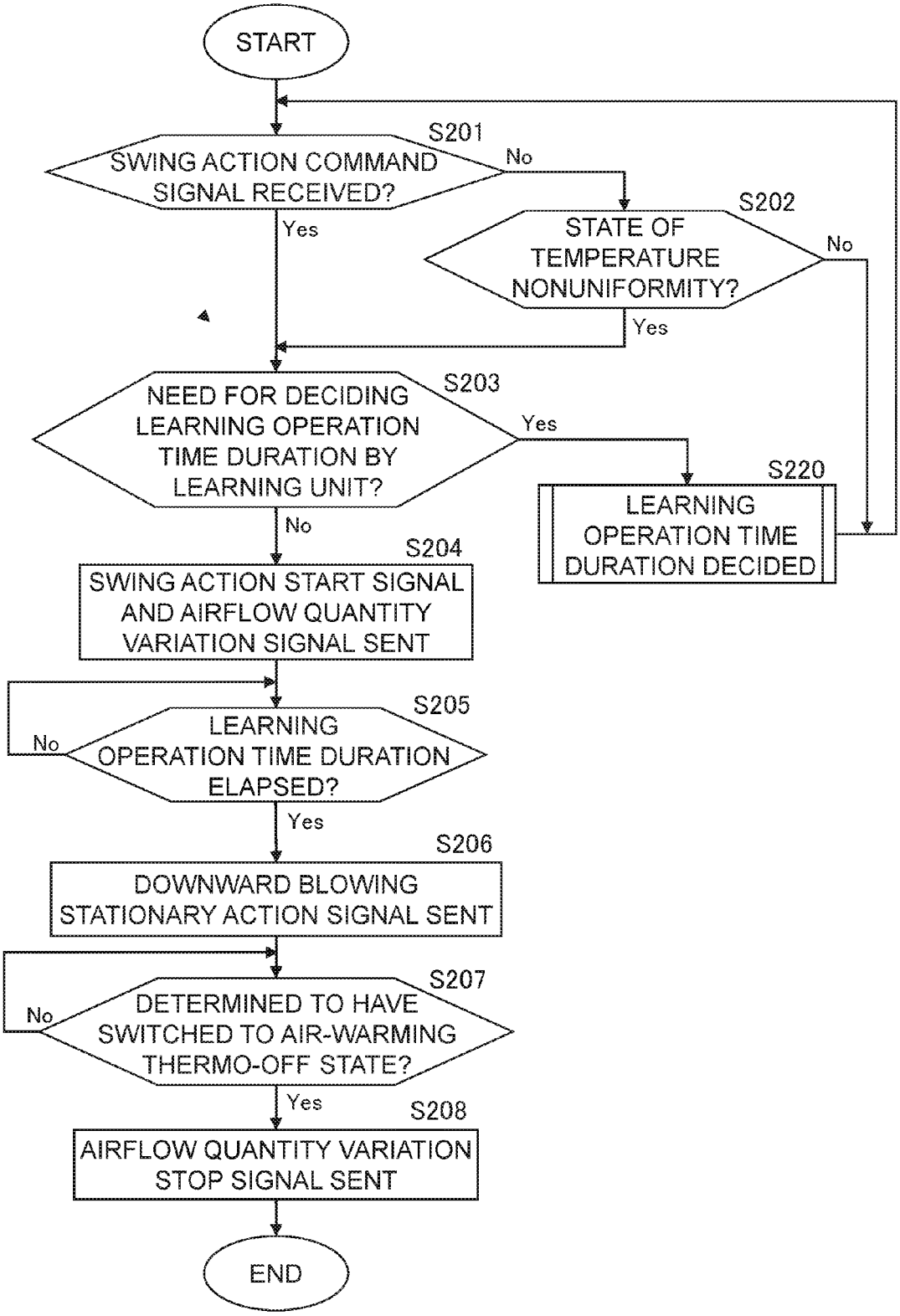
FIG. 30 is a flowchart showing the flow of the control action of the temperature nonuniformity resolution control unit in the air conditioning apparatus according to the third embodiment of the present invention.
Figure 31:
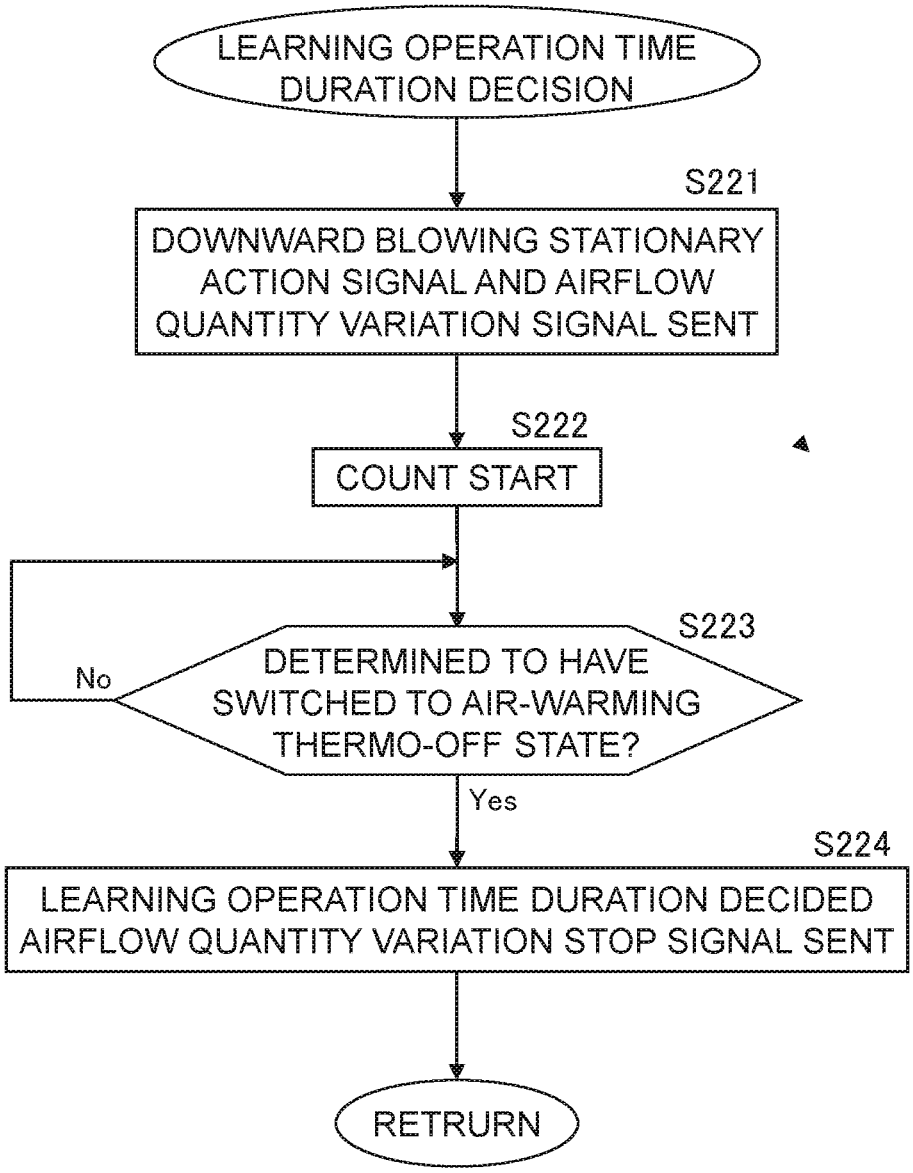
FIG. 31 is a flowchart showing the flow of the learning operation time duration being decided by the learning unit.

(4) Control Action by Temperature Nonuniformity Resolution Control Unit During Air-Warming Operation Next, FIGS. 30 and 31 are used to describe the control action by the temperature nonuniformity resolution control unit 265. As described above, the temperature nonuniformity resolution control unit 265 executes temperature nonuniformity resolution control only when the air-warming operation is in effect and automatic control mode has been set by the user. Specifically, whether the air-cooling operation or the air-warming operation be in effect, temperature nonuniformity resolution control is not executed by the temperature nonuniformity resolution control unit 265 when manual control mode has been set by the user.

When a swing action command signal has been received from the receiver 261 (step S201) or when the judgment unit 264 has judged there to be a state of temperature nonuniformity (step S202), the temperature nonuniformity resolution control unit 265 judges whether or not a learning operation time duration needs to be decided by the learning unit 266 (step S203). Specifically, the temperature nonuniformity resolution control unit 265 receives a swing action command signal sent from the receiver 261 which has received a swing action start command issued by the user who has felt the temperature nonuniformity in the room, and the temperature nonuniformity resolution control unit 265 thereby determines whether or not a learning operation time duration needs to be decided by the learning unit 266. Even if a swing action command signal is not sent from the receiver 261, the temperature nonuniformity resolution control unit 265 determines that a learning operation time duration needs to be decided by the learning unit 266 when the judgment unit 264 has judged there to be a state of temperature nonuniformity.

When the temperature nonuniformity resolution control unit 265 has determined that a learning operation time duration needs to be decided, the learning unit 266 decides a learning operation time duration (step S220). Specifically, the learning unit 266 sends a downward blowing stationary action signal to the airflow direction control unit 263 and sends an airflow quantity variation signal to the airflow quantity control unit 262 (step S221). At the same time the downward blowing stationary action signal and the airflow quantity variation signal are sent, the learning unit 266 also starts a timer count (step S222). Having been sent a downward blowing stationary action signal from the temperature nonuniformity resolution control unit 265, the airflow direction control unit 263 controls the drive motors 138*a*, 138*b*, 138*c*, 138*d* so that the flaps 134*a*, 134*b*, 134*c*, 134*d* go into the downward blowing stationary state. Having been sent an airflow quantity variation signal from the temperature nonuniformity resolution control unit 265, the airflow quantity control unit 262 controls the rotational speed of the fan motor 132*a* so that the airflow quantity of the indoor fan 132 is varied from the set airflow quantity set by the user to the first airflow quantity H. After the learning unit 266 has sent the downward blowing stationary action signal and the airflow quantity variation signal, when it has been determined that the air-warming thermo-on state has switched to the air-warming thermo-off state (step S223), the learning unit 266 uses the air-warming thermo-on continuous time duration measured by the timer to decide a learning operation time duration, and sends an airflow quantity variation stop signal to the airflow quantity control unit 262 (step S224). The learning operation time duration is thereby decided by the learning unit 266.

When the temperature nonuniformity resolution control unit 265 has determined in step S203 that a learning operation time duration does not need to be decided by the learning unit 266, temperature nonuniformity resolution control is started. Specifically, the temperature nonuniformity resolution control unit 265 sends a swing action start signal to the airflow direction control unit 263 and sends an airflow quantity variation signal to the airflow quantity control unit 262 (step S204). Having been sent a swing action start signal from the temperature nonuniformity resolution control unit 265, the airflow direction control unit 263 controls the drive motors 138*a*, 138*b*, 138*c*, 138*d* so that the flaps 134*a*, 134*b*, 134*c*, 134*d* go into the swing state. Having been sent an airflow quantity variation signal from the temperature nonuniformity resolution control unit 265, the airflow quantity control unit 262 controls the rotational speed of the fan motor 132*a* so that the airflow quantity of the indoor fan 132 is varied from the set airflow quantity set by the user to the first airflow quantity H.

When the learning operation time duration has elapsed (step S205) following the sending of the swing action start signal and the airflow quantity variation signal in step S204, the temperature nonuniformity resolution control unit 265 sends a downward blowing stationary action signal to the airflow direction control unit 263 (step S206). Having been sent a downward blowing stationary action signal from the temperature nonuniformity resolution control unit 265, the airflow direction control unit 263 controls the drive motors 138*a*, 138*b*, 138*c*, 138*d* so that the flaps 134*a*, 134*b*, 134*c*, 134*d* go into the downward blowing stationary state. The flaps 134*a*, 134*b*, 134*c*, 134*d* thereby switch from the swing state in which the airflow direction is varied automatically to the downward blowing stationary state in which the airflow direction is maintained in the airflow direction P1. The temperature nonuniformity resolution control unit 265 does not send a downward blowing stationary action signal to the airflow direction control unit 263 until the learning operation time duration has elapsed following the sending of the swing action start signal and the airflow quantity variation signal.

After sending the downward blowing stationary action signal in step S206, when the temperature nonuniformity resolution control unit 265 has determined that the air-warming thermo-on state has switched to the air-warming thermo-off state (step S207), an airflow quantity variation stop signal is sent to the airflow quantity control unit 262 (step S208). Having been sent an airflow quantity variation stop signal from the temperature nonuniformity resolution control unit 265, the airflow quantity control unit 262 controls the fan motor 132*a* and thereby varies the airflow quantity of the indoor fan 132 from the first airflow quantity H to the set airflow quantity, which is the airflow quantity prior to temperature nonuniformity resolution control being executed. The temperature nonuniformity resolution control by the temperature nonuniformity resolution control unit 265 is thereby ended. After sending the downward blowing stationary action signal in step S206, the temperature nonuniformity resolution control unit 265 does not send an airflow quantity variation stop signal to the airflow quantity control unit 262 until it has determined that the air-warming thermo-on state has switched to the air-warming thermo-off state.

(5) Characteristics (5-1)

When the air-warming operation of the air conditioning apparatus 110 is performed, there is a risk of causing discomfort to the user in the room because of a state of temperature nonuniformity in which there is a temperature difference between the top and bottom of the room interior, due to warm air accumulating near the ceiling and cold air accumulating near the floor. The inventors have obtained the knowledge that to resolve the state of temperature nonuniformity in the room, it is effective for the flaps 134*a*, 134*b*, 134*c*, 134*d* to perform the swing action and stir up the air in the room, but in a case in which the flaps 134*a*, 134*b*, 134*c*, 134*d* perform the swing action and the air conditioning apparatus 110 is operated, the consumed power is greater compared with a case in which the flaps 134*a*, 134*b*, 134*c*, 134*d* assume the downward blowing orientation and perform the stationary action and the air conditioning apparatus 110 is operated.

In view of this, in the present embodiment, the swing action of the flaps 134*a*, 134*b*, 134*c*, 134*d* is stopped upon fulfilling of the condition (equivalent to the second condition) that the learning operation time duration, which is decided using the continuous time duration of the air-warming thermo-on state measured in advance, has elapsed following the start of executing temperature nonuniformity resolution control. Therefore, the swing action of the flaps 134*a*, 134*b*, 134*c*, 134*d*, which was started in order to resolve the state of temperature nonuniformity in the room, can be automatically stopped due to the learning operation time duration elapsing even with no command from the user.

Temperature nonuniformity in the room can thereby be resolved, and the consumed power can be reduced.

The learning unit 266 also uses the continuous time duration of the air-warming thermo-on state measured in advance to decide the learning operation time duration. Therefore, a continuous time duration of the swing action more suited to the environment of the room in which the air conditioning apparatus is installed can be decided, in comparison with cases in which the continuous time duration of executing the swing action in temperature nonuniformity resolution control is set in advance, for example.

(5-2)

In the present embodiment, the learning unit 266 decides the learning operation time duration when the temperature nonuniformity resolution control unit 265 has determined that a learning operation time duration needs to be decided. The temperature nonuniformity resolution control unit 265 counts from the time the learning operation time duration is decided by the learning unit 266, and when the number of switches from the air-warming thermo-on state to the air-warming thermo-off state reaches a predetermined number or greater, the temperature nonuniformity resolution control unit 265 determines that a learning operation time duration needs to be decided by the learning unit 266. Therefore, in temperature nonuniformity resolution control, a learning operation time duration can be decided that corresponds to changes in outside air temperature and other external factors.

(6) Modifications (6-1) Modification 3A

In the embodiments described above, the temperature nonuniformity resolution control unit 265 counts from the time the learning operation time duration is decided by the learning unit 266, and when the number of switches from the thermo-on state to the thermo-off state reaches a predetermined number (e.g., 30) or greater, the temperature nonuniformity resolution control unit 265 determines that a learning operation time duration needs to be decided by the learning unit 266.

Instead of this, the temperature nonuniformity resolution control unit 265 may determine that a learning operation time duration needs to be decided by the learning unit 266 when a predetermined time duration (e.g., 12 hours) has elapsed following the time when the learning operation time duration is decided by the learning unit 266. Even with such a configuration, the learning unit 266 can decide a learning operation time duration suited to the outside air temperature and other external factors.

In the embodiments described above, there is a possibility that the learning operation time duration will be decided multiple times in one day by the learning unit 266. In view of this, instead of the embodiments described above, the temperature nonuniformity resolution control unit 265 may determine that a learning operation time duration needs to be decided by the learning unit 266 when a preset time (e.g., 12:00) has passed. Another option is that the learning operation time duration be decided by the learning unit 266 only during a test operation performed when the indoor unit 130 is installed in the room.

(6-2) Modification 3B

In the embodiments described above, a learning operation time duration decided by the learning unit 266 is employed in temperature nonuniformity resolution control.

Instead of this, in temperature nonuniformity resolution control, the user may choose the settings between employing a learning operation time duration decided by the learning unit 266 or employing the executed time duration (optimal time duration) of the swing action obtained experimentally in advance, described in the second embodiment.

Figure 32:
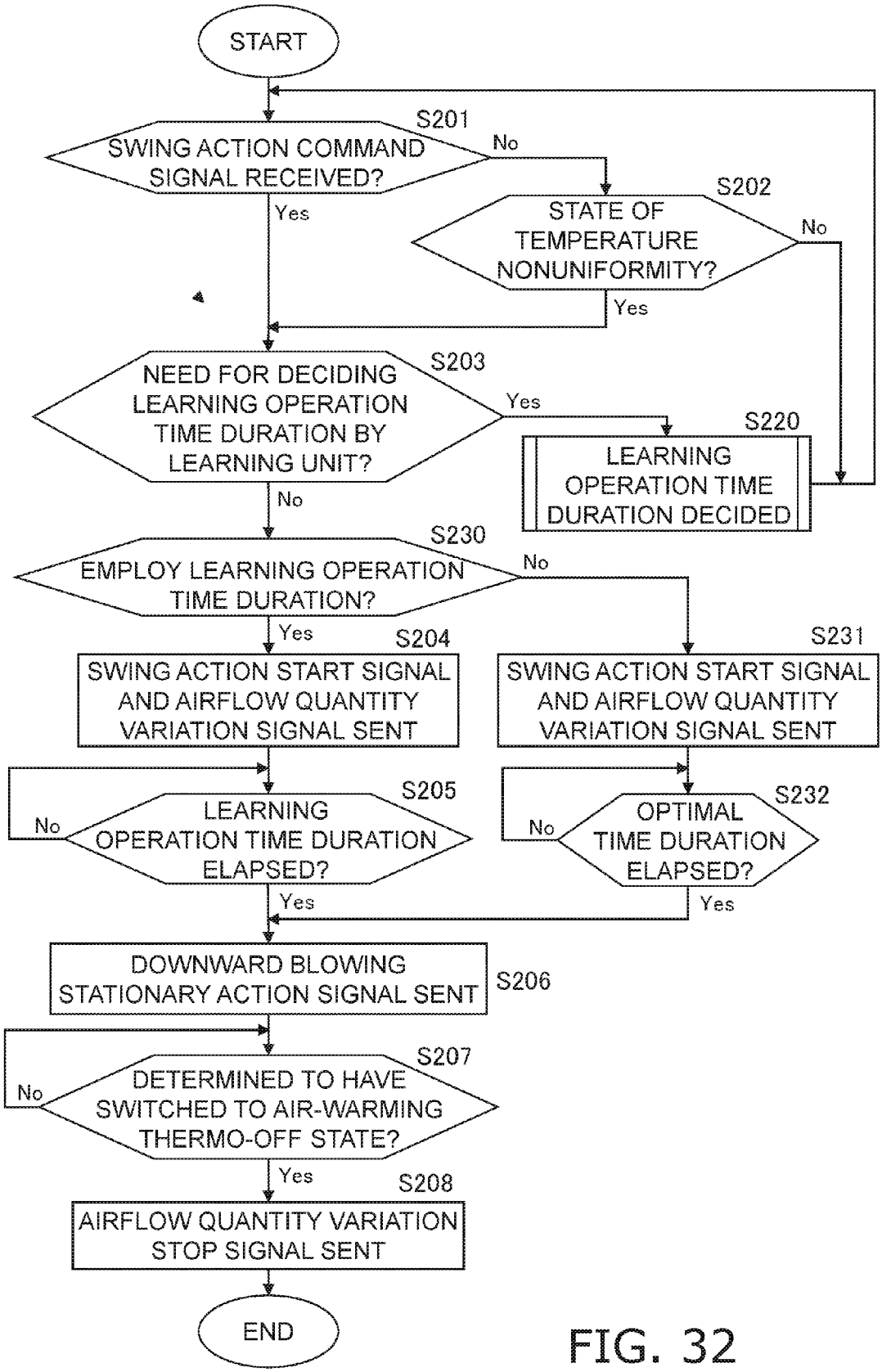
FIG. 32 is a flowchart showing the flow of the control action of the temperature nonuniformity resolution control unit in the air conditioning apparatus according to modification 2B of the third embodiment of the present invention.

FIG. 32 is a flowchart showing the flow of the control action by the temperature nonuniformity resolution control unit 265 in a case in which the user can choose the settings between employing either the learning operation time duration or the optimal time duration in temperature nonuniformity resolution control. In FIG. 32, since the steps other than step S230, step S231, and step S232 are the same as in the embodiments described above, descriptions thereof are omitted and the same symbols as the embodiments described above are used.

When it has been determined in step S203 that there is no need for the learning unit 266 to determine a learning operation time duration, the temperature nonuniformity resolution control unit 265 further determines whether or not the user has chosen the setting that the learning operation time duration be employed (step S230). When the setting that the learning operation time duration be employed has been chosen, the temperature nonuniformity resolution control unit 265 causes the flaps 134*a*, 134*b*, 134*c*, 134*d* to perform the swing action until the learning operation time duration elapses. Specifically, the temperature nonuniformity resolution control unit 265 sends a swing action start signal to the airflow direction control unit 263 (step S204), and when the learning operation time duration elapses following the sending of the swing action start signal (step S205), the temperature nonuniformity resolution control unit 265 sends a downward blowing stationary action signal to the airflow direction control unit 263 (step S206).

In step S230, when the temperature nonuniformity resolution control unit 265 determines that the setting that the learning operation time duration be employed has not been chosen, the temperature nonuniformity resolution control unit 265 causes the flaps 134*a*, 134*b*, 134*c*, 134*d* to perform the swing action until the optimal time duration elapses. Specifically, the temperature nonuniformity resolution control unit 265 sends a swing action start signal to the airflow direction control unit 263 (step S231), and when the optimal time duration elapses following the sending of the swing action start signal (step S232), the temperature nonuniformity resolution control unit 265 sends a downward blowing stationary action signal to the airflow direction control unit 263 (step S206).

When the temperature nonuniformity resolution control unit 265 has such a configuration, since the user can set whether or not the learning operation time duration is employed in temperature nonuniformity resolution control, temperature nonuniformity resolution control can be performed according to the user's preferences.

Fourth Embodiment

Before the fourth embodiment of the present invention is described, first is a description of the knowledge of the inventors that was an important basis for the inventors in devising the present invention.

From the results of the evaluation testing described above, the inventors discovered that the average room temperature exceeds the set temperature Trs when 13 minutes and 30 seconds have elapsed following the start of the operation to resolve temperature nonuniformity in the room in the swing state. Therefore, by focusing on this point, the inventors have obtained the knowledge that temperature nonuniformity in the room has been resolved due to the average room temperature exceeding the set temperature Trs.

The following is a description of an air conditioning apparatus according to the fourth embodiment of the present invention which the inventors completed based on the aforementioned knowledge. In the present embodiment, components other than the control unit 360 are the same as those of the second embodiment, therefore, only (3) the control unit 360 is described, and descriptions are omitted of (1) the outdoor unit 120 and (2) the indoor unit 130, which are components other than the control unit 360.

(3) Control Unit

Figure 33:
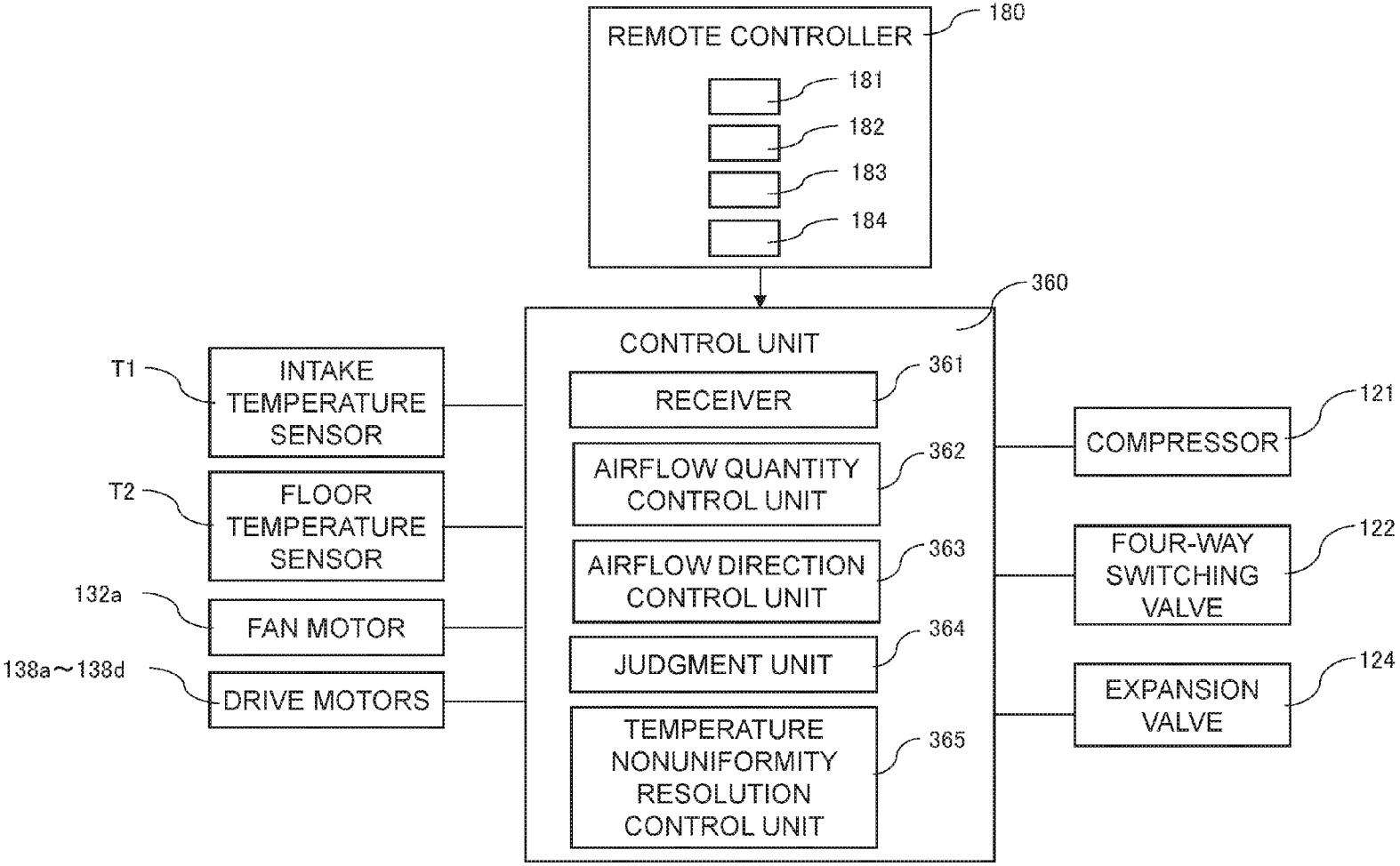
FIG. 33 is a control block diagram of the control unit provided to the air conditioning apparatus according to the fourth embodiment of the present invention.

The control unit 360, which is a microcomputer composed of a CPU and memory, controls the actions of the various devices of the indoor unit 130 and the outdoor unit 120. The control unit 360 comprises a receiver 361, an airflow quantity control unit 362, an airflow direction control unit 363, a judgment unit 364, and a temperature nonuniformity resolution control unit 365, as shown in FIG. 33. The configurations of the receiver 361, the airflow quantity control unit 362, and the airflow direction control unit 363 are the same as those of the second embodiment and are therefore not described.

The judgment unit 364 judges whether or not there are deviations in the temperature distribution in the room when the air conditioning apparatus is operating. Specifically, the judgment unit 364 judges whether or not the room interior is in a state of temperature nonuniformity on the basis of the intake temperature Tr sent from the intake temperature sensor T1 and the floor temperature Tf sent from the floor temperature sensor T2. More specifically, the judgment unit 364 judges that there is a state of temperature nonuniformity when the difference between the intake temperature Tr and the floor temperature Tf is equal to or greater than a predetermined temperature (e.g., 6° C.). The judgment unit 364 also judges that there is not a state of temperature nonuniformity when the difference between the intake temperature Tr and the floor temperature Tf is less than a predetermined temperature (e.g., 6° C.).

When the judgment unit 364 has judged there to be a state of temperature nonuniformity, the judgment unit 364 employs the average value between the intake temperature Tr and the floor temperature Tf as a substitute value of the average room temperature (the temperature near the wall in a position where the distance from the ceiling and the distance from the floor are substantially equal), and further judges whether or not the state of temperature nonuniformity in the room has been resolved based on the aforementioned average value and the set temperature Trs set by the user. Specifically, the judgment unit 364 judges that the state of temperature nonuniformity in the room has been resolved when a temperature value one half the sum of the intake temperature Tr and floor temperature Tf is equal to or greater than a set temperature value obtained from the set temperature Trs ($(Tr+Tf)/2 \geq Trs$). When the temperature value is less than the set temperature value ($(Tr+Tf)/2 < Trs$), the judgment unit 364 judges that the state of temperature nonuniformity in the room has not been resolved. This judgment by the judgment unit 364 of whether or not the state of temperature nonuniformity in the room has been resolved is performed until the state of temperature nonuniformity has been judged to be resolved.

The temperature nonuniformity resolution control unit 365 executes temperature nonuniformity resolution control when automatic control mode has been set and the air-warming operation is being performed in the air conditioning apparatus.

In temperature nonuniformity resolution control, the temperature nonuniformity resolution control unit 365 first sends control signals to the airflow direction control unit 363 and the airflow quantity control unit 362 so that the flaps 134*a*, 134*b*, 134*c*, 134*d* start the swing action and the airflow quantity of the indoor fan 132 reaches the first airflow quantity H. Next, when the state of temperature nonuniformity is judged by the judgment unit 364 to be resolved after temperature nonuniformity resolution control has started, the temperature nonuniformity resolution control unit 365 sends a control signal to the airflow direction control unit 363 so that the flaps 134*a*, 134*b*, 134*c*, 134*d* assume the downward blowing orientation and perform the stationary action.

When it is then determined the air-warming thermo-on state has switched to the air-warming thermo-off state after temperature nonuniformity resolution control has started, the temperature nonuniformity resolution control unit 365 ends temperature nonuniformity resolution control by sending a control signal to the airflow quantity control unit 362 so that the airflow quantity of the indoor fan 132 returns from the first airflow quantity H to the set airflow quantity that was set by the user.

Figure 34:
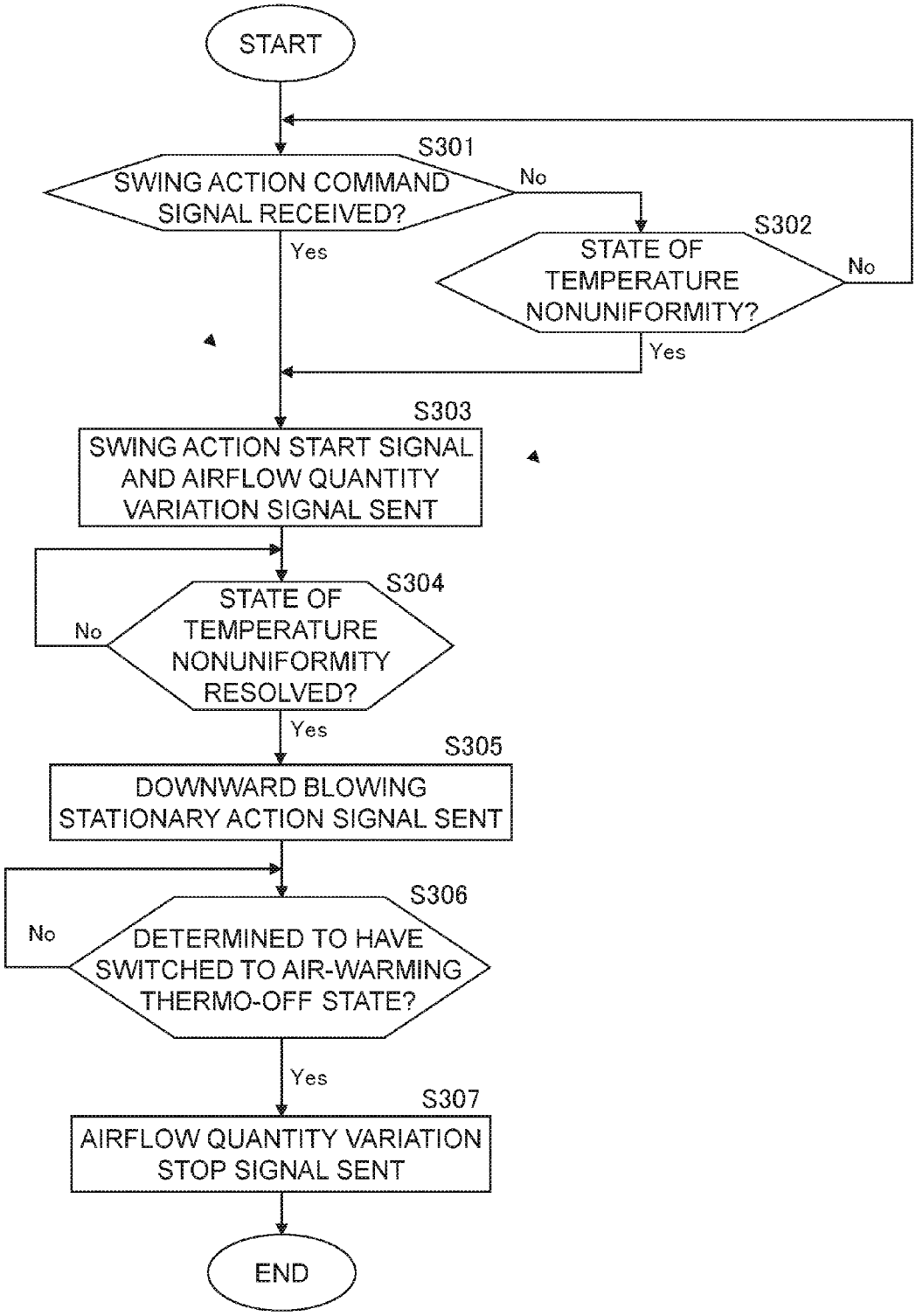
FIG. 34 is a flowchart showing the flow of the control action of the temperature nonuniformity resolution control unit in the air conditioning apparatus according to the fourth embodiment of the present invention.

(4) Control Action by Temperature Nonuniformity Resolution Control Unit During Air-Warming Operation Next, FIG. 34 is used to describe the control action by the temperature nonuniformity resolution control unit 365. As described above, the temperature nonuniformity resolution control unit 365 executes temperature nonuniformity resolution control only in cases in which the air-warming operation is in effect and automatic control mode has been set by the user. Specifically, temperature nonuniformity resolution control by the temperature nonuniformity resolution control unit 365 is not executed when manual control mode has been set by the user, whether the air-cooling operation or the air-warming operation is in effect.

The temperature nonuniformity resolution control unit 365 starts temperature nonuniformity resolution control either when a swing action command signal sent from the receiver 361 has been received (step S301), or when the judgment unit 364 has judged there to be a state of temperature nonuniformity (step S302). Specifically, the temperature nonuniformity resolution control unit 365 receives a swing action command signal sent from the receiver 361 which has received a swing action start command issued by the user who has felt temperature nonuniformity in the room, whereby the temperature nonuniformity resolution control unit 365 starts temperature nonuniformity resolution control. Even if a swing action command signal is not sent from the receiver 361, the temperature nonuniformity resolution control unit 365 starts temperature nonuniformity resolution control when the judgment unit 364 has judged there to be a state of temperature nonuniformity.

During temperature nonuniformity resolution control, the temperature nonuniformity resolution control unit 365 sends a swing action start signal to the airflow direction control unit 363 and sends an airflow quantity variation signal to the airflow quantity control unit 362 (step S303). Having been sent a swing action start signal from the temperature nonuniformity resolution control unit 365, the airflow direction control unit 363 controls the drive motors 138*a*, 138*b*, 138*c*, 138*d* so that the flaps 134*a*, 134*b*, 134*c*, 134*d* go into the swing state. Having been sent an airflow quantity variation signal from the temperature nonuniformity resolution control unit 365, the airflow quantity control unit 362 controls the rotational speed of the fan motor 132*a* so that the airflow quantity of the indoor fan 132 is varied from the set airflow quantity set by the user to the first airflow quantity H.

When the temperature nonuniformity resolution control unit 365 has judged that the state of temperature nonuniformity has been resolved (step S304) following the sending of the swing action start signal and the airflow quantity variation signal in step S303, the temperature nonuniformity resolution control unit 365 sends a downward blowing stationary action signal to the airflow direction control unit 363 (step S305). Having been sent a downward blowing stationary action signal from the temperature nonuniformity resolution control unit 365, the airflow direction control unit 363 controls the drive motors 138*a*, 138*b*, 138*c*, 138*d* so that the flaps 134*a*, 134*b*, 134*c*, 134*d* go into the downward blowing stationary state. The flaps 134*a*, 134*b*, 134*c*, 134*d* thereby switch from the swing state in which the airflow direction is varied automatically to the downward blowing stationary state in which the airflow direction is maintained in the airflow direction P1. The temperature nonuniformity resolution control unit 365 does not send a downward blowing stationary action signal to the airflow direction control unit 363 until the judgment unit 364 has judged that the state of temperature nonuniformity has been resolved following the sending of the swing action start signal and the airflow quantity variation signal.

After sending the downward blowing stationary action signal in step S305, when the temperature nonuniformity resolution control unit 365 has determined that the air-warming thermo-on state has switched to the air-warming thermo-off state (step S306), an airflow quantity variation stop signal is sent to the airflow quantity control unit 362 (step S307). Having been sent an airflow quantity variation stop signal from the temperature nonuniformity resolution control unit 365, the airflow quantity control unit 362 controls the fan motor 132*a* and thereby varies the airflow quantity of the indoor fan 132 from the first airflow quantity H to the set airflow quantity, which is the airflow quantity prior to temperature nonuniformity resolution control being executed. The temperature nonuniformity resolution control by the temperature nonuniformity resolution control unit 365 is thereby ended. After sending the downward blowing stationary action signal in step S305, the temperature nonuniformity resolution control unit 365 does not send an airflow quantity variation stop signal to the airflow quantity control unit 362 until it has determined that the air-warming thermo-on state has switched to the air-warming thermo-off state.

(5) Characteristics (5-1)

When the air-warming operation of the air conditioning apparatus 110 is performed, there is a risk of causing discomfort to the user in the room because of a state of temperature nonuniformity in which there is a temperature difference between the top and bottom of the room interior, due to warm air accumulating near the ceiling and cold air accumulating near the floor. The inventors have obtained the knowledge that to resolve the state of temperature nonuniformity in the room, it is effective for the flaps 134*a*, 134*b*, 134*c*, 134*d* to perform the swing action and stir up the air in the room, but in a case in which the flaps 134*a*, 134*b*, 134*c*, 134*d* perform the swing action and the air conditioning apparatus 110 is operated, the consumed power is greater compared with a case in which the flaps 134*a*, 134*b*, 134*c*, 134*d* assume the downward blowing orientation and perform the stationary action and the air conditioning apparatus 110 is operated.

In view of this, in the present embodiment, the swing action of the flaps 134*a*, 134*b*, 134*c*, 134*d* is stopped upon fulfilling of the condition that the judgment unit 364 has judged that the state of temperature nonuniformity has been resolved, i.e., the condition (equivalent to the third condition) that the judgment unit 364 has judged that the room interior is not in a state of temperature nonuniformity following the start of executing temperature nonuniformity resolution control. Therefore, the swing action of the flaps 134*a*, 134*b*, 134*c*, 134*d*, which was started in order to resolve the state of temperature nonuniformity in the room, can be automatically stopped due to the judgment unit 364 judging that the state of temperature nonuniformity has been resolved even with no command from the user.

Temperature nonuniformity in the room can thereby be resolved, and the consumed power can be reduced.

Fifth Embodiment

Before the fifth embodiment of the present invention is described, first is a description of the knowledge of the inventors that was an important basis for the inventors in devising the present invention.

The inventors believed that the comfort of the user could be improved by reducing the time needed to make the temperature distribution in the room (equivalent to the air-conditioned room) uniform after the start of the air-cooling operation. The following evaluation testing was performed in order to examine actions of the flaps that could possibly make the temperature distribution in the room uniform in a short amount of time at the start of the air-cooling operation. For the sake of convenience in the description hereinbelow, the term "all-synchronous swing state" is used to refer to a state in which all of the flaps 134*a*, 134*b*, 134*c*, 134*d* are performing the swing action synchronously, i.e., a state in which the swing actions of all the flaps 134*a*, 134*b*, 134*c*, 134*d* are started simultaneously and all of the flaps 134*a*, 134*b*, 134*c*, 134*d* thereby assume the same orientation and perform the swing action.

FIG. 35 shows the time duration from the start of the air-cooling operation until the average room temperature (the average value of a plurality of temperature detection sensors disposed in a grid in the space in the test room, i.e., the average value of temperatures measured in all locations in the test room) reaches the set temperature Trs (hereinbelow referred to as the period of making the temperature distribution uniform) and the power consumed by the entire air conditioning apparatus 110, in a case in which the air conditioning apparatus 110 performs the air-cooling operation with the flaps 134*a*, 134*b*, 134*c*, 134*d* of the indoor unit 130 installed in the test room in the horizontal blowing stationary state, a case in which the air conditioning apparatus 110 performs the air-cooling operation with the flaps 134*a*, 134*b*, 134*c*, 134*d* of the indoor unit 130 installed in the test room in the all-synchronous swing state, and a case in which the air conditioning apparatus 110 performs the air-cooling operation with the flaps 134*a*, 134*b*, 134*c*, 134*d* of the indoor unit 130 installed in the test room in the opposite-side swing state.

FIG. 36 shows the power consumed by the entire air conditioning apparatus 110 from the start of the air-cooling operation until one hour has elapsed, in a case in which the air conditioning apparatus 110 performs the air-cooling operation with the flaps 134*a*, 134*b*, 134*c*, 134*d* of the indoor unit 130 installed in the test room in the horizontal blowing stationary state, a case in which the air conditioning apparatus 110 performs the air-cooling operation with the flaps 134*a*, 134*b*, 134*c*, 134*d* of the indoor unit 130 installed in the test room in the all-synchronous swing state, a case in which the air conditioning apparatus 110 performs the air-cooling operation with the flaps 134*a*, 134*b*, 134*c*, 134*d* of the indoor unit 130 installed in the test room in the opposite-side swing state, and a case in which the air conditioning apparatus 110 performs the air-cooling operation with the flaps 134*a*, 134*b*, 134*c*, 134*d* of the indoor unit 130 installed in the test room in the opposite-side swing state until 16 minutes and 40 seconds have elapsed since the start of the operation and then in the horizontal blowing stationary state after 16 minutes and 40 seconds have elapsed.

FIGS. 35 and 36 are the results of evaluation testing after allowing sufficient time with the environment of the test room in JIS air-cooling standard conditions (outside air temperature DB: 35° C., WB: 30° C.). FIGS. 35 and 36 are the results of setting the set temperature Trs to 27° C. and setting the set airflow quantity to the first airflow quantity H.

From the results of measuring the indoor temperature distribution, the time needed for the average room temperature to reach the set temperature Trs following the start of the air-cooling operation, i.e., the length of the period of making the temperature distribution uniform was shorter in the horizontal blowing stationary state than in the all-synchronous swing state, and shorter in the opposite-side swing state than in the horizontal blowing stationary state (see FIG. 35). It was thereby ascertained that during the start of the air-cooling operation, a uniform temperature distribution can be achieved in a shorter amount of time with the horizontal blowing stationary state than with the all-synchronous swing state, and a uniform temperature distribution can be achieved in a shorter amount of time with the opposite-side swing state than with the horizontal blowing stationary state. Specifically, it was ascertained that the effect of making the indoor temperature distribution uniform at the start of the air-cooling operation increases progressively with the opposite-side swing state, the horizontal blowing stationary state, and the all-synchronous swing state.

The power consumed until the average room temperature reaches the set temperature Trs following the start of the air-cooling operation, i.e., the power consumed during the period of making the temperature distribution uniform in the horizontal blowing stationary state was approximately 50% less than that of the all-synchronous swing state, and in the opposite-side swing state was approximately 30% less than that of the horizontal blowing stationary state, as shown in FIG. 35.

Furthermore, the power consumed until one hour elapses following the start of the air-cooling operation in the all-synchronous swing state was approximately 20% greater than that of the horizontal blowing stationary state, and in the opposite-side swing state was approximately 30% greater than that of the horizontal blowing stationary state, as shown in FIG. 36.

From these results, it was ascertained that in a case in which the flaps 134*a*, 134*b*, 134*c*, 134*d* perform the opposite-side swing action from the start of the air-cooling operation until the average room temperature reaches the set temperature Trs, i.e., during the period of making the temperature distribution uniform and the flaps 134*a*, 134*b*, 134*c*, 134*d* then assume the horizontal blowing orientation and perform the stationary action after the average room temperature has reached the set temperature Trs, i.e., during the period following the period of making the temperature distribution uniform (hereinbelow referred to as the stable period), the amount of time needed to make the indoor temperature distribution uniform following the start of the air-cooling operation is shorter and less power is consumed in comparison with a case in which all of the flaps 134*a*, 134*b*, 134*c*, 134*d* assume the horizontal blowing orientation and perform the stationary action continuously throughout the period of making the temperature distribution uniform and the stable period. It was also ascertained that in a case in which the flaps 134*a*, 134*b*, 134*c*, 134*d* perform the opposite-side swing action during the period of making the temperature distribution uniform and then the flaps 134*a*, 134*b*, 134*c*, 134*d* assume the horizontal blowing orientation and perform the stationary action during the stable period, the consumed power needed to make the indoor temperature distribution uniform following the start of the air-cooling operation is less in comparison with a case in which the flaps 134*a*, 134*b*, 134*c*, 134*d* perform the opposite-side swing action continuously throughout the period of making the temperature distribution uniform and the stable period (see FIG. 36).

In view of this, the inventors have obtained the knowledge that causing the flaps 134*a*, 134*b*, 134*c*, 134*d* to start the opposite-side swing action simultaneous with the start of the air-cooling operation, and then causing the flaps 134*a*, 134*b*, 134*c*, 134*d* to stop the opposite-side swing action and assume the horizontal blowing orientation and perform the stationary action when a predetermined time duration (the optimal time duration) has elapsed after the flaps 134*a*, 134*b*, 134*c*, 134*d* have started the opposite-side swing action, is a control whereby the indoor temperature distribution is made uniform in a short amount of time after the air-cooling operation is started and the consumed power is small. In the air conditioning apparatus 110 of the present embodiment, such knowledge is used to employ a control method for controlling the flaps 134*a*, 134*b*, 134*c*, 134*d* during initial air-cooling control so that the state of the flaps 134*a*, 134*b*, 134*c*, 134*d* is switched in sequence to the opposite-side swing state and then to the horizontal blowing stationary state.

In this evaluation testing, when the flaps 134*a*, 134*b*, 134*c*, 134*d* were in the opposite-side swing state, the indoor temperature distribution was made uniform at the point in time when 16 minutes and 40 seconds had elapsed following the start of the air-cooling operation. Therefore, after the air-cooling operation is started, the continuous time duration (optimal time duration) of executing the opposite-side swing action, whereby the indoor temperature distribution can be made uniform and the consumed power can be reduced, is preferably about 16 minutes and 40 seconds following the start of the air-cooling operation. When the optimal time duration is about 16 minutes and 40 seconds, it is a precondition needed to satisfy the condition that the capacity of the air conditioning apparatus 110 substantially match the air-conditioning load of the room in which the air conditioning apparatus 110 is installed (a state such that the capacity is not excessive or insufficient), and the condition that of the four flaps 134*a*, 134*b*, 134*c*, 134*d*, two flaps disposed opposite of each other be driven synchronously.

Employing such control as is described above as the initial air-cooling control makes it possible to make the indoor temperature distribution uniform at the start of the air-cooling operation in a shorter amount of time than with an air conditioning apparatus 110 in which the flaps 134*a*, 134*b*, 134*c*, 134*d* are put in the horizontal blowing stationary state or the flaps 134*a*, 134*b*, 134*c*, 134*d* are put in the all-synchronous swing state at the start of the air-cooling operation.

In the present embodiment, since the optimal time duration in initial air-cooling control is 16 minutes and 40 seconds, the indoor temperature distribution can be made uniform and the amount of power consumed in initial air-cooling control can be reduced.

Hereinbelow, the results of the above-described evaluation testing are used as a basis to describe the air conditioning apparatus according to the fifth embodiment of the present invention completed by the inventors. In the present embodiment, components other than the remote controller 480 and the control unit 460 are the same as those of the second embodiment; therefore, only (2) the remote controller 480 of the indoor unit 130 and (3) the control unit 460 are described, and descriptions are omitted of (1) the outdoor unit 120, (2) the indoor unit 130, and other components besides the remote controller 480, which are components other than the control unit 460.

(2-7) Remote Controller

The remote controller 480 is a device for the user to remotely operate the air conditioning apparatus 110. The remote controller 480 is provided with operation switches such as an operation start/stop switch 484, an airflow direction adjustment switch 481, an airflow quantity adjustment switch 482, and a manual/automatic selection switch 483. The configurations of the operation start/stop switch 484, the airflow direction adjustment switch 481, and the airflow quantity adjustment switch 482 are the same as those of the second embodiment and are therefore not described herein.

The manual/automatic selection switch 483 is a switch operated when the user issues a mode setting command during the air-warming operation. By operating the manual/automatic selection switch 483, the user can set the mode to a manual control mode or an automatic control mode. In the case that the mode is set to the manual control mode, the various devices of the air conditioning apparatus 110 are controlled so as to achieve the set temperature Trs, the set airflow quantity, and the set airflow direction which are set by the user. In the case that the mode is set to the automatic control mode, during an initial time period which is the time period from the start of the air-cooling operation until a predetermined time duration has elapsed, the various devices of the air conditioning apparatus 110 are controlled according to the control specifics of the initial air-cooling control, described hereinafter.

(3) Control Unit

Figure 37:
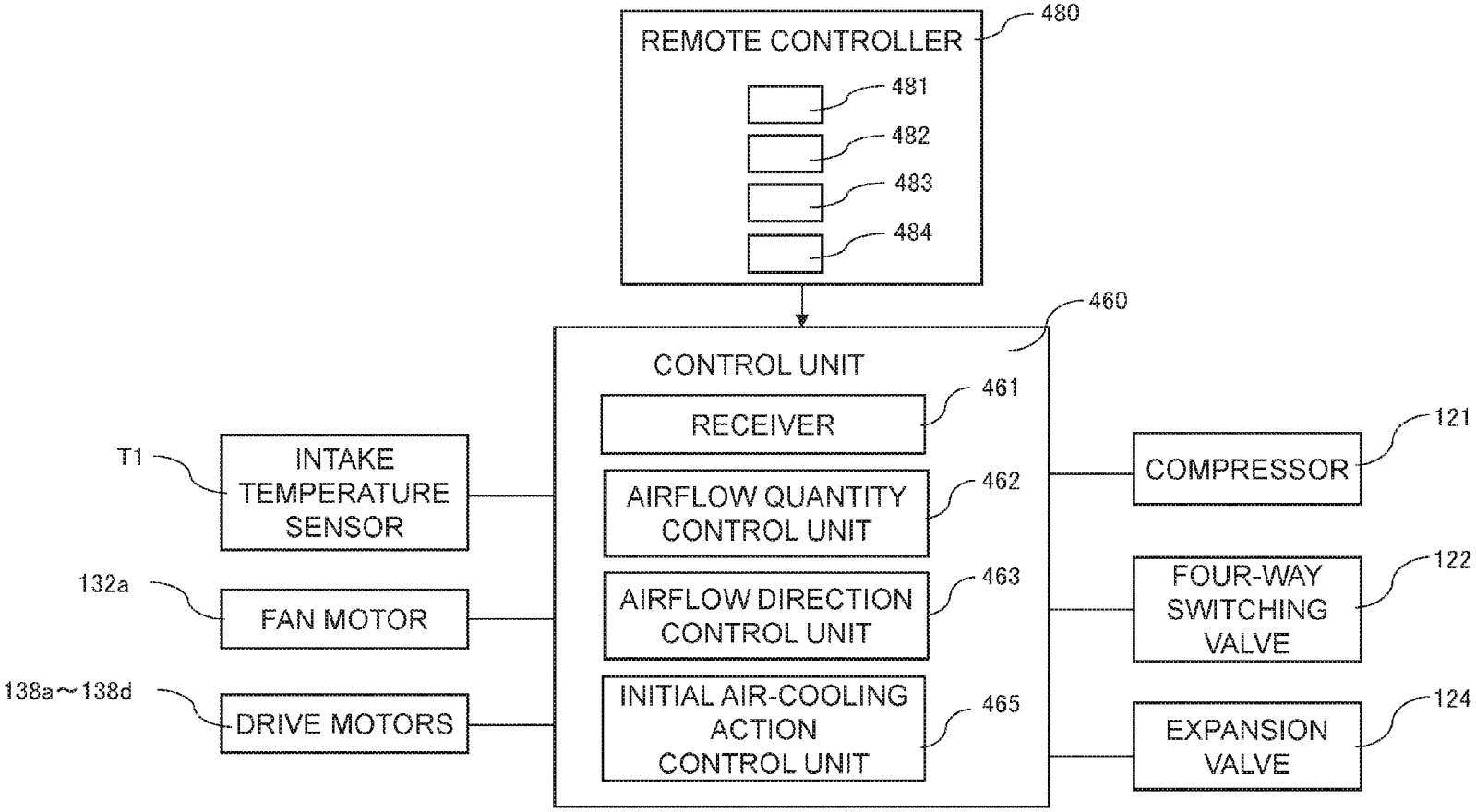
FIG. 37 is a control block diagram of the control unit provided to the air conditioning apparatus according to the fifth embodiment of the present invention.

The control unit 460 is a microcomputer comprising a CPU and memory, and the control unit controls the actions of the various devices of the indoor unit 130 and the outdoor unit 120. Specifically, the control unit 460 is electrically connected with various devices such as the intake temperature sensor T1, the fan motor 132*a*, the drive motors 138*a*, 138*b*, 138*c*, 138*d*, the compressor 121, the four-way switching valve 122, and the expansion valve 124, as shown in FIG. 37. The control unit 460 performs drive control on the compressor 121 and the other various devices on the basis of the detection results of the intake temperature sensor T1, and the various commands issued by the user via the remote controller 480.

When causing the air conditioning apparatus 110 to perform the air-cooling operation, the control unit 460 switches the state of the four-way switching valve 122 so that the outdoor heat exchanger 123 functions as a refrigerant heat radiator and the indoor heat exchanger 133 functions as a refrigerant evaporator, and drives the compressor 121. In the air-cooling operation, the control unit 460 controls the various devices so that the intake temperature Tr reaches the set temperature Trs. Specifically, when the intake temperature Tr is higher than the set temperature Trs in the air-cooling operation, the compressor 121 is driven, whereby the above-described operation control is performed for circulating the refrigerant in the refrigerant circuit (the state in which this operation control is performed is hereinbelow referred to as the air-cooling thermo-on state). When the intake temperature Tr has reached the set temperature Trs, a control is performed in which the compressor 121 is stopped so that refrigerant is not circulated in the refrigerant circuit, and the rotation of the indoor fan 132 is stopped so that air is not blown out of the discharge ports 137 (the state in which this control is performed is hereinbelow referred to as the air-cooling thermo-off state).

Furthermore, the control unit 460 comprises a receiver 461, an airflow quantity control unit 462, and an airflow direction control unit 463. Other than the receiver 461 being capable of sending signals based on various commands issued from the user to a hereinafter-described initial air-cooling action control unit 465, the functions of the receiver 461, the airflow quantity control unit 462, and the airflow direction control unit 463 are the same as in the second embodiment and are therefore not described.

For the sake of convenience in the description hereinbelow, the airflow direction P0*c* represents the airflow direction angle when the flaps 134*a*, 134*b*, 134*c*, 134*d* assume the orientations of closing the discharge ports 137*a* (equivalent to the first discharge port), 137*b* (equivalent to the second discharge port), 137*c* (equivalent to the third discharge port), and 137*d* (equivalent to the fourth discharge port) (see FIG. 38). Furthermore, for the sake of convenience in the description hereinbelow, the orientation assumed by the flaps 134*a*, 134*b*, 134*c*, 134*d* so that the airflow direction is the airflow direction P0 is referred to as the horizontal blowing orientation. In the present embodiment, when automatic control mode is set by the user, the drive motors 138*a*, 138*b*, 138*c*, 138*d* are driven so that the flaps 134*a*, 134*b*, 134*c*, 134*d* assume the horizontal blowing orientation which is set as the default, at times other than when initial air-cooling control, described hereinafter, is being executed.

Furthermore, the control unit 460 comprises an initial air-cooling action control unit 465 for executing initial air-cooling control at the start of the air-cooling operation. The initial air-cooling action control unit 465 executes initial air-cooling control when automatic control mode has been set.

During initial air-cooling control, the initial air-cooling action control unit 465 first sends a control signal to the airflow direction control unit 463 so that of the four flaps 134*a*, 134*b*, 134*c*, 134*d*, two flaps disposed opposite of each other assume the same orientation and perform the swing action (hereinbelow referred to as the opposite-side swing action); and sends a control signal to the airflow quantity control unit 462 so that the airflow quantity of the indoor fan 132 reaches the first airflow quantity H, during the initial time period from the start of the air-cooling operation until a predetermined time duration (hereinbelow referred to as the optimal time duration) obtained experimentally in advance has elapsed. When the optimal time duration has elapsed following the start of the air-cooling operation, i.e., when the initial time period has ended, the initial air-cooling action control unit 465 sends a control signal to the airflow direction control unit 463 so that the opposite-side swing action of the flaps 134*a*, 134*b*, 134*c*, 134*d* is stopped and the flaps 134*a*, 134*b*, 134*c*, 134*d* assume the horizontal blowing orientation and start the stationary action, and also sends a control signal to the airflow quantity control unit 462 so that the airflow quantity of the indoor fan 132 reaches the set airflow quantity that was set by the user, thereby ending initial air-cooling control.

Upon being sent a control signal pertaining to the opposite-side swing action from the initial air-cooling action control unit 465, the airflow direction control unit 463 controls the drive motors 138*a*, 138*b*, 138*c*, 138*d* so that of the four flaps 134*a*, 134*b*, 134*c*, 134*d*, two flaps (e.g., the flaps 134*a* and 134*c*: equivalent to the first flaps) and the other flaps (e.g., the flaps 134*b* and 134*d*: equivalent to the second flaps) perform the swing action in opposite directions of each other. At this time, the airflow direction control unit 463 performs control for changing the turning direction of the other flaps (e.g., the flaps 134*b* and 134*d*) with the timing at which the turning direction of the two flaps (e.g., the flaps 134*a* and 134*c*) changes. By starting the swing action of either the two flaps (e.g., the flaps 134*a* and 134*c*) or the other flaps (e.g., the flaps 134*b* and 134*d*) first, the airflow direction control unit 463 causes the two flaps (e.g., the flaps 134*a* and 134*c*) and the other flaps (e.g., the flaps 134*b* and 134*d*) to perform different swing actions. The term "different swing actions" in the present embodiment means the action of swing actions of the same swing pattern being performed at different timings, but the different swing actions are not limited as such and may be swing actions of different swing patterns, for example.

Figure 38:
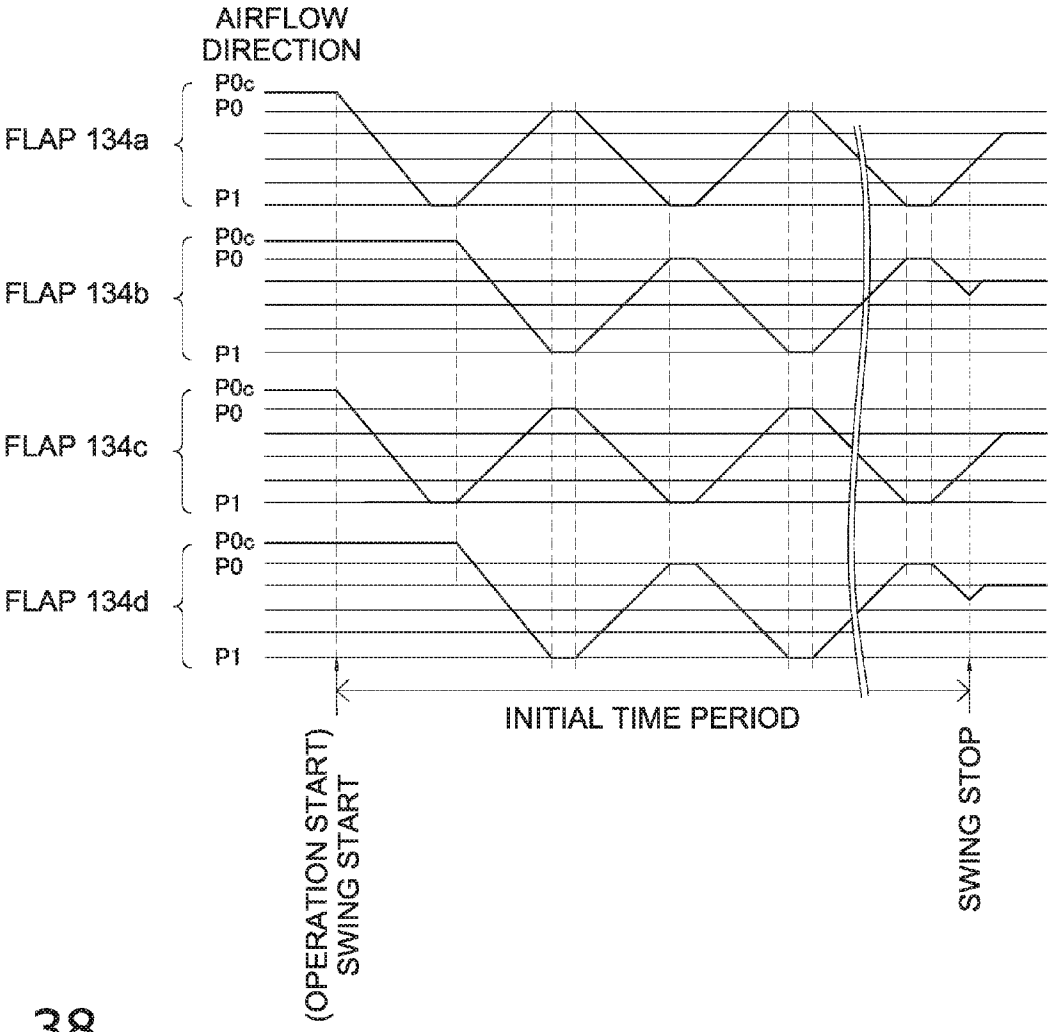
FIG. 38 is a timing chart for describing the action of the flaps.

FIG. 38 is used hereinbelow to describe the orientations assumed by the flaps 134*a*, 134*b*, 134*c*, 134*d* in initial air-cooling control. In FIG. 38, the flap 134*a* and the flap 134*c* start turning before the flap 134*b* and the flap 134*d*, but the flaps are not limited to doing so; the flap 134*b* and the flap 134*d* may start turning before the flap 134*a* and the flap 134*c*.

First, by controlling the driving of the drive motors 138*a*, 138*c*, the airflow direction control unit 463 turns both the flaps 134*a*, 134*c* at the same turning rate in a direction of turning from a state of closing the discharge ports 137*a*, 137*c* (the airflow direction P0*c*) through the airflow direction P0 to the airflow direction P1, i.e., downward. Therefore, the airflow direction angles of the flap 134*a* and the flap 134*c* reach the airflow direction P1 from the airflow direction P0 with the same timing. After the flaps 134*a*, 134*c* have reached the airflow direction P1, the turning direction of the flaps 134*a*, 134*c* changes from downward to upward, and with this timing, the other flaps 134*b*, 134*d* both start turning from a state of closing the discharge ports 137*b*, 137*d* (the airflow direction P0*c*) in the airflow direction P1 (i.e., turning downward). The flaps 134*a*, 134*c* then turn upward at the same turning rate, while the flaps 134*b*, 134*d* turn downward at the same turning rate. At this time, the turning rate of the flaps 134*b*, 134*d* is equal to the turning rate of the flaps 134*a*, 134*c*.

By repeating such an action, when the flaps 134*a*, 134*c* both turn downward, the flaps 134*b*, 134*d* both turn upward, and the airflow direction angles of the flaps 134*b*, 134*d* simultaneously reach the airflow direction P0 with the same timing at which the airflow direction angles of the flaps 134*a*, 134*c* simultaneously reach the airflow direction P1. Conversely, when the flaps 134*a*, 134*c* both turn upward, the flaps 134*b*, 134*d* both turn downward, and the airflow direction angles of the flaps 134*b*, 134*d* simultaneously reach the airflow direction P1 with the same timing at which the airflow direction angles of the flaps 134*a*, 134*c* simultaneously reach the airflow direction P0.

For the sake of convenience in the description hereinbelow, during initial air-cooling control, the term "opposite-side swing state" is used to refer to a state in which either the flaps 134*a*, 134*c* or the flaps 134*b*, 134*d* are performing the above-described swing action (the opposite-side swing action) while being synchronously driven, and the term "horizontal blowing stationary state" is used to refer to a state in which the flaps 134*a*, 134*b*, 134*c*, 134*d* assume the horizontal blowing orientation and perform the stationary action. In the present embodiment, the optimal time duration is 16 minutes and 40 seconds.

(4) Control Action by Initial Air-Cooling Action Control Unit

Figure 39:
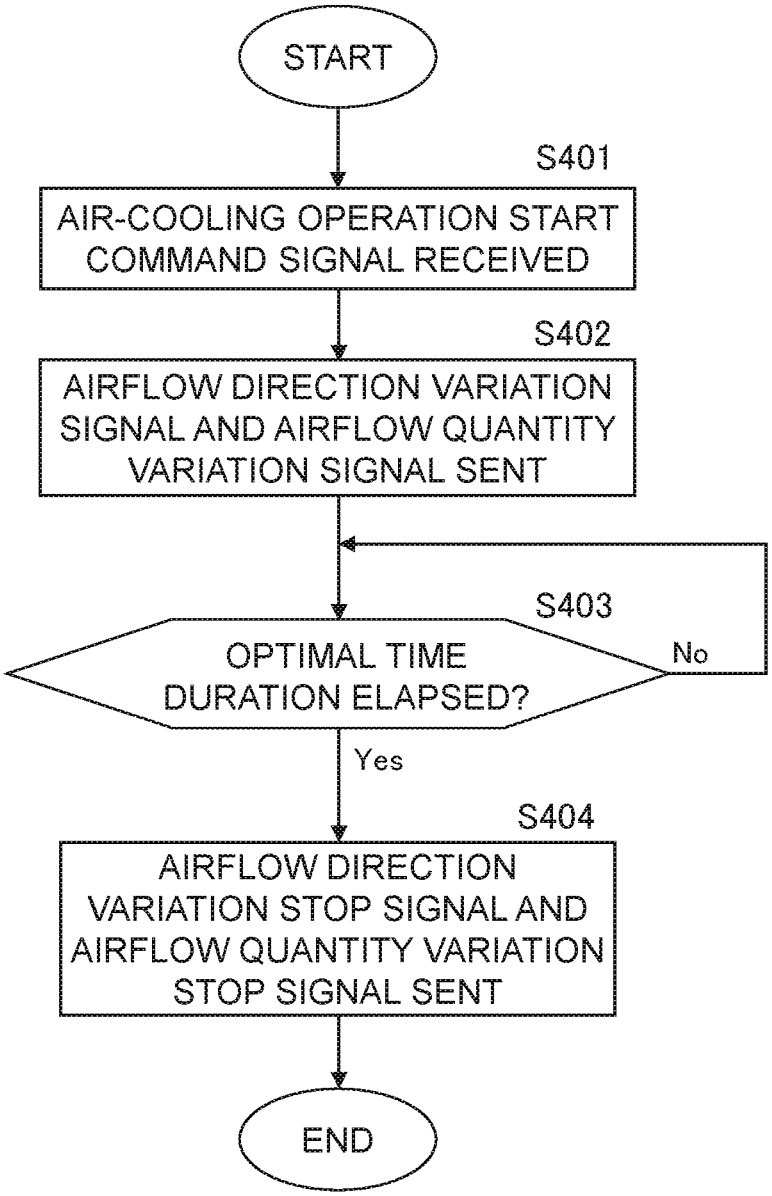
FIG. 39 is a flowchart showing the flow of the control action of the initial air-cooling action control unit.

Next, FIG. 39 is used to describe the control action by the initial air-cooling action control unit 465. As described above, the initial air-cooling action control unit 465 executes initial air-cooling control only when automatic control mode has been set by the user during the start of the air-cooling operation. Specifically, initial air-cooling control is not executed by the initial air-cooling action control unit 465 when manual control mode has been set by the user whether it be the start of the air-warming operation or the start of the air-cooling operation.

The initial air-cooling action control unit 465 starts execution of initial air-cooling control when an air-cooling operation start command signal has been received from the receiver 461 (step S401). Specifically, the initial air-cooling action control unit 465 receives an air-cooling operation start command signal sent from the receiver 461 that has received an air-cooling operation start command issued by the user in the room, and the initial air-cooling action control unit 465 thereby starts execution of initial air-cooling control.

During initial air-cooling control, the initial air-cooling action control unit 465 first sends an airflow direction variation signal pertaining to the opposite-side swing action to the airflow direction control unit 463, and sends an airflow quantity variation signal to the airflow quantity control unit 462 (step S402). Having been sent an airflow direction variation signal pertaining to the opposite-side swing action from the initial air-cooling action control unit 465, the airflow direction control unit 463 controls the drive motors 138*a*, 138*b*, 138*c*, 138*d* so that the flaps 134*a*, 134*b*, 134*c*, 134*d* go into the opposite-side swing state. Having been sent an airflow quantity variation signal from the initial air-cooling action control unit 465, the airflow quantity control unit 462 controls the rotational speed of the fan motor 132*a* so that the airflow quantity of the indoor fan 132 reaches the first airflow quantity H rather than the set airflow quantity that has been set by the user.

When the optimal time duration elapses following the sending of the airflow direction variation signal pertaining to the opposite-side swing action and the airflow quantity variation signal in step S402 (step S403), the initial air-cooling action control unit 465 sends an airflow direction variation stop signal to the airflow direction control unit 463 and sends an airflow quantity variation stop signal to the airflow quantity control unit 462 (step S404). Having been sent an airflow direction variation stop signal from the initial air-cooling action control unit 465, the airflow direction control unit 463 controls the drive motors 138*a*, 138*b*, 138*c*, 138*d* so that all of the flaps 134*a*, 134*b*, 134*c*, 134*d* go into the horizontal blowing stationary state. Having been sent an airflow direction variation stop signal from the initial air-cooling action control unit 465, the airflow quantity control unit 462 controls the fan motor 132*a* and thereby varies the airflow quantity of the indoor fan 132 from the first airflow quantity H to the set airflow quantity that has been set by the user. Initial air-cooling control by the initial air-cooling action control unit 465 is thereby ended. The initial air-cooling action control unit 465 does not send an airflow direction variation stop signal or an airflow quantity variation stop signal until the optimal time duration has elapsed following the sending of the airflow direction variation signal pertaining to the opposite-side swing action and the airflow quantity variation signal (step S403).

(5) Characteristics (5-1)

When an attempt is made to improve the user's comfort during the air-cooling operation, the objective is to make the indoor temperature distribution uniform in the shortest possible time after the air-cooling operation has started. The inventors have obtained the knowledge that in the indoor unit 130 of the air conditioning apparatus 110 having the four flaps 134*a*, 134*b*, 134*c*, 134*d*, causing all of the flaps 134*a*, 134*b*, 134*c*, 134*d* to assume the horizontal blowing orientation and perform the stationary action can make the indoor temperature distribution uniform in a shorter amount of time after the start of the air-cooling operation than causing all of the flaps 134*a*, 134*b*, 134*c*, 134*d* to perform the swing action with the same timing. Furthermore, the inventors have obtained the knowledge that from among the flaps 134*a*, 134*b*, 134*c*, 134*d*, causing two flaps (e.g., the flaps 134*a* and 134*c*) disposed opposite of each other and another two flaps (e.g., the flaps 134*b* and 134*d*) disposed opposite of each other to perform different swing actions can make the indoor temperature distribution uniform in a shorter amount of time after the start of the air-cooling operation than causing all of the flaps 134*a*, 134*b*, 134*c*, 134*d* to assume the horizontal blowing orientation and perform the stationary action.

In view of this, in the present embodiment, in the initial period during initial air-cooling control, the flaps 134*a*, 134*b*, 134*c*, 134*d* are made to perform the opposite-side swing action in which the flaps 134*a*, 134*c* and the flaps 134*b*, 134*d* start the swing action with different timings. Therefore, the amount of time needed to make the indoor temperature distribution uniform after the start of the air-cooling operation can be shortened in comparison with cases in which all of the flaps 134*a*, 134*b*, 134*c*, 134*d* are made to assume the horizontal blowing orientation and perform the stationary action, or cases in which all of the flaps 134*a*, 134*b*, 134*c*, 134*d* are made to perform the same swing action.

The comfort of the user can thereby be improved.

(5-2)

In the present embodiment, the initial air-cooling action control unit 465 sends an airflow quantity variation signal to the airflow quantity control unit 462 during initial air-cooling control so that the airflow quantity of the indoor fan 132 reaches the first airflow quantity H. Thereby, while initial air-cooling control is being performed, the rotational speed of the fan motor 132*a* is controlled so that the airflow quantity of the indoor fan 132 reaches the first airflow quantity H which is the maximum airflow quantity of the indoor fan 132. Therefore, the indoor temperature distribution can be made uniform in a shorter amount of time than in cases in which the rotational speed of the fan motor 132*a* is controlled so that the airflow quantity of the indoor fan 132 reaches the third airflow quantity L which is less than the first airflow quantity H.

(5-3)

In the present embodiment, the optimal time duration obtained experimentally in advance is employed as the length of the initial time period of initial air-cooling control, i.e., the time duration in which the opposite-side swing action is executed during initial air-cooling control. Therefore, the length of the initial time period can be set in advance in the air conditioning apparatus 110.

(5-4)

In the present embodiment, during initial air-cooling control, after the airflow quantity is brought to the first airflow quantity H and the flaps 134*a*, 134*b*, 134*c*, 134*d* are made to perform the opposite-side swing action, the opposite-side swing action of the flaps 134*a*, 134*b*, 134*c*, 134*d* is stopped, the airflow quantity is brought to the set airflow quantity, and the flaps 134*a*, 134*b*, 134*c*, 134*d* are made to assume the horizontal blowing orientation and perform the stationary action. Therefore, when the air-cooling operation has been started, for example, the time duration needed to make the indoor temperature distribution uniform can be shortened and energy can be conserved in comparison with an air conditioning apparatus in which the airflow quantity is brought to the set airflow quantity (e.g., the third airflow quantity L) and the flaps 134*a*, 134*b*, 134*c*, 134*d* assume the horizontal blowing orientation and perform the stationary action.

(6) Modifications (6-1) Modification 5A

In the embodiments described above, of the four flaps 134*a*, 134*b*, 134*c*, 134*d*, two flaps positioned at opposite sides are synchronously driven so as to swing while assuming the same orientation during initial air-cooling control.

Instead of this, during initial air-cooling control, of the four flaps 134*a*, 134*b*, 134*c*, 134*d*, two flaps disposed in adjacent positions may be synchronously driven so as to swing while assuming the same orientation.

For example, when a control signal is sent from the initial air-cooling action control unit 465, the airflow direction control unit 463 controls the drive motors 138*a*, 138*b*, 138*c*, 138*d* so that of the four flaps 134*a*, 134*b*, 134*c*, 134*d*, the two flaps 134*a*, 134*b* and the other flaps 134*c*, 134*d* swing in opposite directions of each other. At this time, the airflow direction control unit 463 performs control for changing the turning direction of the other flaps 134*c*, 134*d* at the timing at which the turning direction of the two flaps 134*a*, 134*b* changes.

Figure 40:
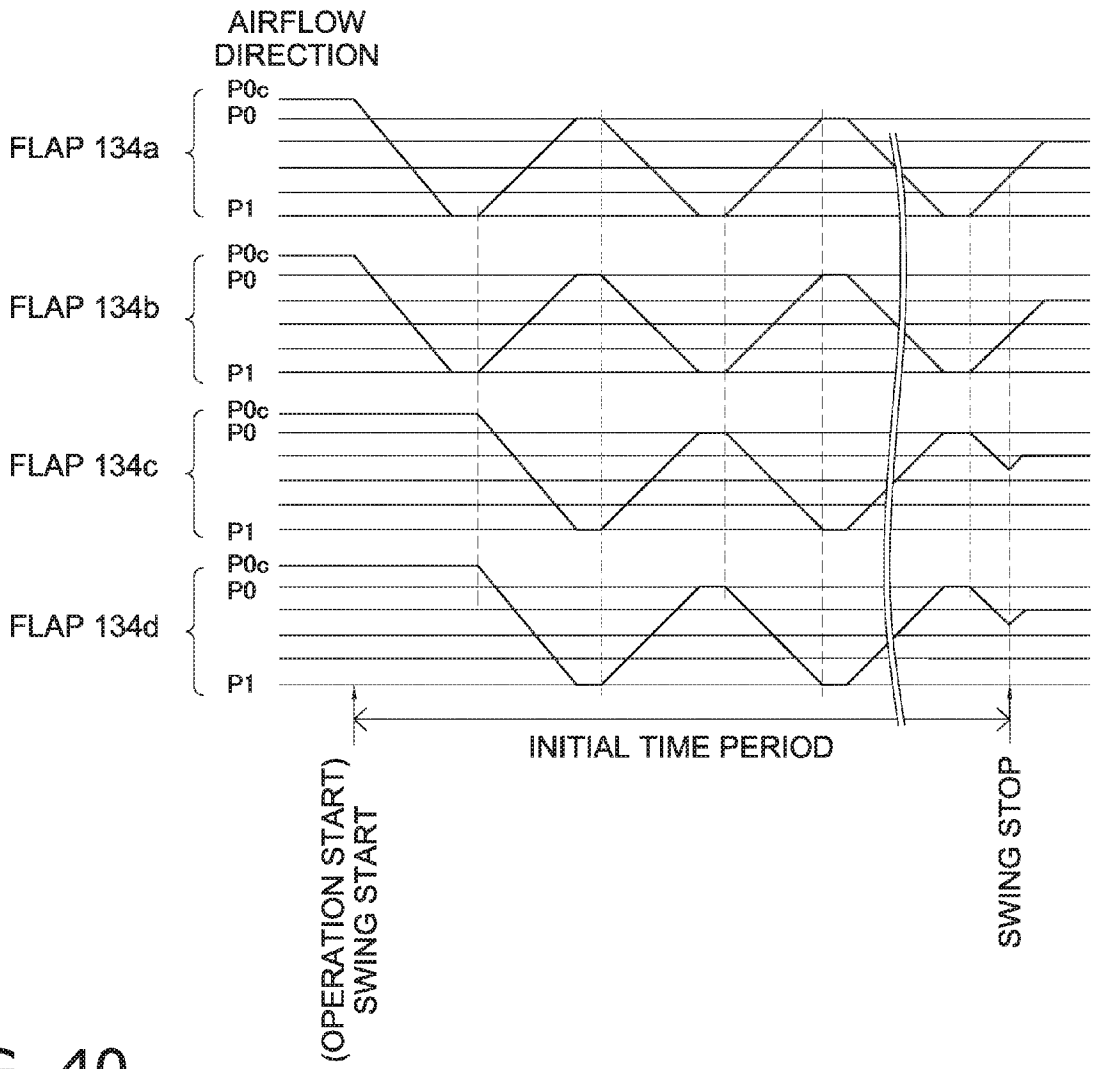
FIG. 40 is a timing chart for describing the action of the flaps according to modification 5A.

FIG. 40 is used hereinbelow to describe the orientations assumed by the flaps 134*a*, 134*b*, 134*c*, 134*d* in initial air-cooling control in the present modification. As one example, FIG. 40 shows a case in which the flap 134*a* and the flap 134*b* adjacent on either side of a discharge port 137*f* of the decorative panel 136 perform the swing action while assuming the same orientation with the same timing, and the flap 134*c* and flap 134*d* adjacent on either side of a discharge port 137*h* perform the swing action while assuming the same orientation with the same timing. However, the combinations of two flaps that perform the swing action while assuming the same orientation with the same timing is not limited to this example; the flap 134*b* and flap 134*c* adjacent on either side of a discharge port 137*g* may be synchronously driven, while the flap 134*d* and flap 134*a* adjacent on either side of a discharge port 137*e* may be synchronously driven. The flap 134*a* and the flap 134*b* herein start turning before the flap 134*c* and the flap 134*d*, but are not limited to doing so; the flap 134*c* and the flap 134*d* may start turning before the flap 134*a* and the flap 134*b*.

First, the airflow direction control unit 463 controls the driving of the drive motors 138*a*, 138*b*, whereby the flaps 134*a*, 134*b* both turn at the same turning rate in a direction of turning from a state of closing the discharge ports 137*a*, 137*b* (the airflow direction P0*c*) through the airflow direction P0 toward the airflow direction P1, i.e., downward. Therefore, the airflow direction angles of the flap 134*a* and the flap 134*b* reach the airflow direction P1 from the airflow direction P0 with the same timing. When the flaps 134*a*, 134*b* have reached the airflow direction P1, the turning direction of the flaps 134*a*, 134*b* changes from downward to upward, and with this timing, the other flaps 134*c*, 134*d* both start turning from a state of closing the discharge ports 137*c*, 137*d* (the airflow direction P0*c*) to the airflow direction P1 (i.e., turning downward). The flaps 134*a*, 134*b* turn upward at the same turning rate, while the flaps 134*c*, 134*d* turn downward at the same turning rate. At this time, the turning rate of the flaps 134*c*, 134*d* is equal to the turning rate of the flaps 134*a*, 134*b*.

By repeating such an action, when the flaps 134*a*, 134*b* both turn downward, the flaps 134*c*, 134*d* both turn upward, and the airflow direction angles of the flaps 134*c*, 134*d* simultaneously reach the airflow direction P0 with the same timing at which the airflow direction angles of the flaps 134*a*, 134*b* simultaneously reach the airflow direction P1. Conversely, when the flaps 134*a*, 134*b* both turn upward, the flaps 134*c*, 134*d* both turn downward, and the airflow direction angles of the flaps 134*c*, 134*d* simultaneously reach the airflow direction P1 with the same timing at which the airflow direction angles of the flaps 134*a*, 134*b* simultaneously reach the airflow direction P0. For the sake of convenience in the description hereinbelow, the term "opposite-side swing state" is used to refer to the state in which either the flaps 134*a*, 134*b* or the flaps 134*c*, 134*d* are performing the above-described swing action while being synchronously driven.

The inventors have obtained the following such knowledge as a result of experimental testing dealing with the effect of making the indoor temperature distribution uniform in a case of the all-synchronous swing state, which is a state of all the flaps being synchronously driven and made to perform the swing action; and a case of the opposite-side swing state, which is a state of two mutually adjacent flaps being synchronously driven and made to perform the swing action as described above; both cases being during the air-warming operation.

It was clear that when the opposite-angle swing action or the opposite-side swing action is performed, a uniform temperature distribution can be achieved in a shorter amount of time than when the all-synchronous swing action is performed. When a case of performing the all-synchronous swing action and a case of performing the opposite-angle swing action were compared in terms of the power consumed by the entire air conditioning apparatus 110 from the start of the air-warming operation in order to make the indoor temperature distribution uniform until the first air-warming thermo-off state (a state in which control is performed wherein the compressor 121 is stopped and the rotation of the indoor fan 132 is stopped due to the intake temperature Tr reaching the set temperature Trs during the air-warming operation), the consumed power in the case of performing the opposite-angle swing action was approximately 30% less than in the case of performing the all-synchronous swing action. When a case of performing the all-synchronous swing action and a case of performing the opposite-side swing action were compared in terms of the power consumed by the entire air conditioning apparatus 110 from the start of the air-warming operation in order to make the indoor temperature distribution uniform until the first air-warming thermo-off state, the consumed power in the case of performing the opposite-side swing action was approximately 40% less than in the case of performing the all-synchronous swing action. This led to obtaining the knowledge that synchronously driving flaps 134*a*, 134*b*, 134*c*, 134*d* positioned at opposite angles or opposite sides of each other as the swing action for making the indoor temperature distribution uniform consumed less power and had a higher effect of making the indoor temperature distribution uniform than synchronously driving all of the flaps 134*a*, 134*b*, 134*c*, 134*d*.

Therefore, during initial air-cooling control, in cases in which the opposite-angle swing action is performed wherein flaps disposed adjacent to each other assume the same orientation and perform the swing action with the same timing, the indoor temperature distribution can be made uniform in a shorter amount of time and a greater energy conservation effect can be expected than in cases in which the all-synchronous swing action is performed wherein all of the flaps perform the swing action synchronously.

(6-2) Modification 5B

In the embodiments described above, the indoor unit 130 provided to the air conditioning apparatus 110 is a ceiling-embedded indoor unit, but is not limited as such; the indoor unit may be a ceiling-hanging indoor unit installed with the casing hanging from the ceiling.

(6-3) Modification 5C

In the embodiments described above, in order to make the indoor temperature distribution uniform in the shortest possible time following the start of the air-cooling operation during initial air-cooling control, the flaps 134*a*, 134*b*, 134*c*, 134*d* are made to perform the opposite-side swing action and the fan motor 132*a* is controlled so that the airflow quantity of the indoor fan 132 reaches the first airflow quantity H. When initial air-cooling control ends, the opposite-side swing action of the flaps 134*a*, 134*b*, 134*c*, 134*d* is stopped, all of the flaps 134*a*, 134*b*, 134*c*, 134*d* are controlled so as to assume the horizontal blowing orientation and perform the stationary action, and the fan motor 132*a* is controlled so that the airflow quantity of the indoor fan 132 reaches the set airflow quantity from the first airflow quantity H.

Instead of this, after the indoor temperature distribution is made uniform during initial air-cooling control, additional efficient control may be performed in order to stabilize the indoor temperature.

The inventors made a comparison between the power consumed when the air-cooling operation is performed with the flaps 134*a*, 134*b*, 134*c*, 134*d* in the horizontal blowing stationary state and the airflow quantity at the first airflow quantity H, and the power consumed when the air-cooling operation is performed with the flaps 134*a*, 134*b*, 134*c*, 134*d* in the horizontal blowing stationary state and the airflow quantity in the second airflow quantity M, after the average room temperature has reached the set temperature Trs following the start of the air-cooling operation, i.e., during the stable period, under the same conditions as the evaluation testing described above. As a result, the inventors discovered that the consumed power of the first airflow quantity H is less than the consumed power of the second airflow quantity M. The reason for this is presumably that during the stable period, using the first airflow quantity H as the airflow quantity of the indoor fan 132 yields better heat exchange efficiency than does the second airflow quantity M. By focusing on this point, the inventors have obtained the knowledge that by using the first airflow quantity H as the airflow quantity from the time the flaps 134*a*, 134*b*, 134*c*, 134*d* are switched from the opposite-side swing state to the horizontal blowing stationary state until a predetermined time duration elapses during initial air-cooling control, the indoor temperature can be stabilized and the consumed power can be reduced in comparison with cases in which the set airflow quantity set by the user (e.g., the second airflow quantity M) is used as the airflow quantity at the same time that the flaps 134*a*, 134*b*, 134*c*, 134*d* are switched from the opposite-side swing state to the horizontal blowing stationary state.

Figure 41A:
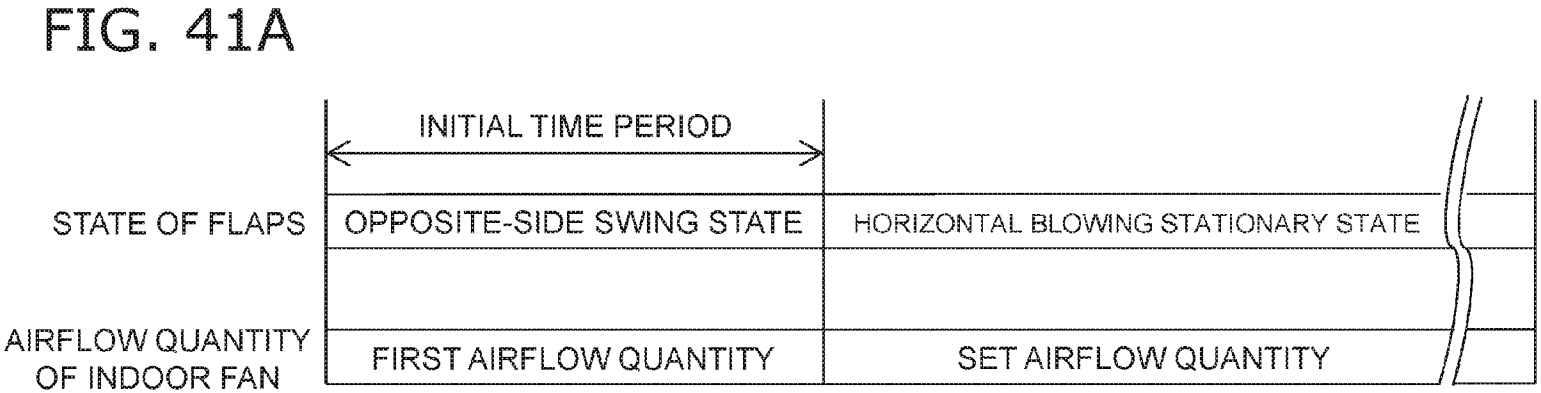
FIG. 41A shows the state of the flaps and the airflow quantity of the indoor fan during the initial time period and after the initial time period in the fifth embodiment in a chart showing the initial time period in initial air-cooling control.
Figure 41B:
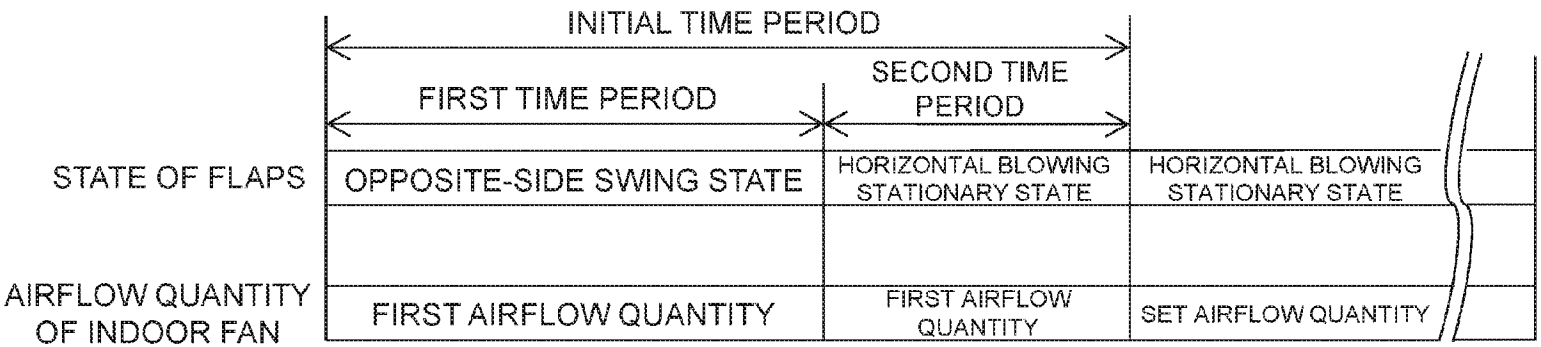
FIG. 41B shows the state of the flaps and the airflow quantity of the indoor fan during the initial time period and after the initial time period according to modification 5C in a chart showing the initial time period in initial air-cooling control.
Figure 42:
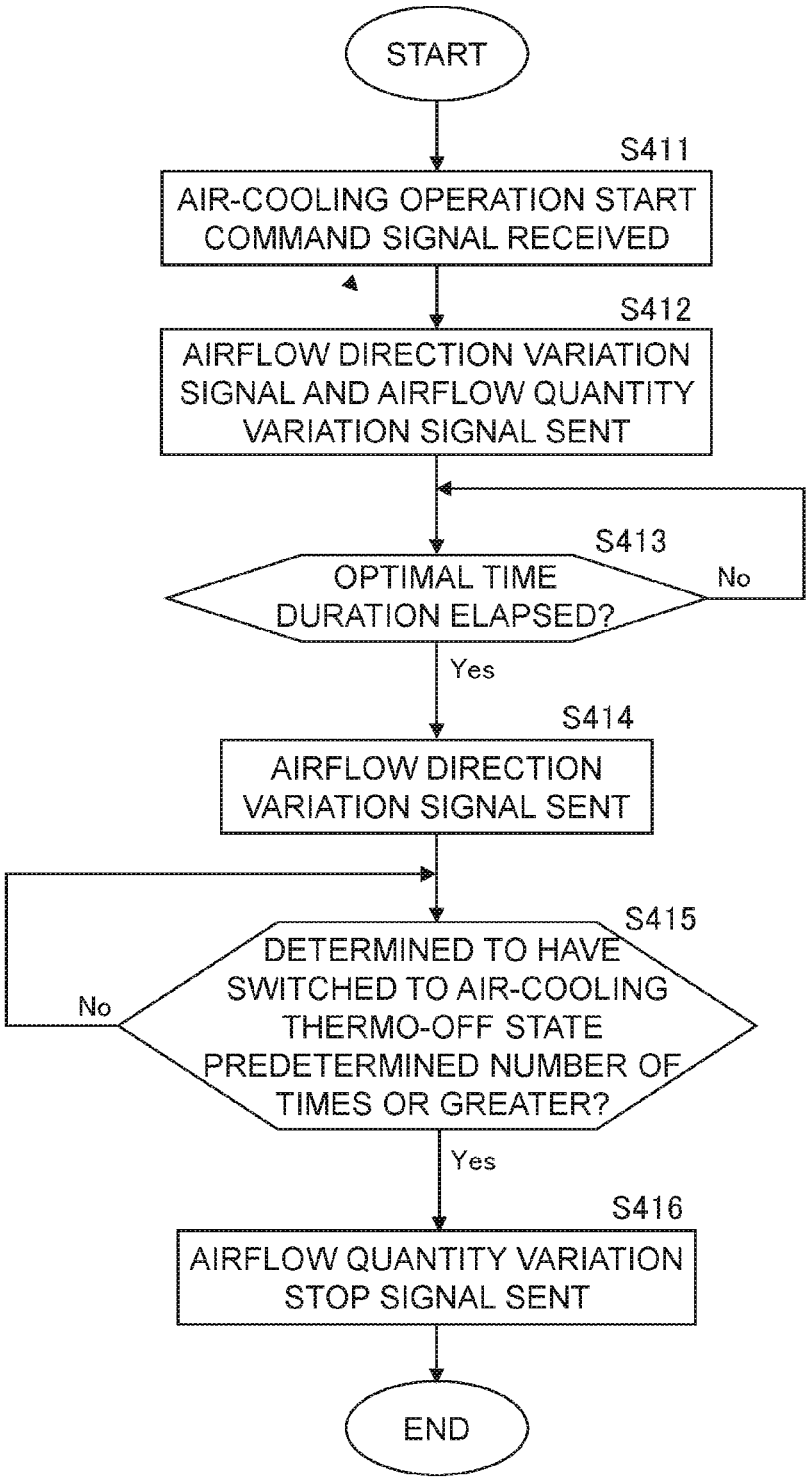
FIG. 42 is a flowchart showing the flow of the control action of the initial air-cooling action control unit according to modification 5C.

Hereinbelow, FIGS. 41 and 42 are used to describe an air conditioning apparatus 110 in which when the air-cooling operation is started, initial air-cooling control is executed wherein the first airflow quantity H is maintained after the flaps 134*a*, 134*b*, 134*c*, 134*d* are switched from the opposite-side swing state to the horizontal blowing stationary state until a predetermined time duration has elapsed. FIG. 41A is a chart showing the state of the flaps 134*a*, 134*b*, 134*c*, 134*d* and the airflow quantity of the indoor fan 132 during the initial time period and after the initial time period in the embodiments described above, and FIG. 41B is a chart showing the state of the flaps 134*a*, 134*b*, 134*c*, 134*d* and the airflow quantity of the indoor fan 132 during the initial time period and after the initial time period in the present modification. In FIG. 41B, for the sake of convenience in the description, the initial time period during which initial air-cooling control is performed is divided into a first time period during which the opposite-side swing action is performed by the flaps 134*a*, 134*b*, 134*c*, 134*d*, and a second time period during which the stationary action is performed. The first time period is a time period equivalent to the initial time period of the embodiments described above, and is the time period from the time the air-cooling operation is started until the elapse of the optimal time duration obtained experimentally in advance. The second time period, which follows the first time period, is the time period after the optimal time duration elapses until the number of switches between the air-cooling thermo-on state and the air-cooling thermo-off state reaches a predetermined number (e.g., 2 or 3) or greater. Furthermore, in the present modification, the determination of whether or not the air-cooling thermo-on state has switched to the air-cooling thermo-off state is made by the initial air-cooling action control unit 465.

Next is a description of the control action by the initial air-cooling action control unit 465 in the present modification (see FIG. 42).

When the initial air-cooling action control unit 465 receives the air-cooling operation start command signal sent from the receiver 461 (step S411), execution of initial air-cooling control is started. Specifically, the initial air-cooling action control unit 465 receives the air-cooling operation start command signal issued by the user in the room and sent from the receiver 461 that has received the air-cooling operation start command, whereby the initial air-cooling action control unit 465 starts execution of initial air-cooling control.

During initial air-cooling control, the initial air-cooling action control unit 465 first sends an airflow direction variation signal pertaining to the opposite-side swing action to the airflow direction control unit 463, and sends an airflow quantity variation signal to the airflow quantity control unit 462 (step S412). Having been sent an airflow direction variation signal pertaining to the opposite-side swing action from the initial air-cooling action control unit 465, the airflow direction control unit 463 controls the drive motors 138*a*, 138*b*, 138*c*, 138*d* so that the flaps 134*a*, 134*b*, 134*c*, 134*d* go into the opposite-side swing state. Having been sent an airflow quantity variation signal from the initial air-cooling action control unit 465, the airflow quantity control unit 462 controls the rotational speed of the fan motor 132*a* so that the airflow quantity of the indoor fan 132 reaches the first airflow quantity H rather than the set airflow quantity set by the user.

When the optimal time duration elapses following the sending of the airflow direction variation signal pertaining to the opposite-side swing action and the airflow quantity variation signal in step S412 (step S413), the initial air-cooling action control unit 465 sends an airflow direction variation signal pertaining to the stationary action in the horizontal blowing orientation to the airflow direction control unit 463 (step S414). Having been sent an airflow direction variation signal pertaining to the stationary action in the horizontal blowing orientation from the initial air-cooling action control unit 465, the airflow direction control unit 463 controls the drive motors 138*a*, 138*b*, 138*c*, 138*d* so that all of the flaps 134*a*, 134*b*, 134*c*, 134*d* go into the horizontal blowing stationary state. The flaps 134*a*, 134*b*, 134*c*, 134*d* are thereby switched from the swing state in which the airflow direction is automatically varied to the horizontal blowing stationary state in which the airflow direction is maintained at the airflow direction P0. The initial air-cooling action control unit 465 does not send an airflow direction variation signal pertaining to the stationary action in the horizontal blowing orientation to the airflow direction control unit 463 until the optimal time duration has elapsed following the sending of the airflow direction variation signal pertaining to the opposite-side swing action and the airflow quantity variation signal.

After the airflow direction variation signal pertaining to the stationary action in the horizontal blowing orientation has been sent in step S414, when it is determined that the air-cooling thermo-on state has switched to the air-cooling thermo-off state a predetermined number of times (e.g., 2 times) or greater (step S415), the initial air-cooling action control unit 465 sends an airflow quantity variation stop signal to the airflow quantity control unit 462 (step S416). Having been sent an airflow quantity variation stop signal from the initial air-cooling action control unit 465, the airflow quantity control unit 462 controls the fan motor 132*a* and thereby varies the airflow quantity of the indoor fan 132 from the first airflow quantity H to the set airflow quantity that has been set by the user. Initial air-cooling control by the initial air-cooling action control unit 465 is thereby ended. After sending an airflow direction variation signal pertaining to the stationary action in the horizontal blowing orientation in step S415, the initial air-cooling action control unit 465 does not send an airflow quantity variation stop signal to the airflow quantity control unit 462 until it is determined that the air-cooling thermo-on state has switched to the air-cooling thermo-off state a predetermined number of times (e.g., 2 times) or greater.

Thus, due to the flaps 134*a*, 134*b*, 134*c*, 134*d* being switched from the opposite-side swing state to the horizontal blowing stationary state, cold air can be hindered from accumulating near the floor of the room after the air-cooling operation has been started and the indoor temperature distribution has been made uniform. Due to the fan motor 132*a* being controlled during initial air-cooling control so that the airflow quantity is the first airflow quantity H from the time the flaps 134*a*. 134*b*, 134*c*. 134*d* are switched from the opposite-side swing state to the horizontal blowing stationary state until a predetermined time duration elapses, the power consumed in the air conditioning apparatus 110 can be reduced in comparison with cases in which the fan motor 132*a* is controlled so that the airflow quantity reaches the second airflow quantity M at the same time that the flaps 134*a*, 134*b*, 134*c*, 134*d* are switched from the opposite-side swing state to the horizontal blowing stationary state, for example.

(6-4) Modification 5D

In the embodiments described above, the length of the initial time period, which is the time period during which initial air-cooling control is executed, is set to the optimal time duration obtained experimentally in advance.

Instead of this, the length of the initial time period may be decided according to the indoor environment where the indoor unit 130 is installed. For example, the length of the initial time period may be decided by learning past operation records.

From the results of the evaluation testing described above, the inventors have discovered that the point in time when 16 minutes and 40 seconds elapse following the start of the air-cooling operation in the opposite-side swing state substantially coincides with the point in time when the air-cooling thermo-on state first switches to the air-cooling thermo-off state following the start of the air-cooling operation in the horizontal blowing stationary state. Therefore, the inventors have obtained the knowledge that the continuous time duration for executing the opposite-side swing action suited to the room where the indoor unit 130 is installed, i.e., the length of the initial time period can be decided from the time duration needed for the air-cooling thermo-on state to switch to the air-cooling thermo-off state after the air-cooling operation is started in the horizontal blowing stationary state.

Hereinbelow is a description of an air conditioning apparatus 110 in which the length of the initial time period, i.e., the time duration during which the opposite-side swing action is performed (the time duration equivalent to the optimal time duration in the embodiments described above) during initial air-cooling control is decided based on past operation records. In the present modification, since configurations other than a control unit 560 are identical to those of the embodiments described above, configurations other than the control unit 560 are described using the same symbols as the embodiments described above.

Figure 43:
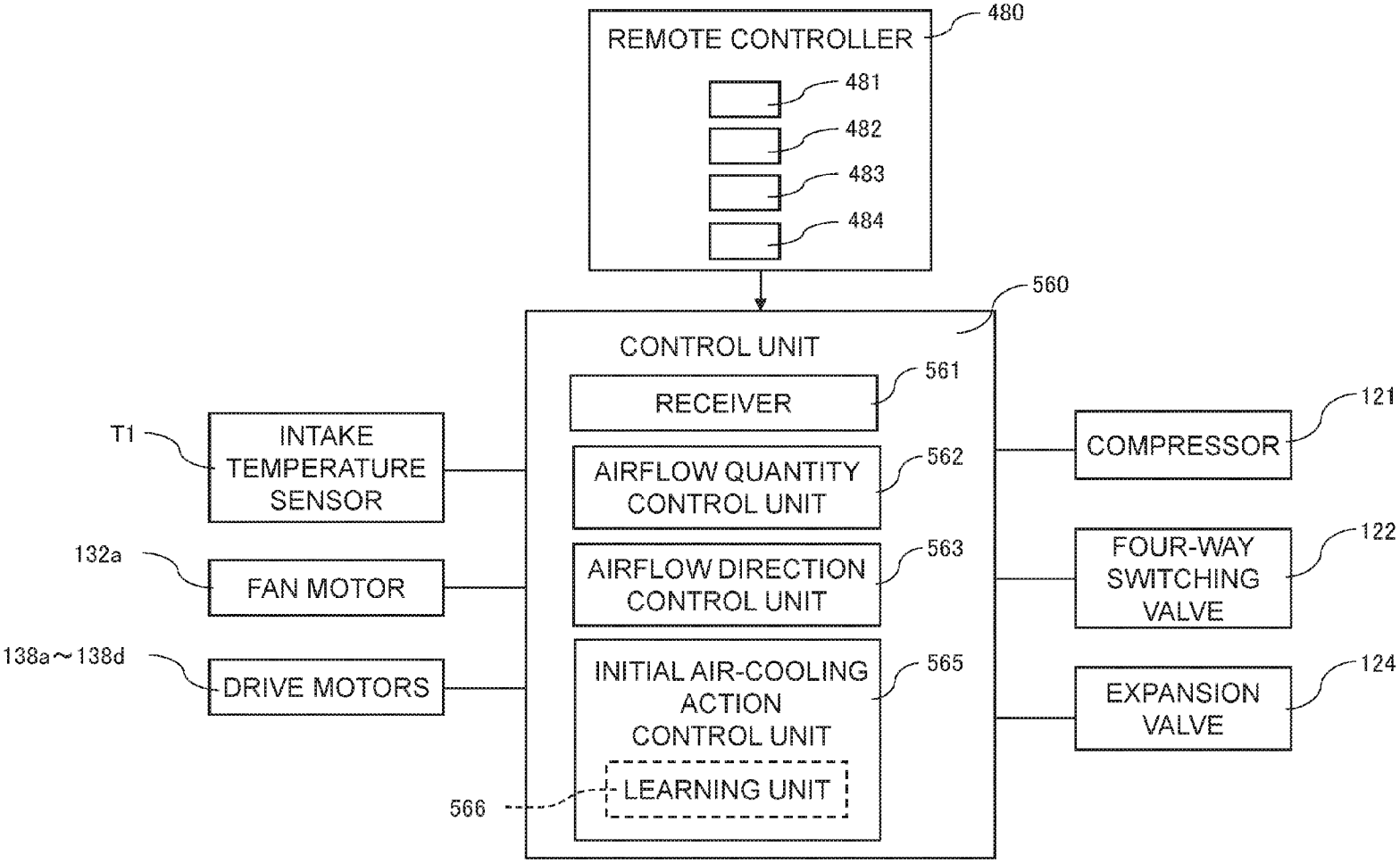
FIG. 43 is a control block diagram of the control unit of the air conditioning apparatus according to modification 5D.

The control unit 560 is a microcomputer comprising a CPU and memory, and the control unit controls the actions of the various devices of the indoor unit 130 and the outdoor unit 120. The control unit 560 comprises a receiver 561, an airflow quantity control unit 562, an airflow direction control unit 563, and an initial air-cooling action control unit 565, as shown in FIG. 43. The configurations of the receiver 561, the airflow quantity control unit 562, and the airflow direction control unit 563 are identical to those of the embodiments described above and are therefore not described.

The initial air-cooling action control unit 565 executes initial air-cooling control at the start of the air-cooling operation. The initial air-cooling action control unit 565 also executes initial air-cooling control when automatic control mode has been set by the user. Furthermore, the initial air-cooling action control unit 565 has a learning unit 566 for deciding a learning operation time duration, which is the opposite-side swing action's executed time duration during initial air-cooling control (the length of the initial time period), by learning past operation records.

The initial air-cooling action control unit 565 determines whether or not learning by the learning unit 566 is needed when an air-cooling operation start command signal is sent from the receiver 561. The initial air-cooling action control unit 565 counts from the time the learning operation time duration is decided by the learning unit 566 and determines that the learning unit 566 needs to decide a learning operation time duration when the number of switches between the air-cooling thermo-on state and the air-cooling thermo-off state is a predetermined number (e.g., 30) or greater. In other words, the initial air-cooling action control unit 565 counts from the time the learning operation time duration is decided by the learning unit 566 and determines that the learning unit 566 does not need to decide a learning operation time duration when the number of switches between the air-cooling thermo-on state and the air-cooling thermo-off state is less than a predetermined number. When learning by the learning unit 566 is determined to not be necessary, initial air-cooling control is started.

During initial air-cooling control, the initial air-cooling action control unit 565 first sends control signals to the airflow direction control unit 563 and the airflow quantity control unit 562 so that the flaps 134*a*, 134*b*, 134*c*, 134*d* start the opposite-side swing action and the airflow quantity of the indoor fan 132 reaches the first airflow quantity H. Next, when the learning operation time duration decided by the learning unit 566 has elapsed after the air-cooling operation has started, the initial air-cooling action control unit 565 sends a control signal to the airflow direction control unit 563 so that the opposite-side swing action of the flaps 134*a*, 134*b*, 134*c*, 134*d* is stopped and all of the flaps 134*a*, 134*b*, 134*c*, 134*d* assume the horizontal blowing orientation and start the stationary action, and sends a control signal to the airflow quantity control unit 562 so that the airflow quantity of the indoor fan 132 shifts from the first airflow quantity H to the set airflow quantity that has been set by the user, thereby ending initial air-cooling control.

Upon being sent a control signal from the initial air-cooling action control unit 565, the airflow direction control unit 563 controls the drive motors 138*a*, 138*b*, 138*c*, 138*d* so that of the four flaps 134*a*, 134*b*, 134*c*, 134*d*, two flaps (e.g., the flaps 134*a* and 134*c*) and the other flaps (e.g., 134*b* and 134*d*) perform the swing action in opposite directions of each other.

The learning unit 566 decides a learning operation time duration when the initial air-cooling action control unit 565 has determined that a learning operation time duration needs to be decided. The learning operation time duration is stored in a storage unit (not shown) each time it is determined by the learning unit 566.

When the air-cooling operation is performed with all of the flaps 134*a*, 134*b*, 134*c*, 134*d* in the horizontal blowing stationary state, the learning unit 566 measures the time duration during which the air-cooling thermo-on state continues, i.e., the air-cooling thermo-on continuous time duration from the start of the air-cooling operation until the air-cooling thermo-off state, and uses the measured air-cooling thermo-on continuous time duration to decide the learning operation time duration.

The initial air-cooling action control unit 565 determines whether or not a learning operation time duration needs to be decided by the learning unit 566 and a learning operation time duration is decided by the learning unit 566 based on this determination, but the learning operation time duration is not limited as such and another option is that it be decided by the learning unit 566 only during a test operation performed when the indoor unit 130 is installed in the room. Another option, for example, is for the initial air-cooling action control unit 565 to determine that the learning operation time duration needs to be decided by the learning unit 566 at a preset time (e.g., 13:00). Yet another option, for example, is for the initial air-cooling action control unit 565 to determine that a learning operation time duration needs to be decided by the learning unit 566 when a predetermined time duration (e.g., 24 hours) has elapsed since the last time a learning operation time duration was decided by the learning unit 566.

Figure 44:
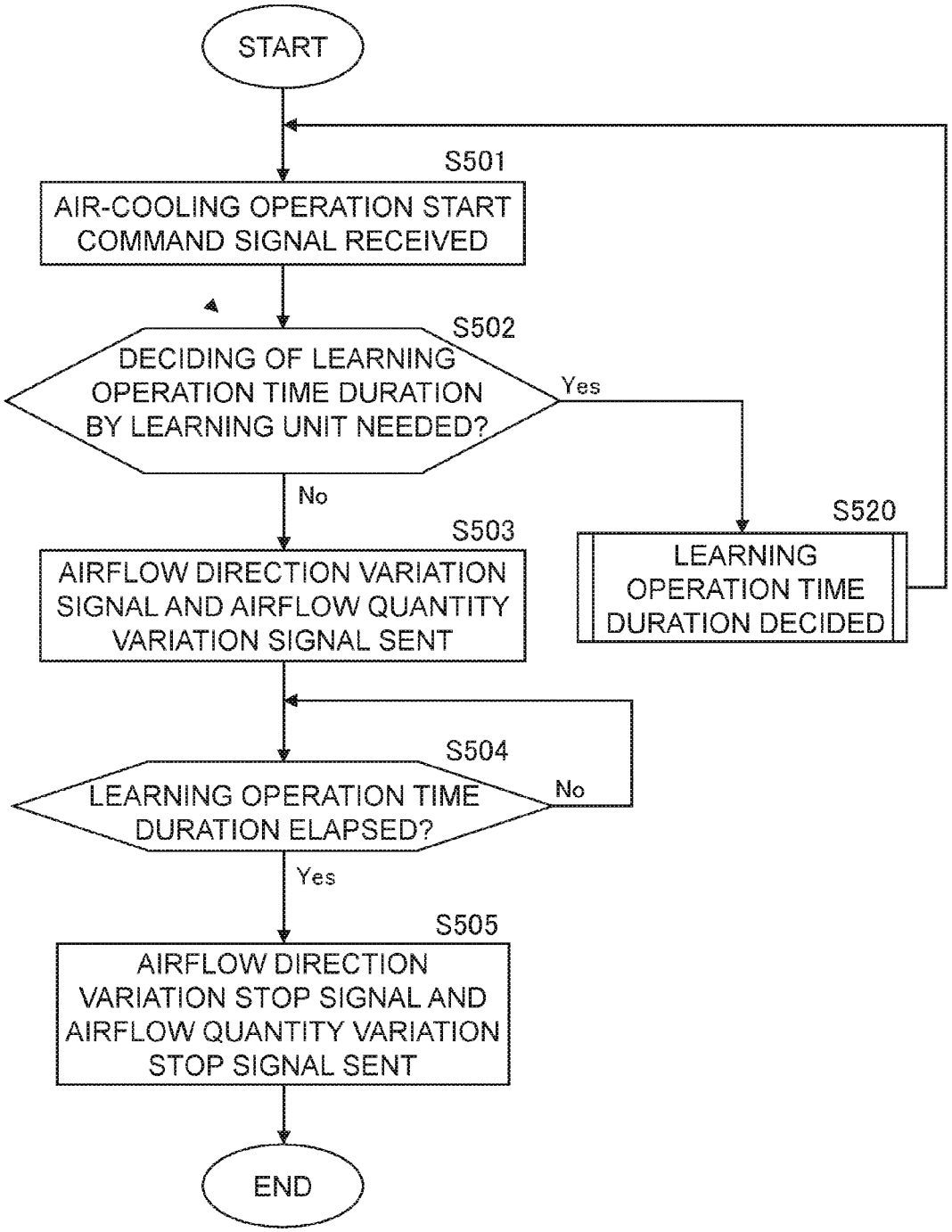
FIG. 44 is a flowchart showing the flow of the control action of the initial air-cooling action control unit according to modification 5D.
Figure 45:
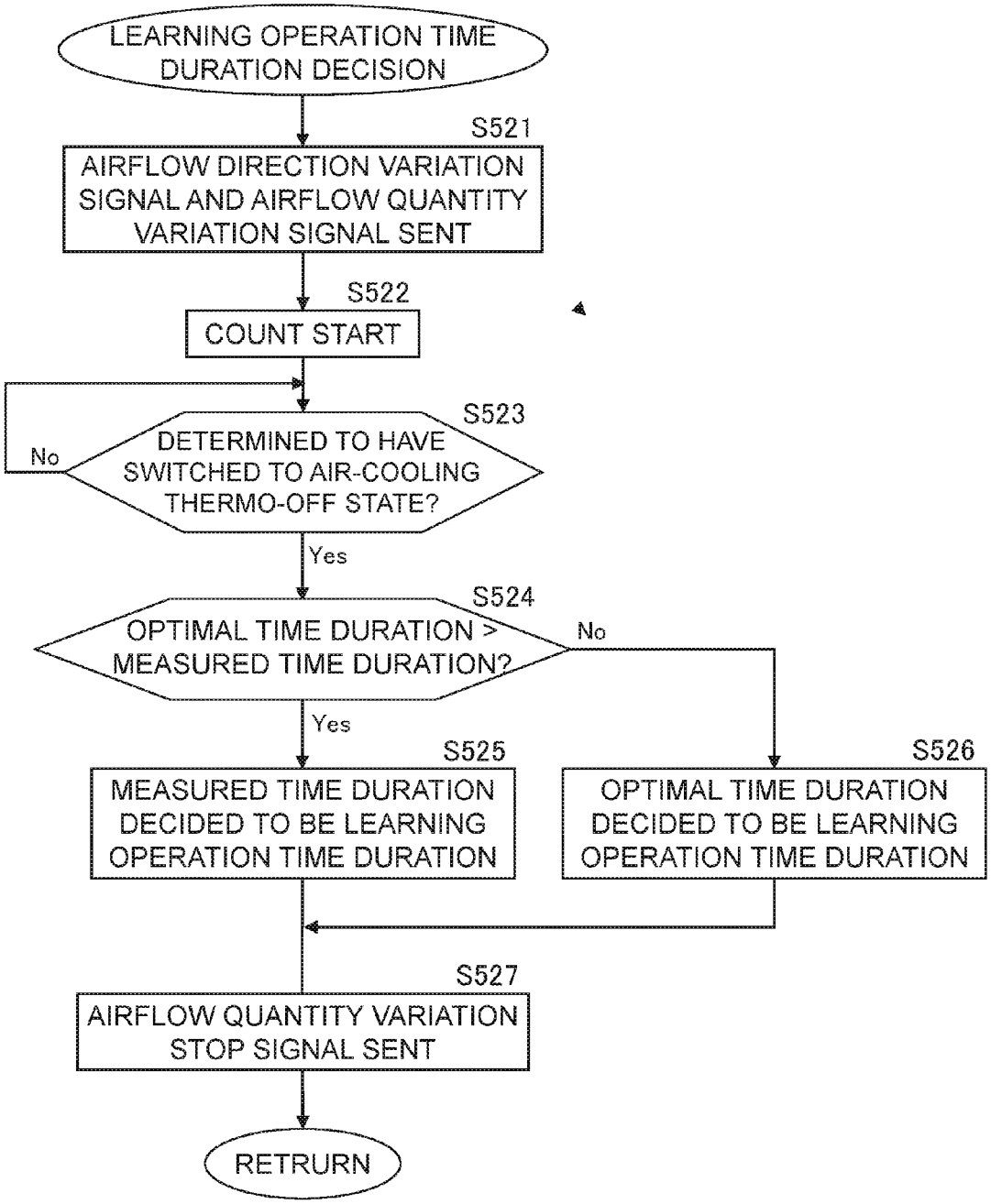
FIG. 45 is a flowchart showing the flow of the learning operation time duration decision by the learning unit according to modification 5D.

Next, FIGS. 44 and 45 are used to describe the control action by the initial air-cooling action control unit 565. As described above, the initial air-cooling action control unit 565 executes initial air-cooling control only when automatic control mode has been set by the user during the start of the air-cooling operation. Specifically, initial air-cooling control is not executed by the initial air-cooling action control unit 565 when manual control mode has been set by the user whether it be the start of the air-warming operation or the start of the air-cooling operation.

Upon receiving the air-cooling operation start command signal sent from the receiver 561 (step S501), the initial air-cooling action control unit 565 determines whether or not a learning operation time duration needs to be decided by the learning unit 566 (step S502). Specifically, the initial air-cooling action control unit 565 receives an air-cooling operation start command signal sent from the receiver 561 that has received an air-cooling operation start command issued by the user in the room, and the initial air-cooling action control unit 565 thereby determines whether or not a learning operation time duration needs to be decided by the learning unit 566.

When the initial air-cooling action control unit 565 has determined that a learning operation time duration needs to be decided, the learning unit 566 determines a learning operation time duration (step S520). Specifically, the learning unit 566 sends an airflow direction variation signal pertaining to the stationary action in the horizontal blowing orientation to the airflow direction control unit 563, and sends an airflow quantity variation signal to the airflow quantity control unit 562 (step S521). The learning unit 566 starts the count of a timer (not shown) (step S522) at the same time the airflow direction variation signal pertaining to the stationary action in the horizontal blowing orientation and the airflow quantity variation signal are sent. Having been sent an airflow direction variation signal pertaining to the stationary action in the horizontal blowing orientation from the initial air-cooling action control unit 565, the airflow direction control unit 563 controls the drive motors 138*a*, 138*b*, 138*c*, 138*d* so that the flaps 134*a*, 134*b*, 134*c*, 134*d* go into the horizontal blowing stationary state. Having been sent an airflow quantity variation signal from the initial air-cooling action control unit 565, the airflow quantity control unit 562 controls the rotational speed of the fan motor 132*a* so that the airflow quantity of the indoor fan 132 reaches the first airflow quantity H rather than the set airflow quantity that has been set by the user. After the airflow direction variation signal pertaining to the stationary action in the horizontal blowing orientation and the airflow quantity variation signal have been sent, when the air-cooling thermo-on state is determined to have switched to the air-cooling thermo-off state (step S523), the learning unit 566 compares the air-cooling thermo-on continuous time duration measured by the timer and the time duration (e.g., 16 minutes and 40 seconds) set in advance as the optimal time duration (step S524). When the result of comparing the time duration measured by the timer and the optimal time duration in step S524 is that the time duration measured by the timer is shorter than the optimal time duration, the learning unit 566 decides the measured time duration to be the learning operation time duration (step S525). When the result of comparing the time duration measured by the timer and the optimal time duration in step S524 is that the time duration measured by the timer is longer than the optimal time duration, the learning unit 566 decides the optimal time duration set in advance to be the learning operation time duration (step S526). The learning operation time duration is thereby decided by the learning unit 566. After deciding the learning operation time duration, the learning unit 566 sends an airflow quantity variation stop signal to the airflow quantity control unit 562 (step S527).

The initial air-cooling action control unit 565 starts initial air-cooling control upon determining that a learning operation time duration does not need to be decided by the learning unit 566 in step S502. Specifically, the initial air-cooling action control unit 565 sends an airflow direction variation signal pertaining to the opposite-side swing action to the airflow direction control unit 563, and sends an airflow quantity variation signal to the airflow quantity control unit 562 (step S503). Having been sent an airflow direction variation signal pertaining to the opposite-side swing action from the initial air-cooling action control unit 565, the airflow direction control unit 563 controls the drive motors 138*a*, 138*b*, 138*c*, 138*d* so that the flaps 134*a*, 134*b*, 134*c*, 134*d* go into the opposite-side swing state. Having been sent an airflow quantity variation signal from the initial air-cooling action control unit 565, the airflow quantity control unit 562 controls the rotational speed of the fan motor 132*a* so that the airflow quantity of the indoor fan 132 reaches the first airflow quantity H rather than the set airflow quantity that has been set by the user.

After the airflow direction variation signal pertaining to the opposite-side swing action and the airflow quantity variation signal are sent in step S503, when the learning operation time duration decided by the learning unit 566 has elapsed (step S504), the initial air-cooling action control unit 565 sends an airflow direction variation stop signal to the airflow direction control unit 563 and sends an airflow quantity variation stop signal to the airflow quantity control unit 562 (step S505). Having been sent an airflow direction variation stop signal from the initial air-cooling action control unit 565, the airflow direction control unit 563 controls the drive motors 138*a*, 138*b*, 138*c*, 138*d* so that all of the flaps 134*a*, 134*b*, 134*c*, 134*d* go into the horizontal blowing stationary state. Having been sent an airflow direction variation stop signal from the initial air-cooling action control unit 565, the airflow quantity control unit 562 controls the fan motor 132*a* and thereby varies the airflow quantity of the indoor fan 132 from the first airflow quantity H to the set airflow quantity that has been set by the user. Initial air-cooling control by the initial air-cooling action control unit 565 is thereby ended. The initial air-cooling action control unit 565 does not send an airflow direction variation stop signal or an airflow quantity variation stop signal until the learning operation time duration has elapsed following the sending of the airflow direction variation signal pertaining to the opposite-side swing action and the airflow quantity variation signal (step S504).

Thus, the learning operation time duration, which is the length of the initial time period, is decided using the time duration measured in advance (the time duration during which the air-cooling thermo-on state continues as measured by the timer), and a time duration for executing the opposite-side swing action suited to the environment of the room where the indoor unit 130 is installed can therefore be decided in comparison with cases in which the length of the initial time period is set in advance, for example.

In the present modification, the learning unit 566 compares the air-cooling thermo-on continuous time duration measured by the timer with the time duration set in advance as the optimal time duration (e.g., 16 minutes and 40 seconds) and decides either of these time durations to be the learning operation time duration, but the object of comparison with the optimal time duration to decide the learning operation time duration is not limited to this option.

From the results of the evaluation testing described above, the inventors have discovered that in the embodiments described above, 16 minutes and 40 seconds, the continuous time duration of executing the opposite-side swing action (the optimal time duration), substantially coincides with approximately 60% of the time duration (the period of making the temperature distribution uniform) needed for the average room temperature to reach the set temperature Trs after the air-cooling operation has been started in the horizontal blowing stationary state. Therefore, by focusing on this point, the inventors have obtained the knowledge that the object of comparison with the time duration set in advance as the optimal time duration to decide the learning operation time duration can be a time duration of 60% or more (60% to 100%) of the air-cooling thermo-on continuous time duration measured by the timer. For example, in step S542 of the present modification, the optimal time duration is compared with a time duration obtained by multiplying 0.6 by the time duration measured by the timer (time duration measured by timer×0.6), and as a result, when the time duration obtained by multiplying 0.6 by the time duration measured by the timer is shorter than the optimal time duration, the learning unit 566 decides the time duration obtained by multiplying 0.6 by the time duration measured by the timer to be the learning operation time duration. In step S524, when the result of comparing the optimal time duration and the time duration obtained by multiplying 0.6 by the time duration measured by the timer is that the time duration obtained by multiplying 0.6 by the time duration measured by the timer is longer than the optimal time duration, the learning unit 566 decides the optimal time duration set in advance to be the learning operation time duration. In this manner, the learning operation time duration may be decided by the learning unit 566.

(6-5) Modification 5E

Figure 46:
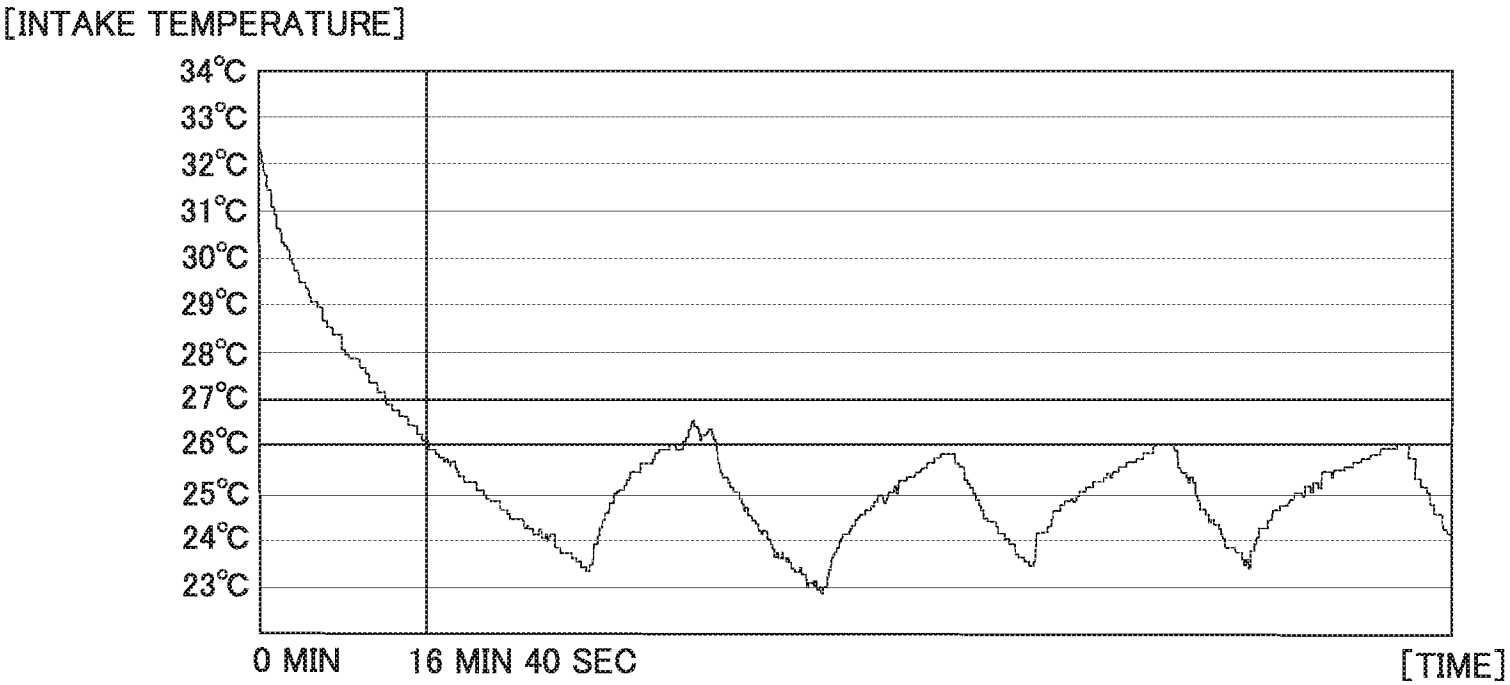
FIG. 46 is a graph showing the transition in the temperature change when the air conditioning apparatus performs the air-cooling operation with the flaps of the indoor unit installed in the test room in the opposite-side swing state in modification 5E.

FIG. 46 shows the transition in the temperature change when the air conditioning apparatus 110 performs the air-cooling operation with the flaps 134*a*, 134*b*, 134*c*, 134*d* of the indoor unit 130 installed in the test room in the opposite-side swing state.

In the embodiments described above, the point in time of the end of the initial time period, which is the time period during which initial air-cooling control is executed, is set to the point in time when the optimal time duration obtained experimentally in advance elapses after the start of the air-cooling operation.

From the results of the intake temperature Tr detected by the intake temperature sensor T1 when the air-cooling operation was started in the opposite-side swing state under the same conditions as the evaluation testing described above, the inventors discovered that the timing at which 16 minutes and 40 seconds elapse after the start of the air-cooling operation in the opposite-side swing state substantially coincides with the timing at which the intake temperature Tr falls to one degree lower than the set temperature Trs (Trs−1) (see FIG. 46). By focusing on this point, the inventors have obtained the knowledge that the detection results from the intake temperature Tr can be used as alternative means for deciding the ending time point of the initial time period.

Hereinbelow is a description of an air conditioning apparatus 110 in which the time duration during which the opposite-side swing action is executed (a time duration equivalent to the optimal time duration in the embodiments described above) is decided from the intake temperature Tr and the set temperature Trs during initial air-cooling control. In the present modification, configurations other than a control unit 660 are identical to those of the embodiments described above, and configurations other than the control unit 660 are therefore described using the same symbols as the embodiments described above.

Figure 47:
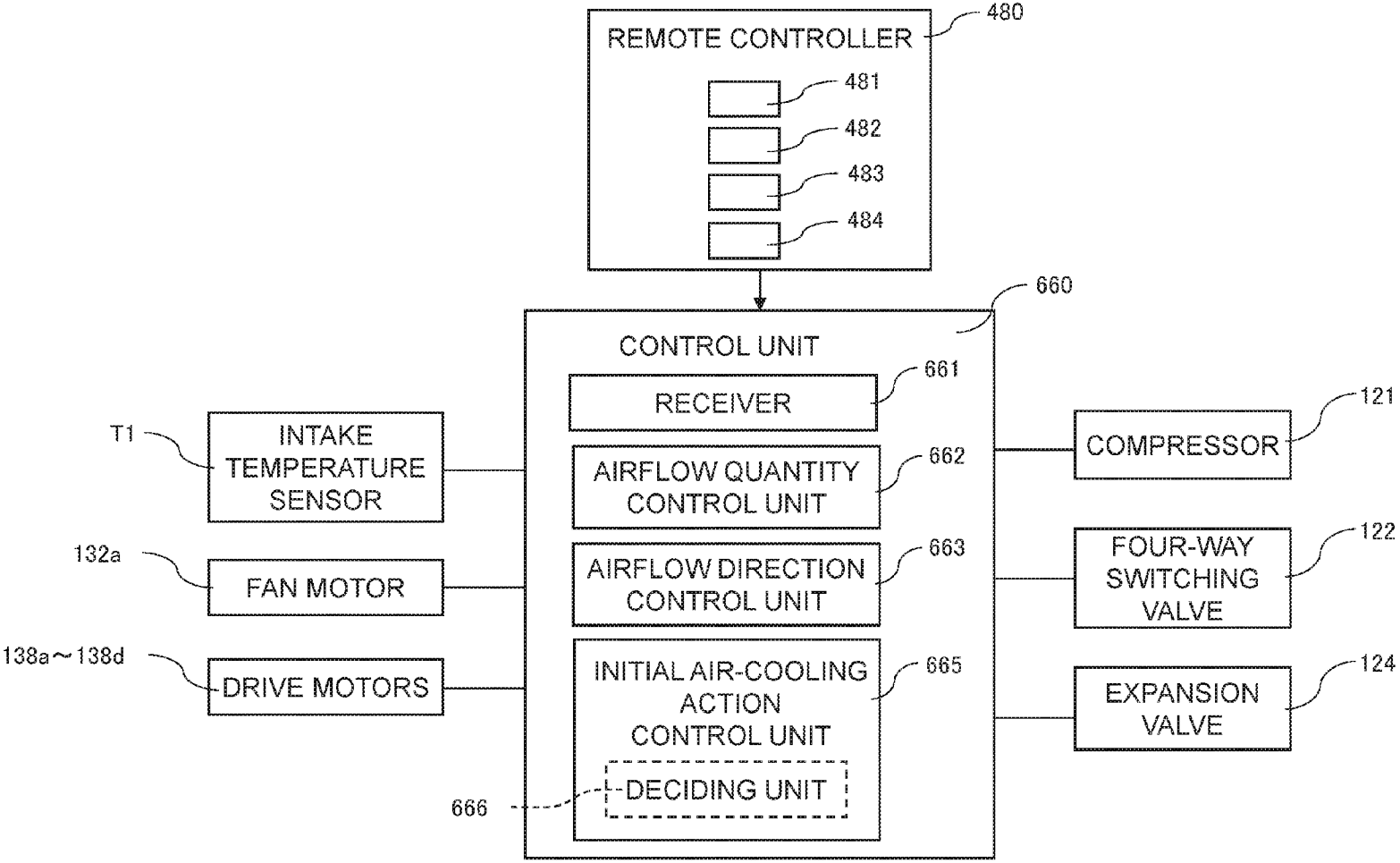
FIG. 47 is a control block diagram of the control unit of the air conditioning apparatus according to modification 5E.

The control unit 660 is a microcomputer comprising a CPU and memory, and the control unit controls the actions of the various devices of the indoor unit 130 and the outdoor unit 120. The control unit 660 comprises a receiver 661, an airflow quantity control unit 662, an airflow direction control unit 663, and an initial air-cooling action control unit 665, as shown in FIG. 47. The configurations of the receiver 661, the airflow quantity control unit 662, and the airflow direction control unit 663 are identical to those of the embodiments described above and are therefore not described.

The initial air-cooling action control unit 665 executes initial air-cooling control at the start of the air-cooling operation. The initial air-cooling action control unit 665 also executes initial air-cooling control when automatic control mode has been set. Furthermore, the initial air-cooling action control unit 665 has a deciding unit 666 for deciding a timing at which the opposite-side swing action by the flaps 134*a*, 134*b*, 134*c*, 134*d* is stopped during initial air-cooling control.

Based on the intake temperature Tr sent from the intake temperature sensor T1 and the set temperature Trs set in advance by the user, the deciding unit 666 decides the timing at which the opposite-side swing action is stopped during initial air-cooling control. Specifically, the deciding unit 666 judges that the indoor temperature distribution has been made uniform when the intake temperature Tr is equal to or less than a value of one degree subtracted from the set temperature Trs (Tr≤Trs−1). The deciding unit 666 then decides that the time at which the indoor temperature distribution is judged to have been made uniform is the timing at which the opposite-side swing action is stopped, i.e., the ending time point of the initial time period. The deciding unit 666 judges that the indoor temperature distribution is not uniform when the intake temperature Tr is higher than a value of one degree subtracted from the set temperature Trs (Tr>Trs−1). The judgment by the deciding unit 666 of whether or not the indoor temperature distribution has been made uniform is made at intervals of a predetermined time duration (e.g., 20 seconds) until the ending time point of the initial time period is decided after the start of the air-cooling operation, i.e., until the indoor temperature distribution is judged to have been made uniform.

During initial air-cooling control, the initial air-cooling action control unit 665 first sends control signals to the airflow direction control unit 663 and the airflow quantity control unit 662 so that the flaps 134*a*, 134*b*, 134*c*, 134*d* start the opposite-side swing action and the airflow quantity of the indoor fan 132 reaches the first airflow quantity H. When the indoor temperature distribution is judged to have been made uniform by the deciding unit 666 after the start of the air-cooling operation, the initial air-cooling action control unit 665 sends a control signal to the airflow direction control unit 663 so that the flaps 134*a*, 134*b*, 134*c*, 134*d* stop the opposite-side swing action and all of the flaps 134*a*, 134*b*, 134*c*, 134*d* assume the horizontal blowing orientation and start the stationary action, and also sends a control signal to the airflow quantity control unit 662 so that the airflow quantity of the indoor fan 132 shifts from the first airflow quantity H to the set airflow quantity that has been set by the user, thereby ending initial air-cooling control.

When the control signal is sent from the initial air-cooling action control unit 665, similar to the embodiments described above, the airflow direction control unit 663 controls the drive motors 138*a*, 138*b*, 138*c*, 138*d* so that of the four flaps 134*a*, 134*b*, 134*c*, 134*d*, two flaps (e.g., the flaps 134*a* and 134*c*) and the other flaps (e.g., the flaps 134*b* and 134*d*) swing in opposite directions of each other.

Figure 48:
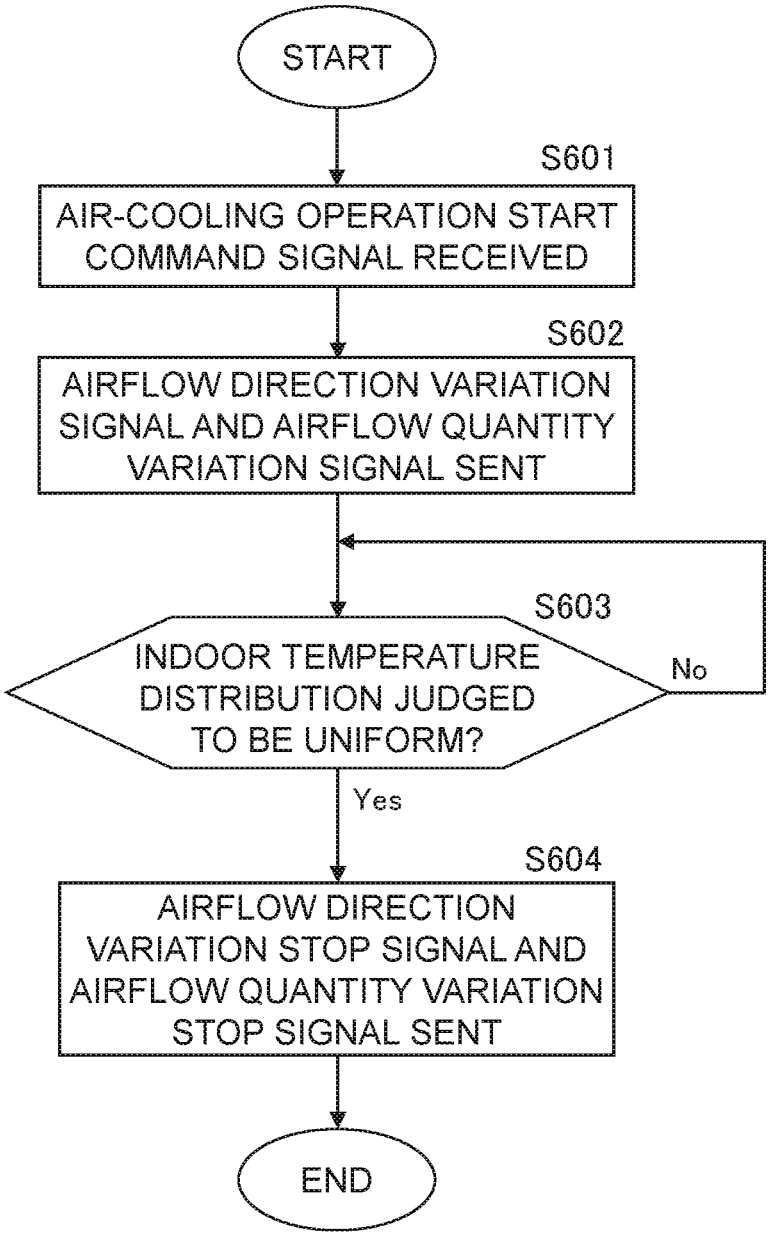
FIG. 48 is flowchart showing the flow of the control action of the initial air-cooling action control unit according to modification 5E.

Next, FIG. 48 is used to describe the control action by the initial air-cooling action control unit 665. As described above, the initial air-cooling action control unit 665 executes initial air-cooling control only when automatic control mode has been set by the user during the start of the air-cooling operation. Specifically, initial air-cooling control is not executed by the initial air-cooling action control unit 665 when manual control mode has been set by the user whether it be the start of the air-warming operation or the start of the air-cooling operation.

Upon receiving the air-cooling operation start command signal sent from the receiver 661 (step S601), the initial air-cooling action control unit 665 starts executing initial air-cooling control. Specifically, the initial air-cooling action control unit 665 receives an air-cooling operation start command signal sent from the receiver 661 that has received an air-cooling operation start command issued by the user in the room, and the initial air-cooling action control unit 665 thereby starts executing initial air-cooling control.

During initial air-cooling control, the initial air-cooling action control unit 665 first sends an airflow direction variation signal pertaining to the opposite-side swing action to the airflow direction control unit 663, and sends an airflow quantity variation signal to the airflow quantity control unit 662 (step S602). Having been sent an airflow direction variation signal pertaining to the opposite-side swing action from the initial air-cooling action control unit 665, the airflow direction control unit 663 controls the drive motors 138*a*, 138*b*, 138*c*, 138*d* so that the flaps 134*a*, 134*b*, 134*c*, 134*d* go into the opposite-side swing state. Having been sent an airflow quantity variation signal from the initial air-cooling action control unit 665, the airflow quantity control unit 662 controls the rotational speed of the fan motor 132*a* so that the airflow quantity of the indoor fan 132 reaches the first airflow quantity H rather than the set airflow quantity that has been set by the user.

After the airflow direction variation signal pertaining to the opposite-side swing action and the airflow quantity variation signal have been sent in step S602, when the indoor temperature distribution is judged to be uniform by the deciding unit 666 (step S603), the initial air-cooling action control unit 665 sends an airflow direction variation stop signal to the airflow direction control unit 663 and sends an airflow quantity variation stop signal to the airflow quantity control unit 662 (step S604). Having been sent an airflow direction variation stop signal from the initial air-cooling action control unit 665, the airflow direction control unit 663 controls the drive motors 138*a*, 138*b*, 138*c*, 138*d* so that all of the flaps 134*a*, 134*b*, 134*c*, 134*d* go into the horizontal blowing stationary state. Having been sent an airflow direction variation stop signal from the initial air-cooling action control unit 665, the airflow quantity control unit 662 controls the fan motor 132*a* and thereby varies the airflow quantity of the indoor fan 132 from the first airflow quantity H to the set airflow quantity that has been set by the user. Initial air-cooling control by the initial air-cooling action control unit 665 is thereby ended. The initial air-cooling action control unit 665 does not send an airflow direction variation stop signal or an airflow quantity variation stop signal until the indoor temperature distribution is judged to be uniform by the deciding unit 666 following the sending of the airflow direction variation signal pertaining to the opposite-side swing action and the airflow quantity variation signal (step S603).

Thus, initial air-cooling control suited to the environment in the room can be executed by deciding the ending time point of the initial time period on the basis of the detection results of the intake temperature Tr.

In the present modification, the ending time point of the initial time period is decided to be the time point when the indoor temperature distribution is judged to be uniform by the deciding unit 666, but is not limited as such; the ending time point of the initial time period may be the time point when the optimal time duration set in advance has elapsed, or any time point earlier than the time point when the indoor temperature distribution is judged to be uniform by the deciding unit 666. Combining modification 5D and the present modification, the ending time point of the initial time period may be either the ending time point of the learning operation time duration of modification 5D, or any time point earlier than the time point when the indoor temperature distribution is judged to be uniform in the present modification.

Furthermore, in the modifications described above, at the end of initial air-cooling control, a control signal is sent to the airflow direction control unit 663 so that the flaps 134*a*, 134*b*, 134*c*, 134*d* go into the horizontal blowing stationary state, and a control signal is sent to the airflow quantity control unit 662 so that the airflow quantity of the indoor fan 132 shifts from the first airflow quantity H to the set airflow quantity that had been set by the user. Instead of this, as in modification 5C, after the flaps 134*a*, 134*b*, 134*c*, 134*d* have been switched from the opposite-side swing state to the horizontal blowing stationary state, initial air-cooling control in which the first airflow quantity H is maintained may be executed until the air-cooling thermo-on state switches to the air-cooling thermo-off state a predetermined number of times (e.g., 2 times) or more.

In the modifications described above, the indoor temperature distribution is judged to be uniform by the deciding unit 666 when the intake temperature Tr is equal to or less than a value of one degree subtracted from the set temperature Trs, but the method for judging that the indoor temperature distribution is uniform is not limited thereto. For example, the deciding unit 666 of the indoor unit 130 may judge the indoor temperature distribution to be uniform in coordination with a wireless sensor network for detecting the temperature in multiple locations in the room. Another possible example, in a case in which the air conditioning apparatus 110 has a floor temperature sensor capable of detecting the floor temperature of the room where the indoor unit 130 is installed, is that the indoor temperature distribution may be judged to be uniform by the deciding unit 666 when the intake temperature Tr detected by the intake temperature sensor T1 and the floor temperature detected by the floor temperature sensor are substantially equal (e.g., ±0.5° C.).

The control device according to the present invention, which exhibits the effect of being able to improve the level of comfort within the room, is useful as a control device or the like of an air conditioning apparatus which can vary the directions of airflows supplied from discharge ports by controlling flaps disposed in the discharge ports.

What is claimed is:

1. An air conditioning apparatus comprising:

a blow-out portion in which discharge ports are formed;

flaps arranged and configured to vary vertical directions of air blown out into a room from the discharge ports, the flaps being disposed in proximity to the discharge ports, and the flaps being configured to be swung up and down; and a control device configured to control a swing action of the flaps, the control device including an operation mode determining section configured to determine at least an air-cooling operation mode and an air-warming operation mode that are operation modes of the air conditioning apparatus, a swing pattern storage area configured to store a plurality of swing patterns that include information pertaining to the swing action, a control command generator configured to generate a control command of the air conditioning apparatus on the basis of a swing pattern corresponding to the mode determined by the operation mode determining section from among the plurality of swing patterns, a judgment unit configured to judge whether or not there is a state of temperature nonuniformity in which temperature nonuniformity is occurring in the room, a receiver configured to receive a swing action start command for the flaps from the user, and a temperature nonuniformity resolution control unit configured to execute temperature nonuniformity resolution control either when the judgment unit judges that the state of temperature nonuniformity is in effect or when the receiver receives the swing action start command, the temperature nonuniformity resolution control unit being configured to control driving of the flaps during the temperature nonuniformity resolution control so that the swing action of the flaps is started, and when a predetermined condition is fulfilled, the swing action of the flaps is stopped, and the predetermined condition being either a first condition in which a first predetermined time duration set in advance has elapsed following the start of the swing action, a second condition in which a learning operation time duration, which is decided by learning past operation records, has elapsed following the start of the swing action, or a third condition in which the judgment unit has judged that the state of temperature nonuniformity is not in effect.

2. The air conditioning apparatus according to claim 1, further comprising:

a fan configured to produce a flow of air blown out from the discharge ports when driven, the temperature nonuniformity resolution control unit being configured to control driving of the fan during the temperature nonuniformity resolution control so that an airflow quantity of the fan reaches a maximum.

3. The air conditioning apparatus according to claim 2, wherein when the temperature nonuniformity resolution control unit executes the temperature nonuniformity resolution control while the air conditioning apparatus is in the air-warming operation mode, the driving of the flaps is controlled so that after the swing action of the flaps has been stopped, the flaps assume a downward blowing orientation in which air is blown out downward from the discharge ports.

4. The air conditioning apparatus according to claim 3, wherein the temperature nonuniformity resolution control unit has a learning unit configured to decide the learning operation time duration; and the learning unit is configured to decide the learning operation time duration using a time duration during which a thermo-on state continues.

5. The air conditioning apparatus according to claim 4, wherein the learning unit is configured to decide the learning operation time duration in any one of the following cases a case in which a test operation has been performed, a case in which the number of switches from the thermo-on state to a thermo-off state reaches a predetermined number or greater, a case in which a predetermined time set in advance has passed, and a case in which a second predetermined time duration has elapsed following the deciding of the learning operation time duration.

6. The air conditioning apparatus according to claim 2, wherein the temperature nonuniformity resolution control unit has a learning unit configured to decide the learning operation time duration; and the learning unit is configured to decide the learning operation time duration using a time duration during which a thermo-on state continues.

7. The air conditioning apparatus according to claim 1, wherein when the temperature nonuniformity resolution control unit executes the temperature nonuniformity resolution control while the air conditioning apparatus is in the air-warming operation mode, the driving of the flaps is controlled so that after the swing action of the flaps has been stopped, the flaps assume a downward blowing orientation in which air is blown out downward from the discharge ports.

8. The air conditioning apparatus according to claim 7, wherein the temperature nonuniformity resolution control unit has a learning unit configured to decide the learning operation time duration; and the learning unit is configured to decide the learning operation time duration using a time duration during which a thermo-on state continues.

9. The air conditioning apparatus according to claim 1, wherein the temperature nonuniformity resolution control unit has a learning unit configured to decide the learning operation time duration, and the learning unit is configured to decide the learning operation time duration using a time duration during which a thermo-on state continues.

10. The air conditioning apparatus according to claim 9, wherein the learning unit is configured to decide the learning operation time duration in any one of the following cases a case in which a test operation has been performed, a case in which the number of switches from the thermo-on state to a thermo-off state reaches a predetermined number or greater, a case in which a predetermined time set in advance has passed, and a case in which a second predetermined time duration has elapsed following the deciding of the learning operation time duration.

11. The air conditioning apparatus according to claim 1, further comprising:

a first temperature sensor configured to detect temperature in proximity to a floor of the room; and a second temperature sensor configured to detect temperature in proximity to the blow-out portion, the judgment unit being configured to judge whether or not the state of temperature nonuniformity is in effect on the basis of the detected temperatures of the first temperature sensor and the second temperature sensor.

12. The air conditioning apparatus according to claim 11, wherein the blow-out portion is installed in proximity to a ceiling of the room.

13. The air conditioning apparatus according to claim 1, wherein the blow-out portion is installed in proximity to a ceiling of the room.

* * * * *